US006033316A

United States Patent [19]

Nixon

[11] Patent Number: 6,033,316

[45] Date of Patent: Mar. 7, 2000

[54] GOLF COURSE PROGRESS MONITOR TO ALLEVIATE SLOW PLAY

[76] Inventor: Rodger Nixon, 1520 York Ave., #6-D, New York, N.Y. 10028

[21] Appl. No.: 08/908,466

[22] Filed: Aug. 7, 1997

[51] Int. Cl.[7] ..... A63B 57/00; G04B 47/00

[52] U.S. Cl. ..... 473/131; 473/409; 368/107

[58] Field of Search ..... 473/131, 407, 473/409; 463/1, 35; 704/200, 258, 270, 274; 368/10, 107–113; 434/307 R

[56] References Cited

U.S. PATENT DOCUMENTS

| | | | |
|---|---|---|---|
| 4,303,243 | 12/1981 | Wolf . | |
| 5,086,390 | 2/1992 | Matthews . | |
| 5,097,416 | 3/1992 | Matthews . | |
| 5,305,201 | 4/1994 | Matthews . | |
| 5,324,028 | 6/1994 | Luna | 473/409 |
| 5,335,212 | 8/1994 | Bartos | 368/107 |
| 5,523,985 | 6/1996 | Nixon | 368/107 |

*Primary Examiner*—Valencia Martin-Wallace
*Assistant Examiner*—Mark A Sager
*Attorney, Agent, or Firm*—Hoffman, Wasson & Gitler

[57] ABSTRACT

A monitoring device, which indicates the position a golfer must be on the golf course in order to complete the course in a specified period of time. The progress monitor operates on the basis of its electronic memory being loaded with parameters governing the amount of time to be allocated, or apportioned, to any number of different facets of play, or to any number of different holes or to the course as a whole. Such parameters may be fixed amounts of time or percentages of some other factor, such as the total time for the round. Based on these parameters, the progress monitor uses either a continuously moving display or a series of displayed notices on a panel such as an LCD screen, or as a graphic display, or a spoken message to show a golfer where he or she should be on the course at any point in time if the golfer is to complete the round within the designated target time. The progress monitor provides for the golfer to nominate any hole as the starting point. The progress monitor also allows the golfer at any time to indicate the actual position they have reached on the golf course. Given such an indication, the progress monitor automatically recalibrates the progress monitor so that the display correctly shows the increased or decreased rate at which the golfer must move to still complete the round in the target time.

25 Claims, 41 Drawing Sheets

GOLF COURSE PROGRESS MONITOR TO ALLEVIATE SLOW PLAY

BACKGROUND OF THE INVENTION

1. Field of the Invention

The present invention relates to a monitoring device, hereafter a progress monitor for use on a golf course to help keep golfers move at a pace that enables them to meet course designated target times for completion of their rounds. More particularly the present invention relates to a progress monitor that allows any useful number of the different facets of the game of golf, such as teeing off, playing down the fairway, putting out and walking between holes, to be distinguished. For each of these facets of the game and for the game as a whole the progress monitor allows for the input of parameters. For example, one parameter might be the designated time to complete the whole round. Parameters may be input in the form of fixed quantities of time for a particular facet of play or for a particular hole. Alternatively, or in combination, factors such as a percentages, of the total time for a hole or for a round, may be entered governing how time, for a particular facet of play or for a particular hole, is to be apportioned From the parameters for the individual facets of the game and for the game as a whole, the amount of time that will be spent on any or all of these facets of the game, for any or all holes, will be calculated or taken by the progress monitor. Based on the inputs the progress monitor continuously displays or periodically advises the golfer where he or she should be on the course at that moment if the golfer is to complete his or her round in the specified time. It also allows for the golfer to enter the actual position he or she is on the course. Given this input it recalibrates the progress monitor so that the remaining time is uniformly apportioned, according to the initial percentages or times per hole, so the golfer may still achieve the target completion time. If the golfer is behind schedule the progress monitor will indicate the faster rate of play required, if the golfer is ahead of schedule the progress monitor will indicate the slower rate at which play can continue and still meet the target time. Beside providing guidance for the normal game, which is started from the first tee, the progress monitor will also allow for a starting hole other than the first to be entered by the user, to cater for those situations, such as a "shotgun start" where the field for a tournament starts at different holes simultaneously. Regardless of the starting hole, the progress monitor will accurately determine the position where a golfer should be on the course at that moment if the golfer is to complete his or her round in the specified time.

2. Description of the Prior Art

Golf has experienced extraordinary growth in popularity throughout the world both as a sport and recreation. As the number of golfers increases, the demand for time on golf courses grows proportionally. While many groups of golfers can play on the same course simultaneously, a safe distance must be maintained between each group. This is to protect the group in front from being struck by a ball hit by the group behind.

If a group of golfers play too slowly, they force every group following them to play at their pace. This results in congestion and less than optimum utilization of golf courses by the greatest number of golfers. If clubs can improve the speed of play they can accommodate greater numbers of golfers and produce higher revenues. Although no golfers will admit to being slow golfers, all regard it as one of the most frustrating aspects of the game today. If overall speed improved both golf clubs and golfers would benefit. The game would be much more enjoyable for golfers and more profitable for the golf clubs.

Clubs have adopted various measures to improve playing speed. Such as, insisting on the use of carts, eliminating the rough and employing marshals to police the course. These steps have had a minimal effect. Today, many games take over five hours to complete. It should take golfers of even modest ability no more than fours hours to complete a round.

Many clubs have tried posting signs throughout the course indicating how long it should take a golfer to reach that point. These signs are not effective. For a start, they require golfers to do mental arithmetic, subtracting start time from current time to calculate whether they are ahead of, or behind, the standard.

All golfers believe they are playing quickly, that it is the group ahead causing the delays. If they are not on time at a particular sign they blame it on that group. Of course, they may be right, there is no way at present to easily determine where the problem starts. Because golfers do not easily relate their play to the signs, they quickly cease to have any impact.

The root cause of slow play is that most golfers do not have any idea of the proper speed to play golf. Signs are too static. The individual golfer does not make the connection between his play and the signs. Until individuals make that connection, they will not be encouraged to make the simple changes in their playing habits that will improve the situation for all golfers.

What is needed is an effective, non subjective, way to enable every individual golfer to monitor their progress around the course relative to standards the club has established. This device would give golfers immediate feedback if they were falling behind. The device would in some way politely, but emphatically, convey the message, "speed up", directly to the individual golfer.

Nixon, the inventor of the present progress monitor, has already been issued a patent in the field. (U.S. Pat. No. 5,523,985), which is incorporated herein by reference. The Nixon patent relates to an invention that provides continuous monitoring in the form of a portable progress monitor that can be used by individual golfers. The Nixon invention allows for the input of a target time for completion of the round, but operates on the basis of an even distribution of time per hole (approximately 5.56% per hole). The advantage of this approach is that it simplifies use by not requiring settings for individual holes. The position in U.S. Pat. No. 5,523,985 is that there are so many variables affecting rate of play that per hole settings are unnecessary and that, in the range of target times that would be usual, it will be accurate enough to be useful.

The United States Golf Association (USGA) has recently introduced a set of rating for golf courses that, for a specific target time, apportion the time per hole according to various criteria (such as par, length, degree of difficulty, etc.). If the view that the apportionment of time can be improved by taking such criteria into account is valid, then the Nixon invention is incapable of providing this functionality.

In the device disclosed in U.S. Pat. No. 5,386,990, Smith, provision is made for allocating varying amounts of time per hole. However, the Smith progress monitor operates on the basis of a countdown timer moving hands at a steady pace and having 18 leaves that can be spaced out so the amount of time taken per hole varies according to the spacing. The most severe drawback of the Smith invention is that it would be extremely difficult to set accurately. In many cases the differences between times that should be spent on one hole as opposed to another will be small. The Smith progress monitor depends for its performance on being able to visually distinguish that a spacing for one hole should represent 5% of the target time and another should represent 5.5%. Further, it is intrinsic to the design that any inaccuracy in the setting of the spacing for one hole will always result in the provision of time for at least one other hole also being inaccurate. That is because any time added erroneously to one hole means that somewhere on the course less time than intended is available for another hole. The Smith invention is specifically dependent upon a countdown timer moving at a constant pace.

Rather than using a countdown timer and a hand rotating at constant speed as is proposed in both the Nixon and Smith patents, numerous advantages in improved accuracy can be obtained by using a progress monitor that internally knows the specific amount of time to allocate per hole and displays that information by, for example, rotating one degree in a amount of time that varied according to the hole being played.

By allowing the suggested time per hole to be explicitly entered, either directly or in the form of percentages, the inaccuracy inherent in the manual setting of the Smith progress monitor is eliminated.

The view that for each hole there are factors that determine the speed at which it is practical to expect golfers to play the whole course is fundamental to the invention. In no prior art device are the factors that affect the amount of time that should be allowed for a particular hole explicitly used in an algorithm to calculate the apportionment of time. Such an approach is feasible, and is covered by the progress monitor of the present invention. However, this is not the preferred method of implementation for the invention. The preferred implementation expects such factors would be considered externally and only the resulting apportionment entered as actual times per hole, or as percentages of a target time.

None of the prior art devices takes into account the fact that there are places on the golf course where time spent is relatively independent of factors such as the par for the hole, its length or the degree of difficulty of the hole. For example, there is no obvious reason why the time it would take a group of golfers to hit their tee shots on one hole should be different to the time it would take them to hit their tee shots on another. Likewise, on its face, it would seem that the amount of time a group would spend on the putting green would be independent of the par for the hole. In theory, accuracy could be further improved by allowing for the progress monitor to allocate a fixed amount of time per hole for teeing off and putting out and a variable amount only for the activity in between.

It is important to understand what the term accuracy means in the context of a progress monitor. A progress monitor can be considered accurate if the position it indicates a golfer should be on the course, at a given point in time, is a point a typical golfer playing at a comfortable and steady pace would naturally have reached.

Accuracy, in the above sense, is vitally important to the success of any progress monitor. If the progress monitor forces unnatural behavior, rather than improvement in golfing habits, it is unlikely to be successful.

Combining the approach of entering the parameters for the round (target time and percentage of time or actual time to be allocated for each hole) with (for example) a microprocessor based progress monitor greatly simplifies the process of setting the progress monitor and obviates the need for a countdown timer. In a watch like progress monitor such as that envisaged by Nixon, in one embodiment of the progress monitor, the microprocessor could simply control the number of degrees, or fractions of a degree, the rotating main hand would move around the face in a given time. A variety of alternative displays are also made possible. For example, rather than hands, an LCD type display could be used that simulated a moving hand by "graying" out the portion of the face that a hand would have covered. Another alternative would be a progress monitor that displayed a message, such as "You should now be on the fifth tee", or "You should now be moving up the fifth fairway", or "You should be on the fifth green". Other approaches would show the position graphically. Conceptually, the progress monitor could have a speaker and rather than displaying these announcements, they could be made verbally through a speaker on the progress monitor (on request by a golfer wanting to know his or her positional situation).

Further, as an alternative to a mechanism by which the percentages per hole and target times could be entered into the progress monitor manually, a microprocessor based progress monitor would make it feasible to download the parameters from a computer through an appropriately designed interface. The significant advantage of such a progress monitor would be that it would make it then feasible to provide, through CD ROM or by internet connection, a centralized repository of golf course ratings. Golfers using different courses could then plug in their progress monitors and load in the appropriate parameters for the course on which they are going to play.

In all progress monitors mentioned in the prior art, the assumption is made that golfers given the ability to monitor their progress will stay on schedule. However, circumstances may preclude this. Few golfers are likely to take kindly to the approach that they not play a hole to get back to the point they should be on the course. However, they may be amenable to speeding up play by a small amount per hole, over all the remaining holes, to still meet the target time. No previously described progress monitor in the field provides any such recalibration facility.

Progress monitors in the prior art all show the first hole as the starting point. No progress monitor in the prior art provides a mechanism for simply and explicitly nominating some other hole as the starting point and adjusting the progress monitor so that it will accurately display the appropriate position for a golfer at any point in time for the 18 holes they will play in order from that starting point.

SUMMARY OF THE INVENTION

The forgoing and other deficiencies of the prior art are addressed by the progress monitor of the present invention. Several embodiments are described. All embodiments provide for the input of parameters regarding the various facets of play to be allocated to each of the holes to be played.

It is a particular objective of the progress monitor of the present invention to allow for parameters, relating to the various facets of play for each of the holes to be played, to be downloaded into the progress monitor by way of an interface to a computer or like system (such as an internet capable device). In such an embodiment the actual time per hole could be calculated on the computer and downloaded rather than necessarily being calculated by the progress monitor.

All embodiments provide a means by which the golfer can easily and at any moment determine whether he or she is on schedule. In one embodiment, information would be displayed by a continuously moving hand in a manner similar to that shown in the Nixon device (U.S. Pat. No. 5,523,985). It would differ from that invention in that the hand would move at a variable speed between fixed markings in accordance with the time allotted for the individual hole. In another embodiment, rather than a rotating hand an LCD type display would be used that showed the position the golfer should be in by way of darkening of that sector containing the holes that should have been played. In a further embodiment, rather than a continuously moving display, a message would be displayed on a screen advising the golfer where he or should be on the course at that moment.

It is another objective of the progress monitor of the present invention to allow a golfer to delegate a specific hole, other than the first hole, as the starting point for the round.

It is another objective of the progress monitor of the present invention to allow a golfer to enter his or her actual position on the course and have the progress monitor recalibrate so that the pace is adjusted to reflect the faster or slower pace the golfer must play to still achieve the target time.

BRIEF DESCRIPTION OF THE DRAWINGS

The foregoing objects and other attributes of the progress monitor will be described with respect to the following drawings in which.

DETAILED DESCRIPTION OF THE INVENTION

Figure 1:
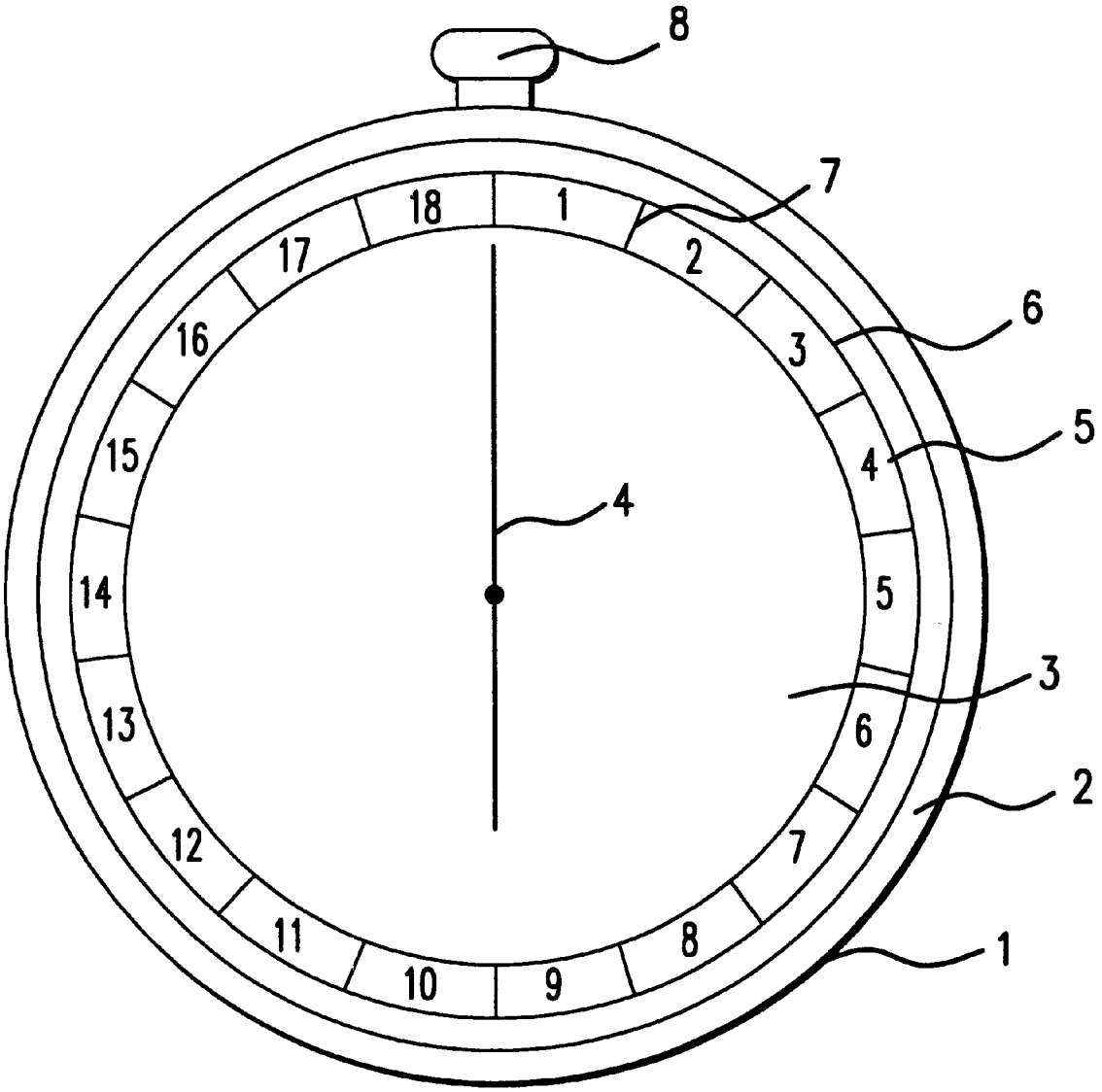
FIG. 1 is a front view of a first embodiment of the progress monitor.

Referring to FIG. 1, a first embodiment of the progress monitor 1 of the present invention is illustrated. The progress monitor has a case 2 with a face or dial 3. Inside the progress monitor is a mechanism, not shown, for rotating main hand 4 in a clockwise direction. The dial 3 has a series of numbers 5, each of which corresponds to a hole on the golf course.

In the first embodiment of the progress monitor 1 shown in FIG. 1 the numbers 5 are provided around the circumference of the dial 3, and are positioned inside of equally sized arcuate segments of circular ring 6. The first embodiment has eighteen holes corresponding to the typical number of holes on a golf course. Each number 5 is positioned in an arcuate segment so that it is preceded by a line 7. The lines 7 represent the tees for each of the holes. Therefor, the line 7 preceding the numeral 1 of the dial 3, represents the first tee, the line 7 preceding the numeral 2, represents the second tee, and so on.

In use, the golfer sets the desired duration of the round of golf to be played, in a manner to be described later. The golfer also enters the percentage of the desired duration to be allocated to each of the holes to be played, in a manner to be described later. The time it takes for the main hand 4 of the progress monitor 1 to complete a single rotation will equal the set duration for the round of golf. The main hand 4 starts at the 12 o'clock position at the line 7 between numerals 18 and 1, which represents the first tee. When the golfer or golfers are ready to begin playing their round the start/stop button 8 is depressed to start the main hand 4 rotating clockwise.

When the main hand 4 reaches the line 7 between the numerals 1 and 2 the golfer or golfers should be at the second tee. When the main hand 4 reaches the line 7 between the numerals 2 and 3 the golfer or golfers should be at the third tee, and so on.

The speed at which the main hand 4 moves between lines 7 depends upon the proportion of time allocated to the hole.

Figure 2:
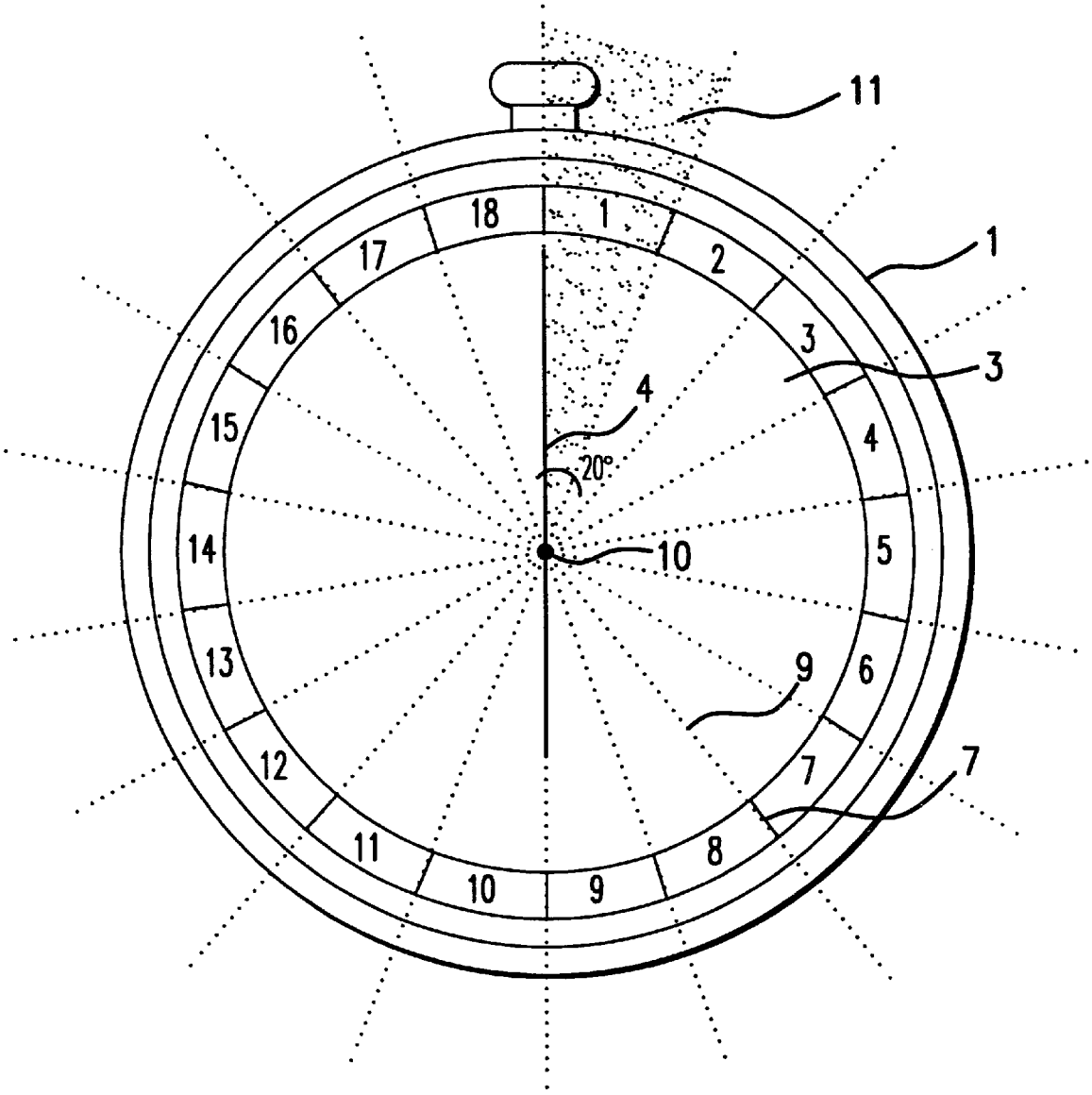
FIG. 2 is a front view of the first embodiment of the progress monitor, laid on top of a schematic, that shows how the progress monitor is organized into eighteen identical segments.

FIG. 2 shows the first embodiment of the progress monitor, as shown in FIG. 1, overlaid on a grid of eighteen evenly spaced dotted lines 9 emanating from a central point that is the same as the center of rotation 10 of the main hand 4. FIG. 2 shows how the circular face 3 of the progress monitor 1 effectively comprises eighteen equally sized segments 11, each representing one hole on a golf course. The first segment 11 is shaded to highlight this point.

In the first embodiment of the progress monitor of the present invention, the rotating hand must cover 20 degrees (20°) to complete its passage through one segment. In this embodiment, one degree is designated the "unit of measure". When the golfer enters the total time and percentage of time to allocate to each hole these parameters are processed and converted to a table of values in the electronic memory of the progress monitor 1 that would be similar to the following:

| Total Time (Hours: Minutes) | Hole | Percentage | Time For Hole (Minutes: Secs) | Number of Units Of Measure (1°) | Time Per Unit Of Measure (Seconds, Tenths) |
|---|---|---|---|---|---|
| | | | | | |
| | | | | | |
| | | | | | |

Of these values, only the last two are essential for the operation of the progress monitor. The Total Time and the Percentage of total time to allocate to each hole are parameters entered by the user of the progress monitor 1. The Time For Hole is a value calculated by the progress monitor. The Number Of Units Of Measure, which in this case represents the number of units of measure for one hole, is a value known to the progress monitor 1. The Time Per Unit Of Measure is a value calculated by the progress monitor 1.

For example, take the case where the desired duration of the round is four hours (240 minutes). If time was equally apportioned to each hole approximately 5.56% of the total time would be spent on each of eighteen holes. The following is the type of information that would be stored in the electronic memory of the progress monitor, for this example:

Example 1

| Target Time (Hours: Minutes) | Hole | Percentage | Time For Hole (Minutes: Secs) | Number Of Units Of Measure (1°) | Time Per Unit Of Measure (Seconds, Tenths) |
|---|---|---|---|---|---|
| 4:00 | 1 | 5.56 | 13:20 | 20 | 40.0 |
| 4:00 | 2 | 5.56 | 13:20 | 20 | 40.0 |
| 4:00 | 3 | 5.56 | 13:20 | 20 | 40.0 |
| . . . | | | | | |

In Example 1, the parameters entered by the user of the progress monitor 1 are the target time for the round (four hours) and the percentage of that total time to allocate to each hole (5.56%). The time for each hole values calculated by the progress monitor 1 are thirteen minutes and twenty seconds for each hole. In this embodiment the unit of measure is one degree (1°) and the number of units of measure is twenty. The time per unit of measure value calculated by the progress monitor 1 is forty seconds for each hole.

In this case, to show the correct rate of play, the main hand 4 must take 13 minutes and 20 seconds to rotate from the line 7 between numerals 18 and 1, which represents the first tee to the line 7 between the numerals 1 and 2, which represents the second tee. It takes another 13 minutes and 20 seconds to rotate from the line 7 between numerals 1 and 2, which represents the second tee to the line 7 between the numerals 2 and 3, which represents the third tee, and so on.

Looking at it in terms of our units if measure, which in this embodiment are movements of the main hand 4 of one degree, in this example the main hand 4 must move one unit of measure every 40 seconds. That is, one degree (1°) every 40 seconds. In the first embodiment of the progress monitor 1 a microprocessor, not shown, may control movement of the main hand 4 so that it occurs in steps equal to the unit of measure, and from the information in the electronic memory it would determine the interval it must wait before it makes each movement of one unit.

In Example 1, the unit of measure was designated as one degree (1°). Alternatively, it could have been defined as a tenth of a degree (1/10°) and the progress monitor manufactured to operate in increments of such size. In this case, the main hand 4 would move a tenth of a degree (1/10°) every 4 seconds. The finer the increment the closer movement approximates a continually moving hand.

Now, look at another example. Consider the situation where, because of various factors, the course management determines that rather than 5.56% of the desired duration being spent on each hole, provision should be made for 6.5% to be spent on the first hole (starting holes might be considered likely to take longer than other holes, regardless of length and par because golfers take time to settle in to their games). Because of length, degree of difficulty or other factors they also determine that 4% of the desired duration should be spent on the second hole (a par 3, say) and 6% on the third hole (a par 5, say). In the progress monitor 1, in a manner to be described later, the golfer enters these percentages and the target time as parameters for the progress monitor 1. The following is the type of information that would be stored in the electronic memory of the progress monitor 1, for this example:

Example 2

| Target Time (Hours: Minutes) | Hole | Per-centage | Time For Hole (Minutes: Secs) | Number Of Units Of Measure (1°) | Time Per Unit Of Measure (Seconds, Tenths) |
|---|---|---|---|---|---|
| 4:00 | 1 | 6.5 | 15:36 | 20 | 46.8 |
| 4:00 | 2 | 4.0 | 9:36 | 20 | 28.8 |
| 4:00 | 3 | 6.0 | 14:24 | 20 | 43.2 |
| . . . | | | | | |

In this case, to show the correct rate of play, the main hand 4 must take 15 minutes and 36 seconds to rotate from the line 7 between numerals 18 and 1, which represents the first tee to the line 7 between the numerals 1 and 2, which represents the second tee. It must then take 9 minutes and 36 seconds to rotate from the line 7 between numerals 1 and 2, which represents the second tee to the line 7 between the numerals 2 and 3, which represents the third tee. It will then take 14 minutes and 24 seconds to rotate from the line 7 between numerals 2 and 3, which represents the third tee to the line 7 between the numerals 3 and 4, which represents the fourth tee.

Looking at it in terms of our units of measure, which in this embodiment are movements of the main hand 4 of one degree, in this second example the main hand 4 must move first move 20 units of measure at a rate of one unit of measure every 46.8 seconds. That is, one degree (1°) every 46.8 seconds (a tenth of a degree (1/10°) every 4.68 seconds). For the second hole, the main hand 4 must move 20 units of measure at a rate of one unit of measure every 28.8 seconds. That is, one degree (1°) every 28.8 seconds (a tenth of a degree (1/10°) every 2.88 seconds). For the third hole, the main hand must 4 move 20 units of measure at a rate of one unit of measure every 43.2. That is, one degree (1°) every 43.2 seconds (a tenth of a degree (1/10°) every 4.32 seconds).

In Example 1 the golfers have been allocated 13 minutes and 20 seconds per hole and 40 minutes in total to complete the first three holes. In Example 2 they have been allocated varying amounts of time per hole (15 minutes and 36 seconds, 9 minutes and 36 seconds, 14 minutes and 24 seconds respectively) and 39 minutes and 36 seconds in total to complete the first three holes. The difference is that in the second case, provided the parameters reflect factors that in the real world do affect pace for typical golfers on these holes, the progress monitor will more accurately demonstrate where the golfers should be. For example, the progress monitor 1 would show that after the first 13 minutes 20 seconds of play the golfers should be on the first green rather than on the second tee. This greater degree of accuracy should make such a progress monitor more acceptable.

Figure 3:
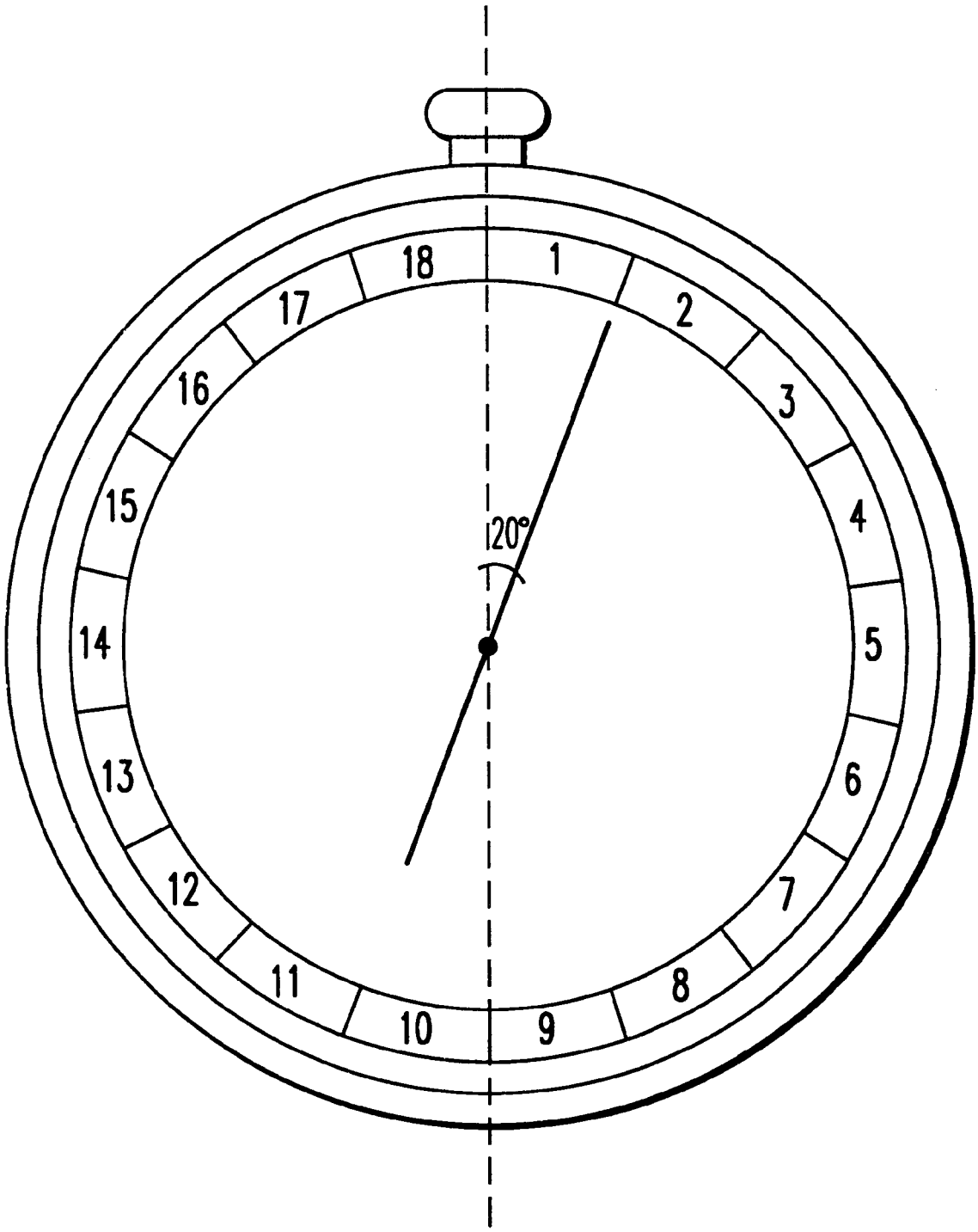
FIGS. 3, 4 and 5 are front views of the first embodiment of the progress monitor showing the changes in the position of a rotating hand that occur as time passes.
Figure 4:
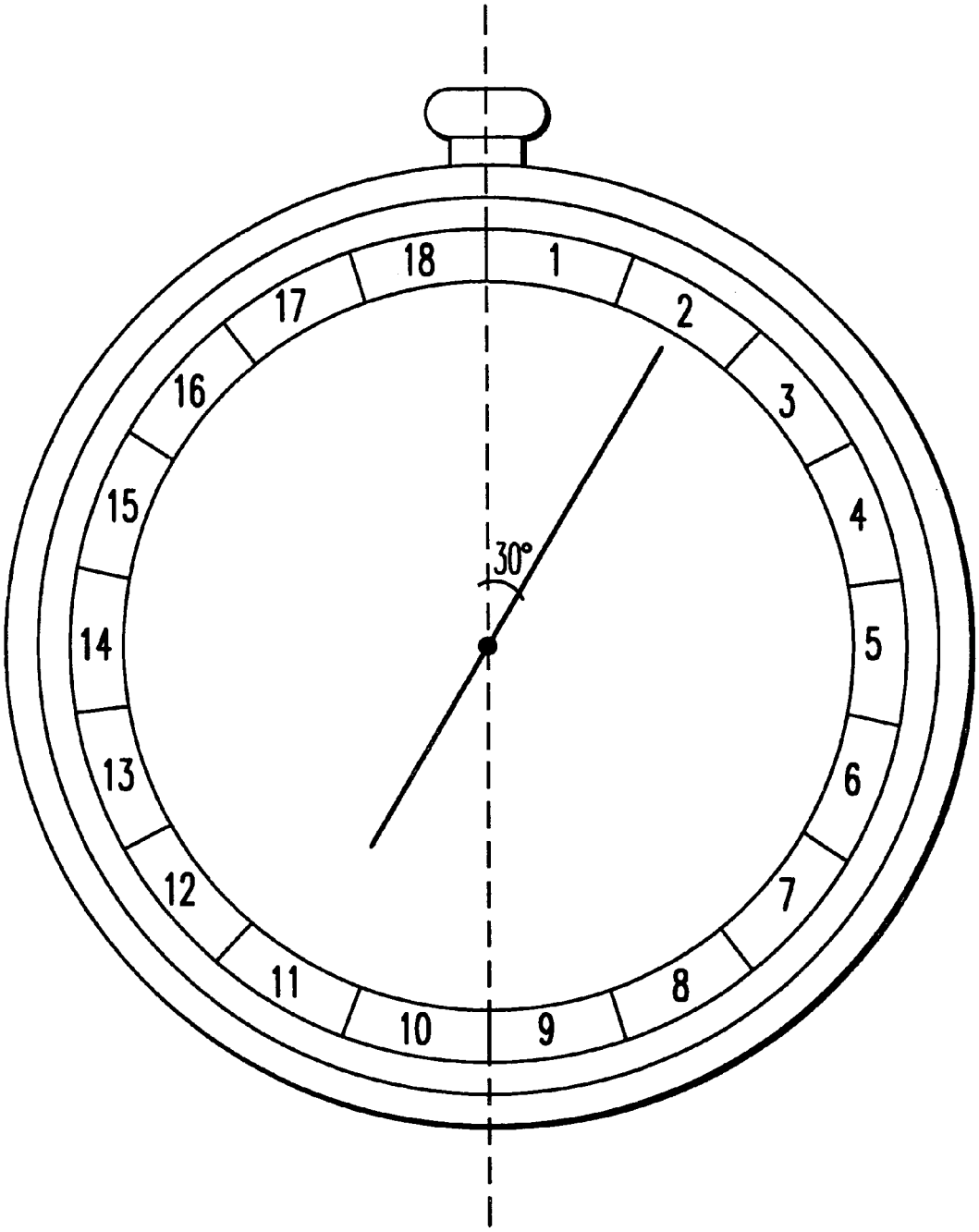
Figure 5:
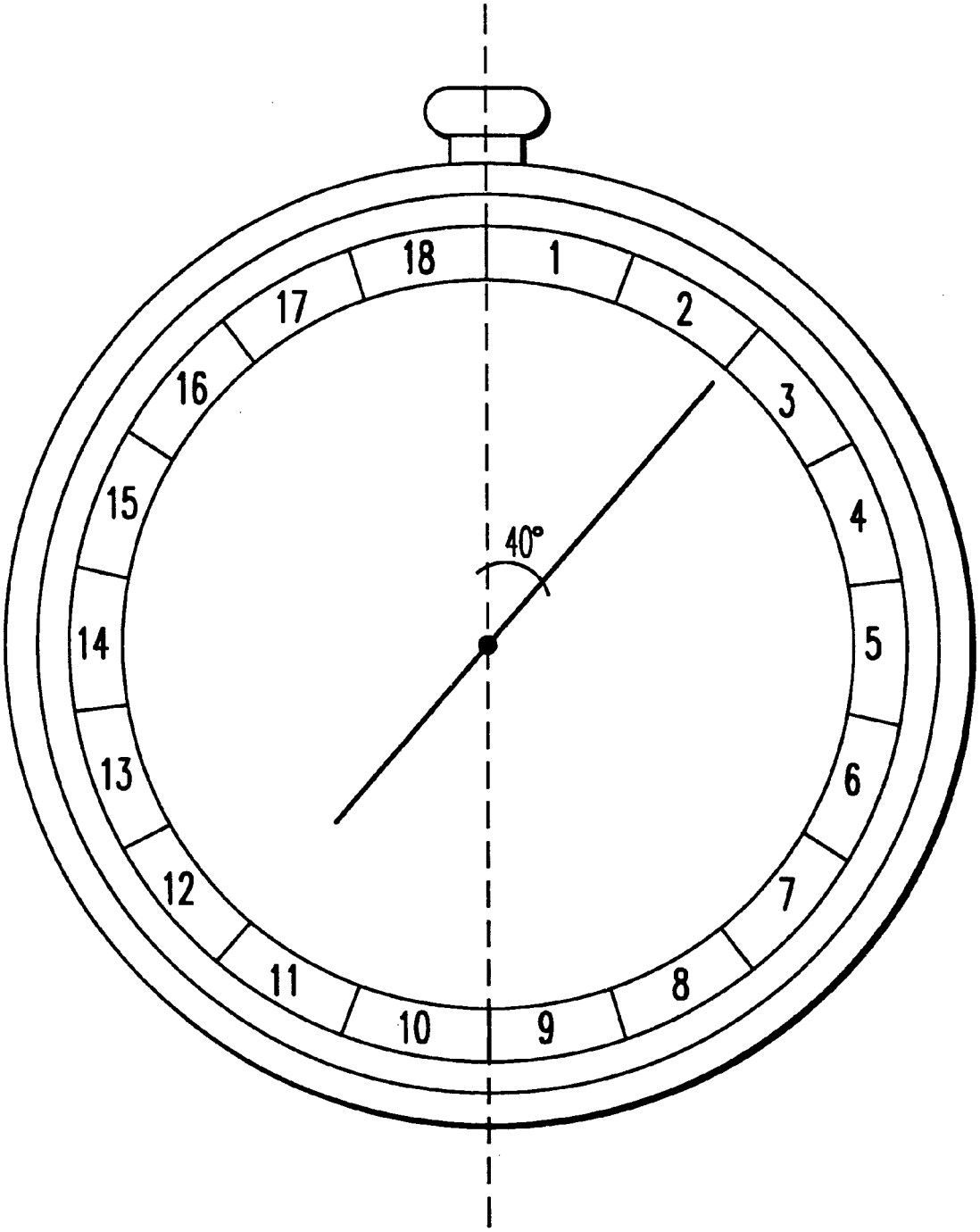

FIGS. 3, 4 and 5 illustrate movement of the rotating main hand 4 in the first embodiment of the progress monitor. Based on Example 2 above, FIG. 3 illustrates the way the face of this embodiment of the progress monitor 1 would look after 15 minutes and 36 seconds had elapsed, FIG. 4 illustrates the way the face of this embodiment of the progress monitor 1 would look after a further 4 minutes and 48 seconds had elapsed, FIG. 5 illustrates the way the face of this embodiment of the progress monitor 1 would look after a further 4 minutes and 48 seconds had elapsed.

Figure 6:
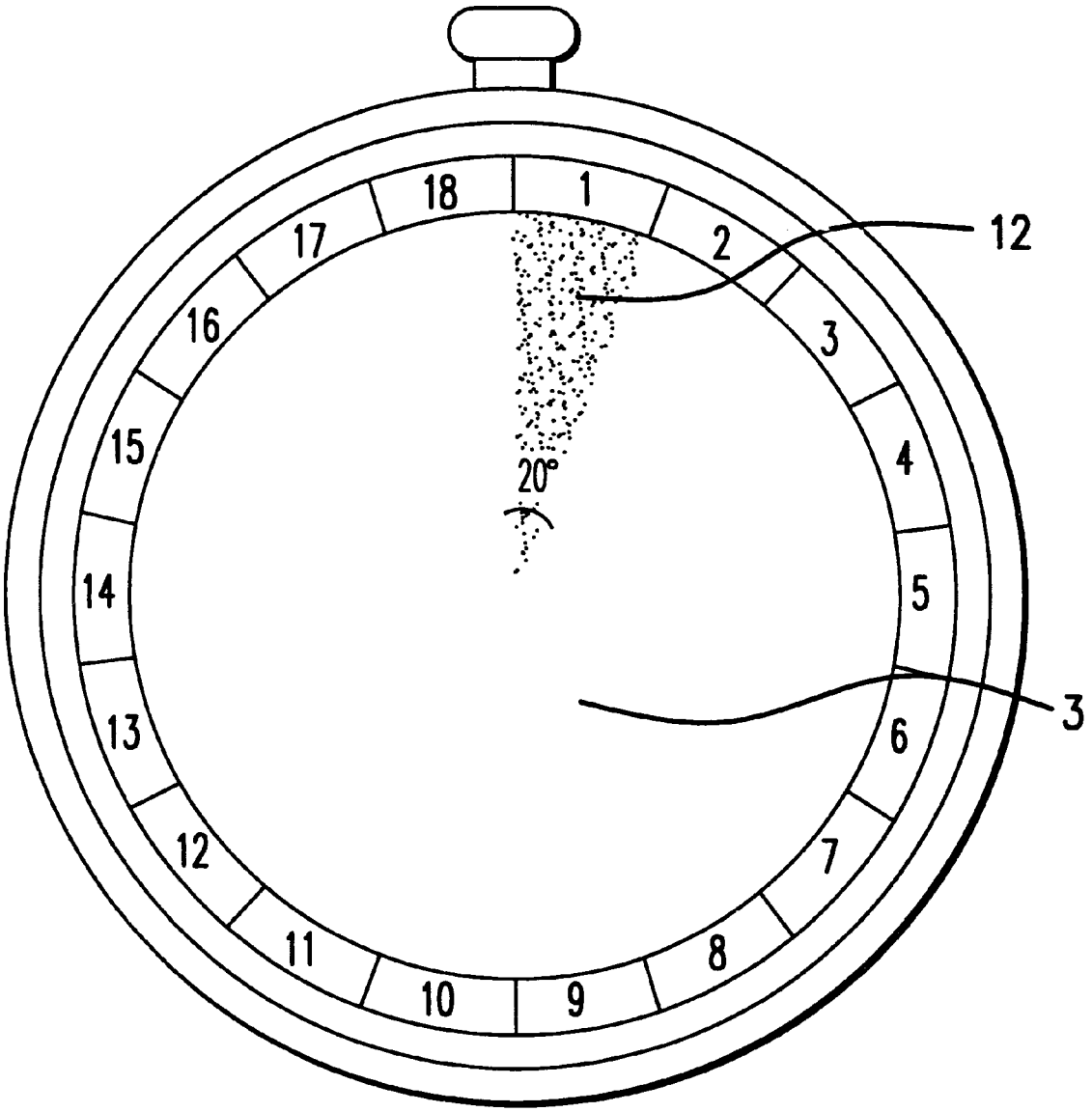
FIGS. 6, 7 and 8 are front views of a second embodiment of the progress monitor showing the changes on an LCD display that occur as time passes.
Figure 7:
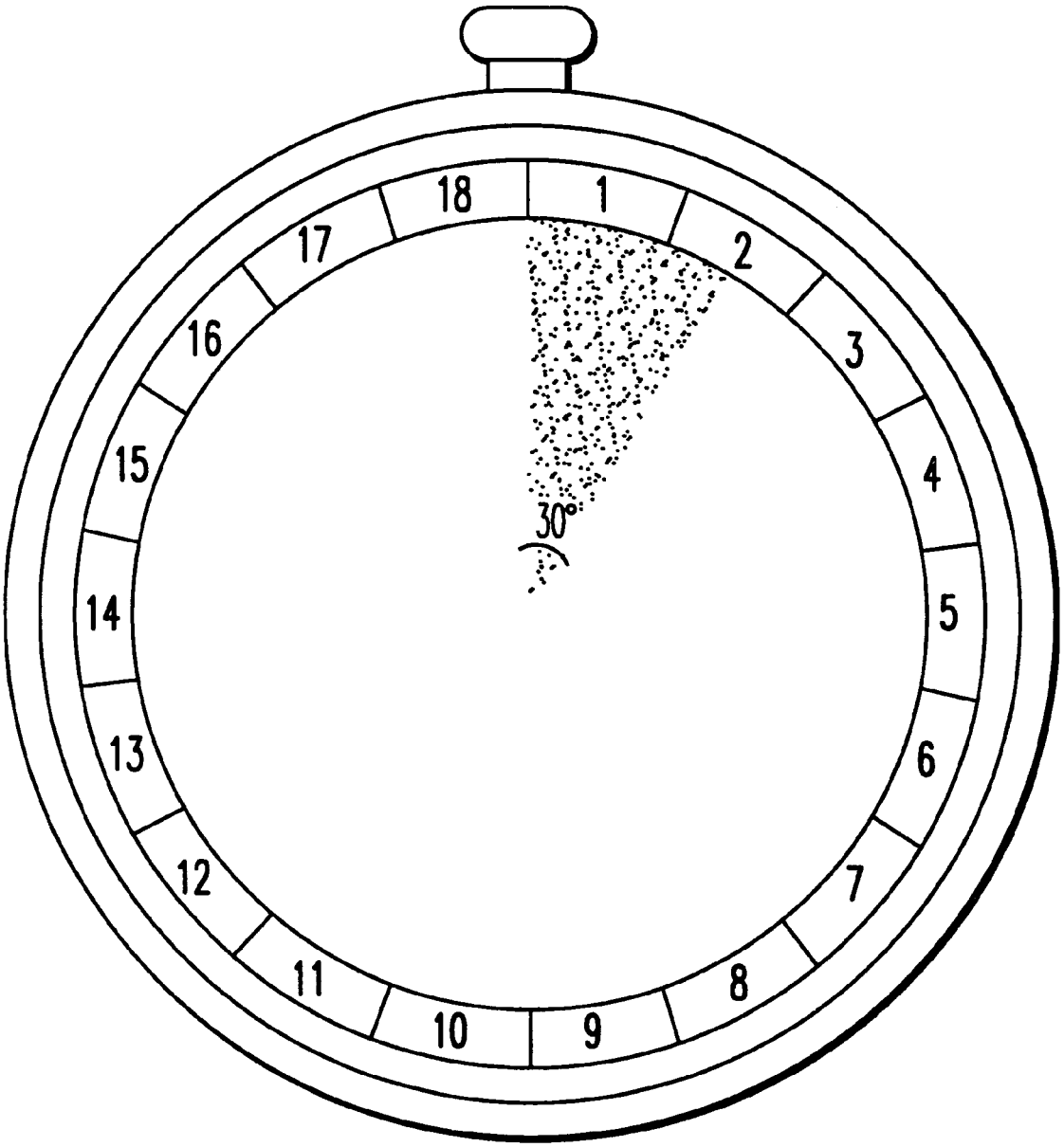
Figure 8:
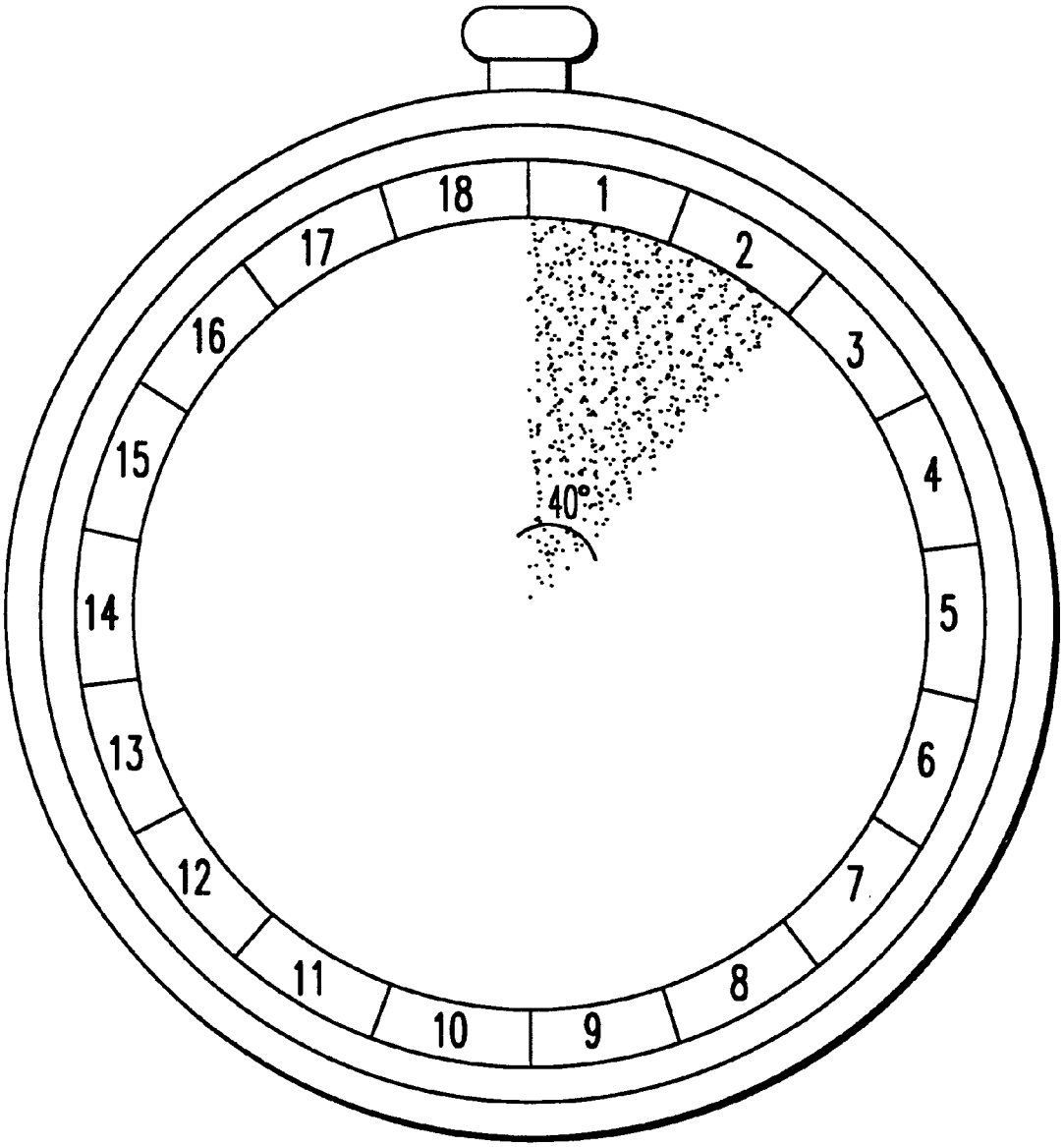

FIGS. 6, 7 and 8 illustrates a second embodiment of the progress monitor 1. The primary difference is that rather than a moving hand the dial 3 is an electronic display, such as an LCD or flat computer screen. Rather than a moving hand the positional situation is shown by a sector of darker color 12 that continuously increases as time passes. Based on Example 2 above, FIG. 6 illustrates the way the face of this embodiment of the progress monitor 1 would look after 15 minutes and 36 seconds had elapsed, FIG. 7 illustrates the way the face of this embodiment of the progress monitor 1 would look after a further 4 minutes and 48 seconds had elapsed, FIG. 8 illustrates the way the face of this embodiment of the progress monitor 1 would look after a further 4 minutes and 48 seconds had elapsed.

The mode of operation explained above, where the progress monitor moves an established number of units of measure at different rates depending on the parameters held in electronic memory, enables us to provide for different allocations of time to every hole, to cater for presumed variances in the optimal time it would take golfers to play those holes because of differences in their length, degree of difficulty and so on.

This mode of operation improves the accuracy of the progress monitor beyond that envisaged by Nixon (U.S. Pat. No. 5,523,985) and Smith (U.S. Pat. No. 5,386,990). However, in this embodiment as in those, the smallest discrete form of progress monitoring is a single hole. That is, all these progress monitors show progress through a hole as occurring at a uniform pace.

There are two drawbacks with this approach. The first is that it is less accurate than it could be. After several minutes these progress monitors would all show the golfers should be progressing down the fairway, while they may in fact be expected to be still teeing off. Or they might show that the golfers should be on the fairway, when in fact they should be putting out. The second drawback is, that in showing progress this way, a significant opportunity to improve the behavior of the golfer is lost.

A major objective of all these progress monitors is to solve the problem of slow play. Much slow play is caused by bad habits, or lack of understanding of how time can be saved by proceeding in a certain way. A progress monitor that merely operated on the principle of showing golfers where they should be will not solve the problem of slow play unless it encourages changes in behavior. It is unrealistic to think that golfers will react to the fact they are behind the point the progress monitor shows they should be by, for example, running down the fairway. So far as improving habits is concerned, a significant amount of time can be saved when golfers follow good etiquette on the tee and on the green. For example, always knowing whose turn it is to play. A progress monitor that explicitly showed golfers how much time they should spend on the tee, on the fairway and on the green would draw their attention directly to the need to apply these techniques for faster play.

Further, on the face of it, while the par of a hole, and by implication its length, should have a roughly proportional effect on the time it should take to move down the fairway, the time spent on the tees and greens could be expected to be largely independent of these factors. Ideally, a progress monitor would allow for the optimal time to be spent on tees and greens to be explicitly displayed and allow these times to be set as fixed amounts of time for all or most holes.

Thus far we have identified teeing off, moving down the fairway and putting out as separate components of the play on a hole of golf. From here on they will be referred to as "facets of play". A facet of play is not a technical term, it is simply a distinctive element in the way a hole of golf is played. There are other facets of play that can be added to these three. For example, the time it takes to move to the tee and from the green, the sum of which is generally the time to move from the end of one hole to the start of another (the distinction is made because the first factors might not be considered applicable to the first tee and the second might not be considered applicable to the last green). Another, important consideration that a progress monitor could be expected to take into account is "call up time". Call up time is a facet of play that deserves special mention and should well be explicitly allowed for by a progress monitor.

There is a misconception regarding slow play that needs correction. While it is true that the pace of play for all golfers is effectively determined by the slowest golfer anywhere ahead of them, it is not necessarily true that congestion is solely caused by other golfers catching up to this slow golfer. That is, it is not necessarily so that if all golfers moved at exactly the same pace there would be no congestion. In fact, congestion is eventually caused, even if golfers all move at the same speed, if the starter releases golfers at an interval that is less than the longest time it would take to play any par 3 hole on the course.

On most courses starting holes are par fours or par fives. Starters almost universally start a new foursome as soon as the preceding foursome has advanced beyond the range of the tee shot of any of the members of the following group. Let us assume this is seven minutes. If all groups proceeded at the same pace, this gap, of seven minutes, would be maintained throughout the round. However, par three holes disrupt this pattern. On a par three a following group can not begin to tee off until all members of a preceding group have not only finished putting out, but have moved out of range of any errant tee shot. If the time allowed for a par 3 is ten minutes, that means the following group, arriving seven minutes after the preceding group must wait three minutes before they can proceed with their game. This effectively resets the interval between the groups to ten minutes (the time for the par three). The group behind them arrives four minutes after they start teeing off and has to wait six minutes to begin teeing off. In theory, at the first par three all gaps are reset to the time of the hole. However, on both the Nixon and Smith progress monitor the displays would show each set of golfers as playing behind schedule.

A similar problem occurs when golfers on any hole can not play because golfers ahead are in range of another golfer who could otherwise play, however it is most obvious on par three holes.

There are two things that can be done to improve this situation. One is that starters let groups go at timed intervals that take this factor into account. With the assurance golfers will move at the same, good pace, this would very likely happen. The other is to speed up play on the par threes by making all or some of them "call up holes".

On a call up hole, as soon as a group of golfers have all put all their balls on the green they motion the group behind them to play up. That is, they stand aside while the following group hit their tee shots, and then proceed to put out. Then, with the following group now free to move up, the first group resumes putting. This practice does theoretically speed up play on the par three holes, but it does change the timings for the hole. In theory, for such a par three, calling up adds the time it would take to tee off to the time it would normally take to putt out on that green.

The point is, the progress monitor should allow for call up time in its calculations for the hole, and will be most effective if it highlights to the first group their responsibility to call the following group up.

A third embodiment of the progress monitor 1 provides the capability for a number of individual facets of play to be taken into account and for the time for each of the facets of play that are applicable to a particular hole to be individually monitored. Allowing for times to be individually determined for certain elements of play, such as teeing off and putting out, makes the progress monitor 1 capable of providing an even higher degree of positioning accuracy than thus far demonstrated.

Figure 9:
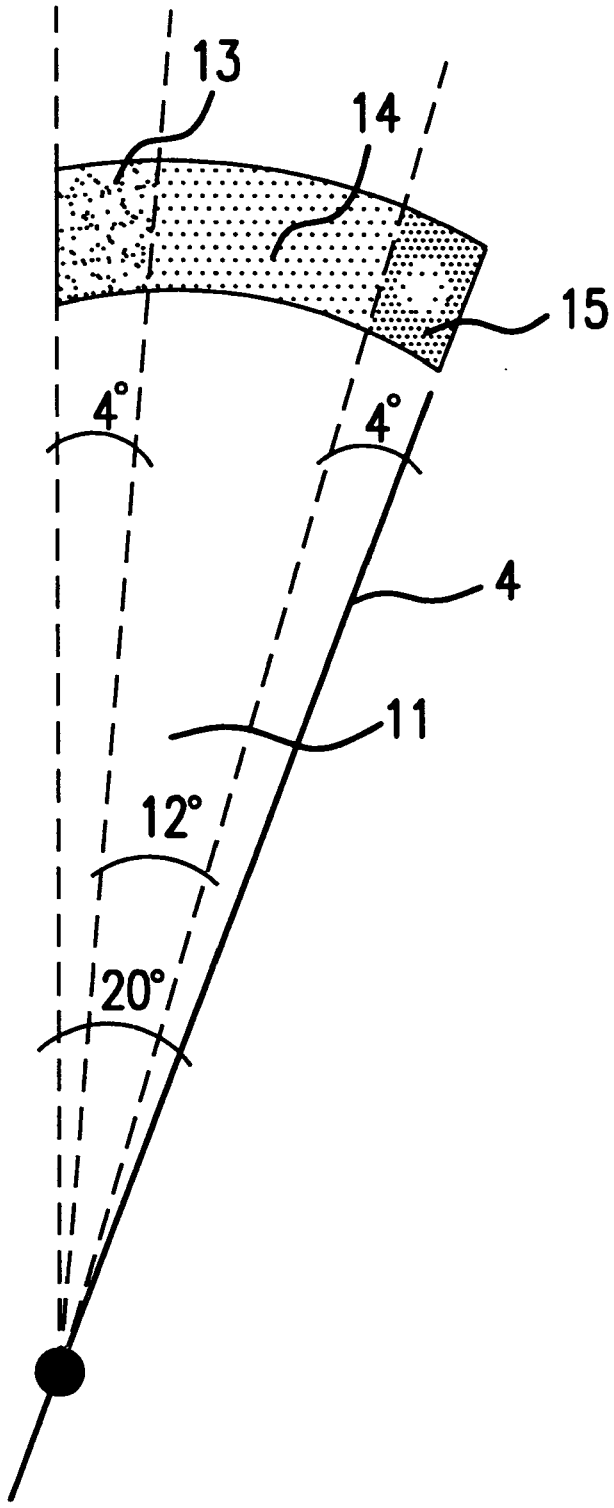
FIG. 9 is an enlarged view of one of the segments highlighted in FIG. 2.

FIG. 9 shows an expanded view of one of the segments 11 described in FIG. 2. In FIG. 9 the area through which the main hand 4 rotates the twenty degrees (20°) that define a single hole has been divided into three distinctively marked portions. The first portion, the "tee time element" 13 represents the maximum time that should be spent on the tee. It occupies the area that would be covered by the main hand 4 in rotating from the zero degree (0°) position (that marks the beginning of play on the hole) through the first four degrees (4°). The center portion, the "fairway time element" 14 represents the maximum time that should be spent on the fairway. It occupies the area that would be covered by the main hand 4 in rotating through the next twelve degrees (12°). The last few degrees, the "green time element" 15 represents the maximum time that should be spent on the putting green. It occupies the area that would be covered by the main hand 4 in rotating through the next four degrees (4°) to the twenty degree (20°) position (that marks the end of play on the hole).

Figure 10:
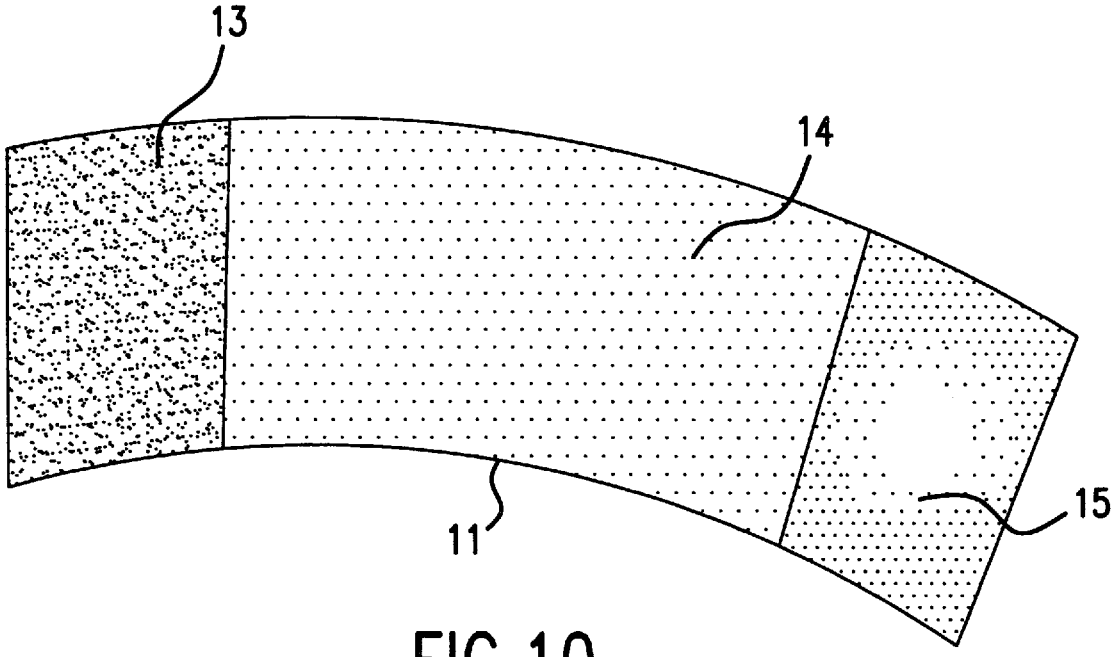
FIG. 10 is an enlarged view of a portion the segment shown in FIG. 9, as it might be used in a third embodiment of the progress monitor, showing how markings can be used to distinguish facets of play on a golf course.

FIG. 10 shows an expanded views of the three distinctively marked sections of a single segment described in FIG. 9. The diagram shows clearly the area marked by different shadings, to distinguish the facets of play.

Figure 11:
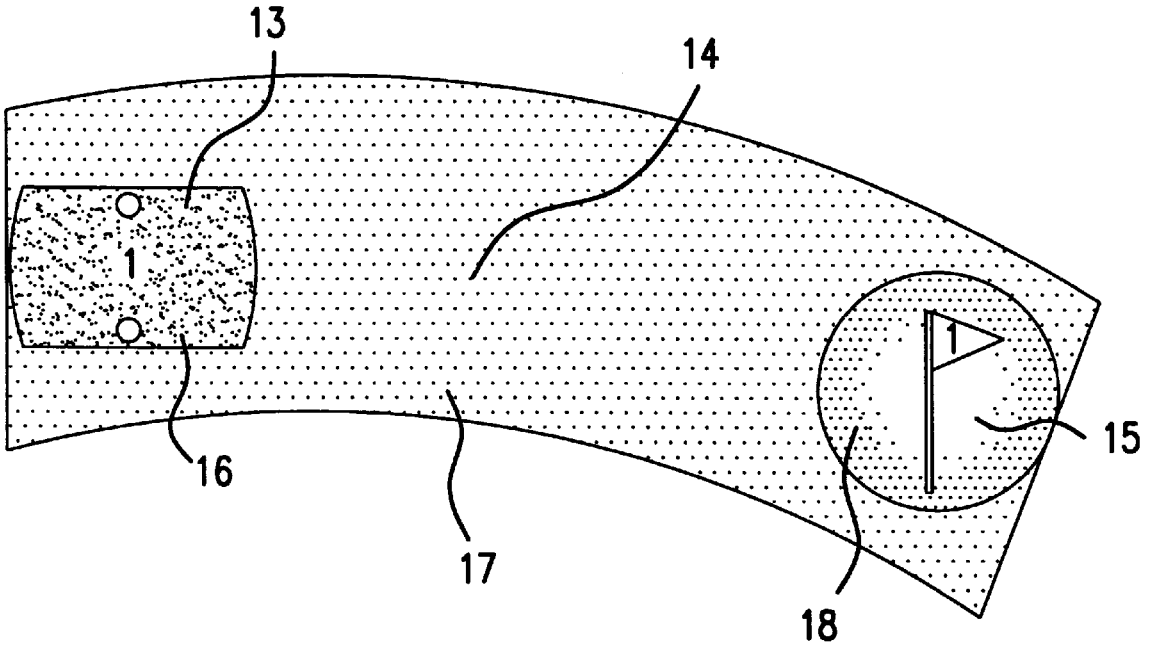
FIG. 11 is a similar view to that in FIG. 10, as it might be used in a fourth embodiment of the progress monitor, showing how a different set of graphic objects can be used to distinguish different facets of play on a golf course.

FIG. 11 shows another expanded view of the three distinctively marked sections of a single segment 11 described in FIGS. 9 and 10. The difference between FIG. 11 and FIG. 10 is that FIG. 11 contains a graphic representation of a tee 16 corresponding to the tee time element 13 and a graphic representation of a green 17 corresponding to the green time element 15. By implication, the area between them graphically represents fairway 18 and the fairway element 14. Each of these graphics occupies the same area as on FIGS. 9 and 10. That is, the main hand 4 will need to rotate four degrees to pass from the start of the hole to the finish of the tee graphic 16, representing the tee time element 13, to rotate a further twelve degrees to pass through the fairway graphic 17, representing the fairway time element 14, and a final four degrees to move from the start to the finish of the green graphic 18, representing the green time element 15 (also the end of the hole).

With these markings we are now in a position to accept and display information on how a golfer should progress through the individual facets of play on the hole. All that is required is that the progress monitor 1 take the correct amount of time to rotate the first four degrees to demonstrate the time that should be spent teeing off, then rotate at a faster or slower rate through the next twelve degrees so that it completes the rotation through this area in the time allocated for fairway play and rotate through the last four degrees, the putting out area in the time allocated to be spent on the green. To do this requires some additional information be input and stored in the electronic memory of the progress monitor.

The following is the table with the information it contained for Example 2 above.

| Target Time (Hours: Minutes) | Hole | Per-centage | Time For Hole (Minutes: Secs) | Number Of Units Of Measure (1°) | Time Per Unit Of Measure (Seconds, Tenths) |
|---|---|---|---|---|---|
| 4:00 | 1 | 6.5 | 15:36 | 20 | 46.8 |
| 4:00 | 2 | 4.0 | 9:36 | 20 | 28.8 |
| 4:00 | 3 | 6.0 | 14:24 | 20 | 43.2 |
| . . . | | | | | |

It should be apparent that the target time information need only be recorded once. We can simplify the tables by separating them into two tables, one for global or course related information, the other for hole information. Let us say that it has been determined that, per hole, no more than two minutes should be spent by a group of four golfers in teeing off. Similarly it has been determined that, per hole, no more than three minutes should be spent on the putting green. We know that the second hole is a par 3 on which golfers are expected to pause when on the green and to beckon the group following them to tee off. For this facet of play on this one hole it is decided that the normal tee off time should be added to the normal putting out time to provide for calling up. It has been determined that time on the fairways should be apportioned in the same percentages as was previously allocated to complete each hole. To illustrate how the progress monitor would be capable of displaying how much time should be spent on each facet of play consider the following example which uses these parameters:

Facet is either the Fixed Time allowance entered by the user or a value calculated by the progress monitor 1 from the Allowance As Percentage entered by the user. The Number Of Units Of Measure, which in this case represents the number of units of measure for one facet of play, is a value know to the progress monitor. The Time Per Unit Of Measure is a value calculated by the progress monitor 1.

Calculating the time to be spent on the fairway is a little more complex in this embodiment of the progress monitor of the present invention than previously. Rather than being the percentage input of the target time, it is the percentage input of the target time, less all the fixed amounts of time. To make this calculation requires all 18 holes be input. To simplify the example, let us presume that each following group of three holes repeats the pattern of these three, so far as tee and putting time are concerned. The total fixed time entered then would be 6 times 17 minutes=102 minutes. This leaves 138 minutes (of a target time of 240 minutes) to distribute over each fairway in the percentages input. This gives us the times for each fairway, shown in the example, that will be stored in the electronic memory of the progress monitor (times are rounded to the nearest second).

You will note that now, with fixed times for teeing off and putting out and an allowance of two extra minutes on the second green to call up the following group, the times for the first three holes (in minutes:seconds) are: 13:58 (versus 15:36 previously), 12:31 (versus 9:36 previously) and 13:17 (versus 14:24 previously). The total time for these three holes is 39:46 (versus 39:36 previously). While this is just an example, it clearly demonstrates that allocating parameters for individual facets of play could well provide a much more Example 3

Course information:

| Target Time (Hours:Minutes) |
|---|
| 4:00 |

Hole information:

| Hole | Facet Of Play | Facet Sequence Number | Fixed Time Allowance (Minutes:Secs) | Allowance As Percentage | Time For Facet (Minutes:Secs) | Number Of Units Of Measure (1°) | Time Per Unit Of Measure (Seconds, Tenths) |
|---|---|---|---|---|---|---|---|
| 1 | Tee Off | 1 | 2:00 | | 2:00 | 4 | 30.0 |
| 1 | Play Fairway | 2 | | 6.5 | 8:58 | 12 | 44.8 |
| 1 | Putt Out | 3 | 3:00 | | 3:00 | 4 | 45.0 |
| 2 | Tee Off | 1 | 2:00 | | 2:00 | 4 | 30:0 |
| 2 | Play Fairway | 2 | | 4.0 | 5:31 | 12 | 27.6 |
| 2 | Putt Out | 3 | 5:00 | | 5:00 | 4 | 75.0 |
| 3 | Tee Off | 1 | 2:00 | | 2:00 | 4 | 30.0 |
| 3 | Play Fairway | 2 | | 6.0 | 8:17 | 12 | 41.4 |
| 3 | Putt Out | 3 | 3:00 | | 3:00 | 4 | 45.0 |
| . . . | | | | | | | |

Of these values, only the last two are still the only ones essential for the operation of the progress monitor 1. The Facet Of Play and The Facet Sequence Number are values know to the progress monitor 1. The Fixed Time Allowance for a facet of play and the Allowance As Percentage of the target time to allocate to each hole are mutually exclusive parameters entered by the user of the progress monitor 1. The Target Time itself will also generally be one of the parameters entered by the user, though it could be calculated from the times allocated for each facet of play on each hole, if these were all entered as fixed time values. The Time For realistic picture of where golfers should be on the course at any moment. In Example 3, time is much more evenly distributed across the holes, despite differences in length.

Example 3 demonstrates quite dramatically how accuracy can be achieved over a wide range of scenarios and the results presented effectively with this implementation of the progress monitor 1. Though the rate at which the main hand 4 varies markedly in the fairway time element between holes 2 and 3 of this example (27.6 seconds per degree and 41.4 seconds per degree, respectively) it matches the scenario we have illustrated where the second hole is a par three, on which the golfers should be approaching the green almost immediately after their tee shots, and the third hole, which we said was a par five, on which we can presume our golfers will spend a much greater proportion of time on the fairway.

Having the progress monitor 1 display this information requires no significant change in the operation of the progress monitor 1 as discussed previously. The table in electronic memory provides the information as to how many units of measure to move for each facet of play in turn and the time to take per unit of measure. Thus, in this example, the main hand 4 would rotate four degrees at a rate of 30.0 seconds per degree, rotate the next 12 degrees at a rate of 44.8 seconds per degree, the next four degrees at a rate of 45 seconds per degree, and so on.

The ability of the progress monitor to discriminate between the fixed time that should be spent in certain areas of play on every hole, versus the variable time that is hole dependent, is seen as a major advantage over previous progress monitors in the field. It should be particularly effective in educating golfers how to be prepared to take their turn for teeing off and to spend their time on the green efficiently.

In Example 3, the progress monitor 1 provided for only three facets of play to be explicitly recorded. With this setup, the progress monitor required call up time be included in the putting out time for the hole. However, catering for recording call up time explicitly has advantages, as will be explained in a proposed embodiment to be covered later. Doing so requires no significant change in the basic of operation of the progress monitor 1. It just requires that it be recorded as a facet and that the progress monitor 1 take it into account in the right sequence.

It will be noted that in the hole information table shown in Example 3, the facet details are repeated. For convenience, they could be separated out into a separate table with the sequence number being used as the key to that table that links it to the hole information table. The arrangement of information in the electronic memory of the progress monitor, with allowance explicitly made for call up time, might then look something like this next example:

Example 4

Course information:

| Target Time (Hours:Minutes) |
|---|
| 4:00 |

Facet information:

| Facet Sequence Number | Facet Of Play |
|---|---|
| 1 | Tee Off |
| 2 | Play Fairway |
| 3 | Call Up |
| 4 | Putt Out |
| . . . | |

Hole information:

| Hole | Facet Sequence Number | Fixed Time Allowance (Minutes:Secs) | Allowance As Percentage | Time For Facet (Minutes:Secs) | Number Of Units Of Measure (1°) | Time Per Unit Of Measure (Seconds.Tenths) |
|---|---|---|---|---|---|---|
| 1 | 1 | 2:00 | | 2:00 | 4 | 30.0 |
| 1 | 2 | | 6.5 | 8:58 | 12 | 44.8 |
| 1 | 4 | 3:00 | | 3:00 | 4 | 45.0 |
| 2 | 1 | 2:00 | | 2:00 | 4 | 30:0 |
| 2 | 2 | | 4.0 | 5:31 | 12 | 27.6 |
| 2 | 3 | 2:00 | | 2:00 | 0 | 120.0 |
| 2 | 4 | 3.00 | | 3:00 | 4 | 45.0 |
| 3 | 1 | 2:00 | | 2:00 | 4 | 30.0 |
| 3 | 2 | | 6.0 | 8:17 | 12 | 41.4 |
| 3 | 4 | 3:00 | | 3:00 | 4 | 45.0 |
| . . . | | | | | | |

Operationally, the progress monitor works in exactly the same way, using the number of units of measure, in combination with the time per unit of measure to dictate how many degrees it rotates and the time interval for each degree of rotation. It shows that when it reaches the place where golfers should be calling up the group behind, it does not rotate (the number of units of measure specified are zero) but simply waits for the specified time (120 seconds). It should be noted that the information in the columns is not used in a mathematical summation of the form number of units of measure time per unit of measure. A value of zero is a valid parameter, that in the number of units of measure simply indicates to the progress monitor, pause here for the specified time.

Examples 2 and 3 show the format of a progress monitor with a design for each hole as described in FIGS. 9 and 10, or 11. A progress monitor with this design, when applied to all eighteen holes, would have the graphic for the first green directly abutting the graphic for the second tee, the graphic for the second green directly abutting the graphic for the third tee, and so on. Such a design does not explicitly cater for showing the time it takes for walking between holes. Neither does the current structure of tables of information cater for such a factor. Increasing the versatility of the progress monitor to allow time to be allocated for this facet of play, and to display it, requires minor enhancement of the embodiment just discussed.

Providing this additional functionality would only require that the rate of movement parameters be calculated for each new factor and the progress monitor have these additional time elements marked. The huge advantage of the progress monitor is the one design can cater for the conditions that apply to any individual course.

Figure 12:
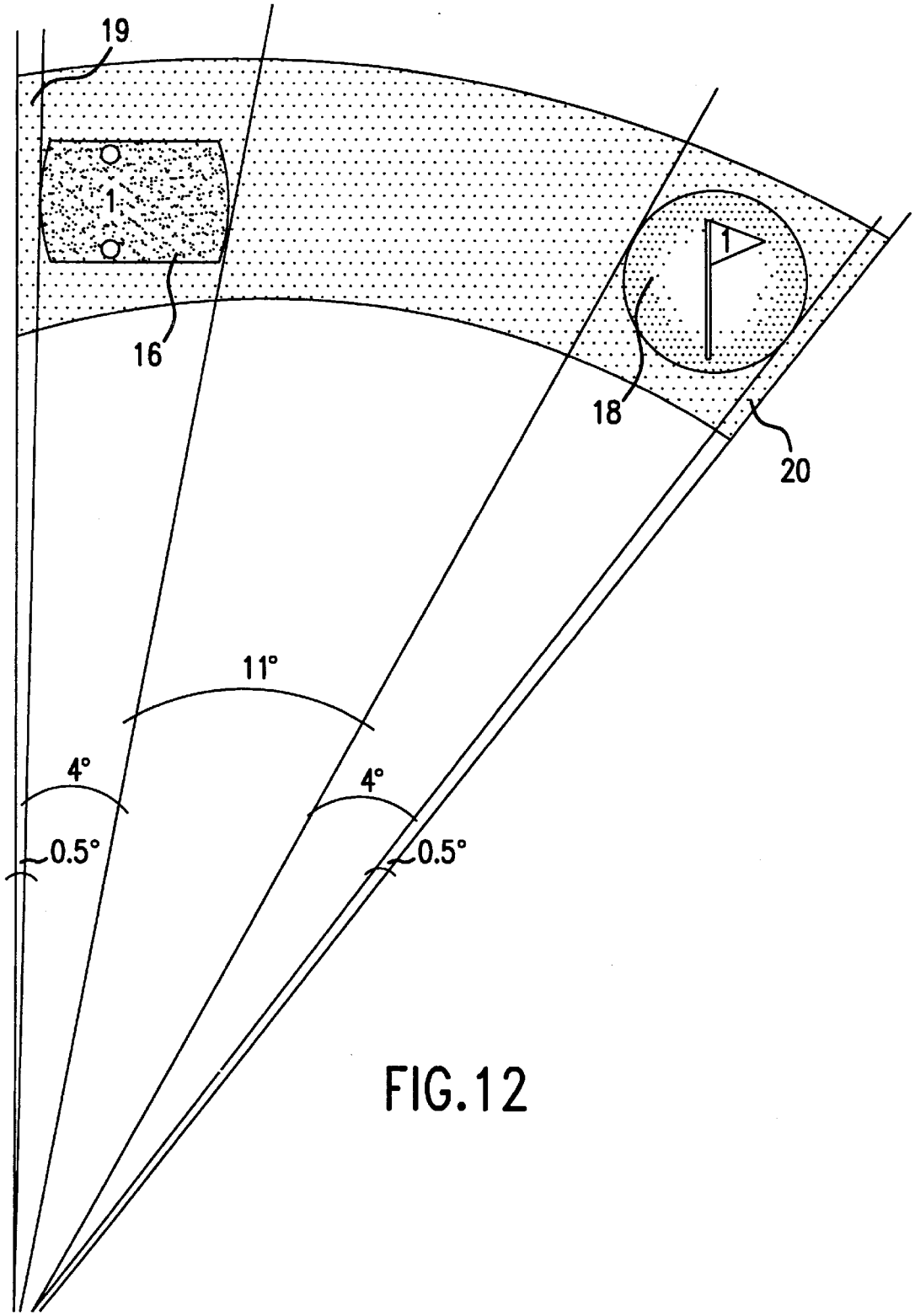
FIG. 12 is a modification of FIG. 11, as it might be used in a fifth embodiment of the progress monitor, in which the markings are further modified to allow for additional facets of play on a golf course to be distinguished.

FIG. 12 illustrates an embodiment of the invention that allows additional facets of play to be entered and monitored. The difference between this embodiment and that described in FIG. 11 is that there is now a one degree (1°) gap between each hole. Between the 12 o'clock vertical position and the beginning of the tee graphic on the first hole is a gap of a half degree (0.5°). This gap could represent the time to get to the starting tee 16. After the end of the green graphic on the eighteenth hole there is similarly a gap of a half degree (0.5°). This gap could represent the time to clear the last green played 18. To take these factors into account the tables of information stored in electronic memory need to be expanded as is shown in the following example:

many degrees it rotates and the time interval for each degree of rotation. The unit of measure has been defined as one tenth of a degree (0.1°) in this embodiment of the progress monitor, to allow for finer discrimination of the facets of play. The only other significant change is that entering a zero time allowance for the facet of moving to the starting tee is allowable. It simply indicates to the monitor that on encountering this entry in the table in electronic memory, it rotates directly to the next facet of play. The target time has not been altered, but seventeen and a half extra minutes of fixed time have been added to allow for the facets of play, moving to the starting tee, moving between holes and moving clear of the last green. This consequently lowers the amount of time that can be apportioned to play on the fairways, which were established as varying percentages of the remaining available time.

As in the preceding example, the time to be spent on the fairway is the percentage input of the target time, less all the fixed amounts of time. To make this calculation requires all 18 holes be input. As previously, to simplify the example, let us presume that every three holes following repeats the pattern of these three, so far as tee and putting time are concerned. The total fixed time entered for these facets of Example 5

Course information:

| Target Time (Hours:Minutes) |
|---|
| 4:00 |

Facet information:

| Facet Sequence Number | Facet Of Play |
|---|---|
| 0 | Move To Starting Tee |
| 1 | Tee Off |
| 2 | Play Fairway |
| 3 | Call Up |
| 4 | Putt Out |
| 5 | Move to Next Hole |
| 9 | Clear Last Green |
| . . . | |

Hole information:

| Hole | Facet Sequence Number | Fixed Time Allowance (Minutes:Secs) | Allowance As Percentage | Time For Facet (Minutes:Secs) | Number Of Units Of Measure (0.1°) | Time Per Unit Of Measure (Seconds.Tenths) |
|---|---|---|---|---|---|---|
| 1 | 0 | 0:00 | | 0:00 | 5 | 0.0 |
| 1 | 1 | 2:00 | | 2:P00 | 40 | 3.0 |
| 1 | 2 | | 6.5 | 7:46 | 110 | 7.8 |
| 1 | 4 | 3:00 | | 3:00 | 40 | 4.5 |
| 1 | 5 | 1:00 | | 1:00 | 10 | 6.0 |
| 2 | 1 | 2:00 | | 2:00 | 40 | 3.0 |
| 2 | 2 | | 4.0 | 4:47 | 110 | 2.6 |
| 2 | 3 | 2:00 | | 2:00 | 0 | 12.0 |
| 2 | 4 | 3.00 | | 3:00 | 40 | 4.5 |
| 2 | 5 | 1:00 | | 1:00 | 10 | 6.0 |
| 3 | 1 | 2:00 | | 2:00 | 40 | 3.0 |
| 3 | 2 | | 6.0 | 7:10 | 110 | 3.3 |
| 3 | 4 | 3:00 | | 3:00 | 40 | 4.5 |
| 3 | 5 | 1:00 | | 1:00 | 10 | 6.0 |
| . . . | | | | | | |
| 18 | 9 | 0:30 | | 0:30 | 5 | 6.0 |

Operationally, the progress monitor works in exactly the same way, using the number of units of measure, in combination with the time per unit of measure to dictate how play then would be 6 times 17 minutes=102 minutes. In addition we now need to subtract the time we have allowed for walking between holes and off the last green, which is 17.5 minutes. This leaves 119.5 minutes (of a target time of 240 minutes) to distribute over each fairway in the percentages input. This gives us the times for each fairway, shown in the example, that will be stored in the electronic memory of the progress monitor (times are rounded to the nearest second). Note that the total time for the round has not altered, and in fact the time for completing the first three holes is practically the same. However, the fact that another set of fixed amounts of time has been allocated for the round, for walking to tees and greens and from greens, reduces the amount of time available for play on the fairway. If the calculations of the time that each facet of play should take reflect real world conditions acceptable to the majority of golfers, the progress monitor will accurately highlight the speed at which play will need to proceed down the fairway. Contrast the last example (example 5) to the first (example 1). In the first the golfer has only the one guideline of time to complete each hole, and might, for sake of argument consider this was all available for the fairway. Contrast these times with the times allocated for fairway play in example 5.

| Hole | Example 1 | Example 5 |
|---|---|---|
| 1 | 15:36 | 7:46 |
| 2 | 9:36 | 4:47 |
| 3 | 14:24 | 7:10 |

It is very clear now that only half the total time per hole is available for fairway play as might be assumed from the progress monitor portrayed in the first embodiment of the progress monitor.

Figure 13:
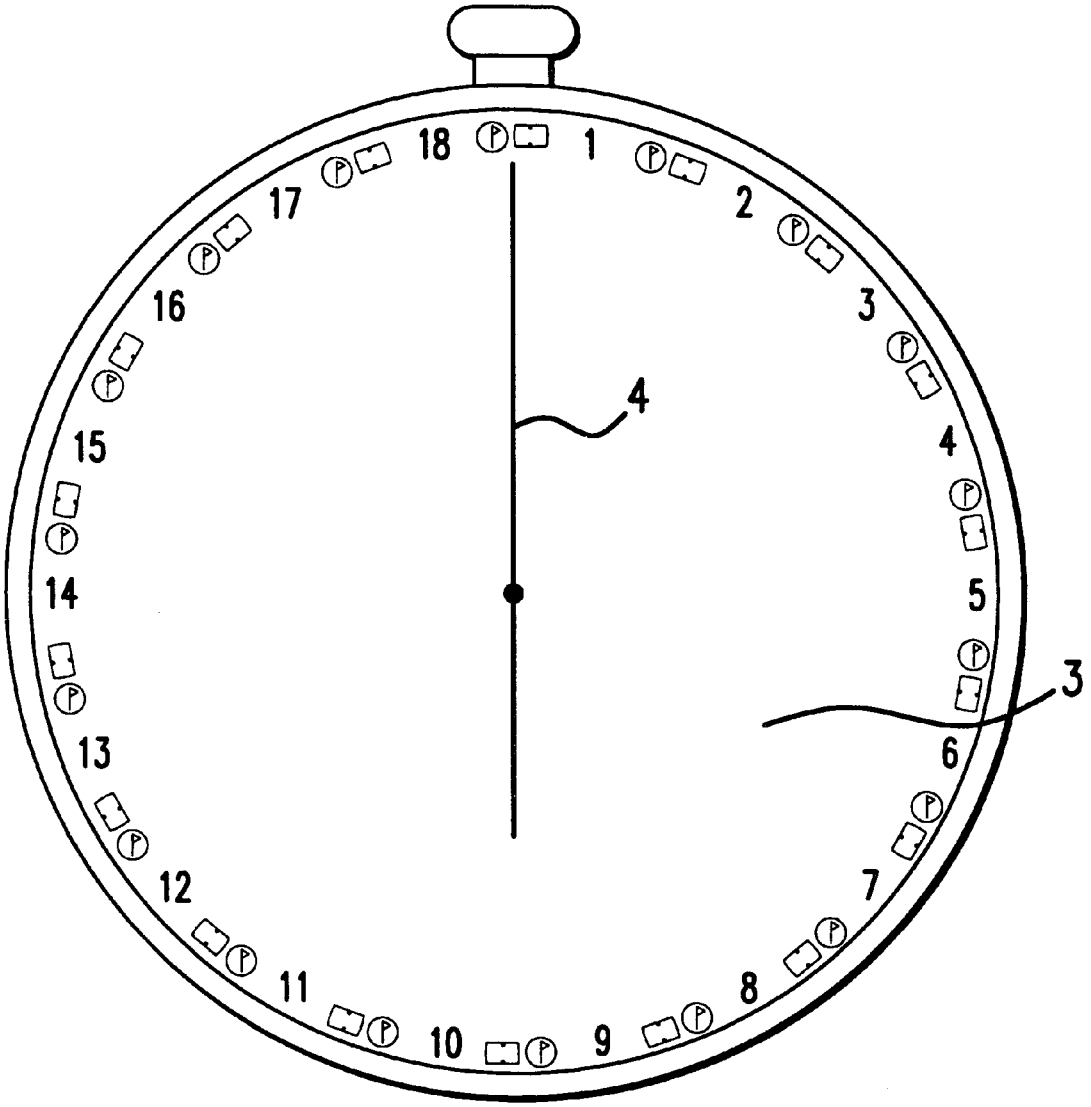
FIG. 13 is a front view of the fifth embodiment of the progress monitor showing how all eighteen of the segments described in FIG. 12 might look when laid out on the face of the progress monitor.

FIG. 13 shows an embodiment of the progress monitor based on the above distribution of symbols representing graphically, the time to move to a tee 19, the tee time element 13, the fairway time element 14, the green time element 15, and the time to move from the tee 20. The advantage of the layout is that is provides a sense of context, the golfer sees precisely where he or she should be at this point in time relative to holes that have been played and remain to be played. However, if implemented on a small scale, the information on the dial 3 of this embodiment could be difficult to read.

Figure 14:
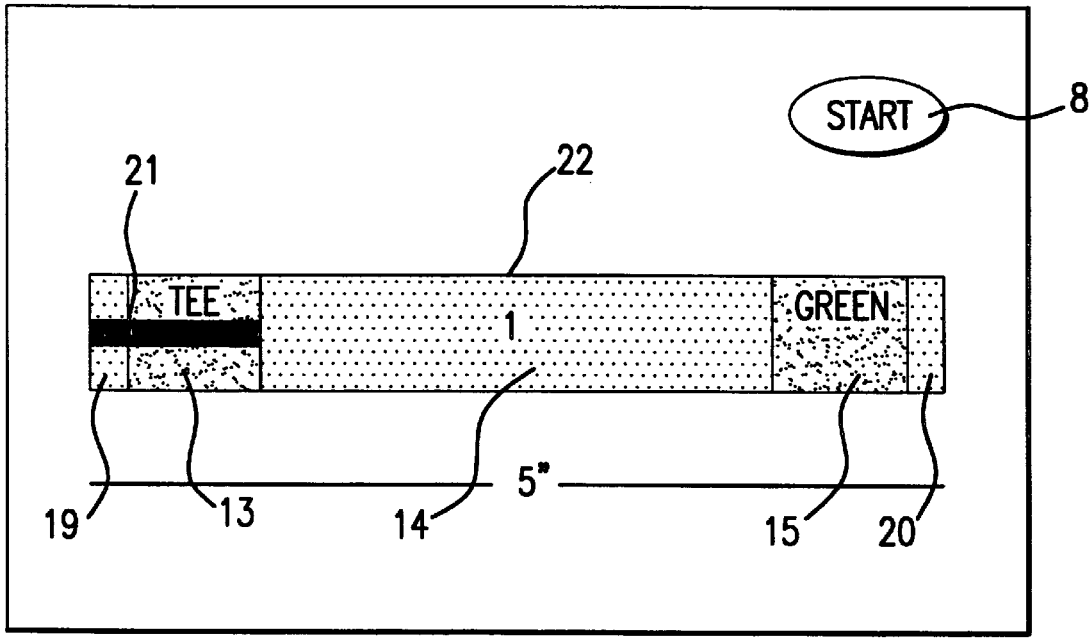
FIGS. 14 and 15 are front view of a sixth embodiment of the progress monitor showing how the position a golfer should have reached on the course at a given moment can be presented in the form of a bar moving across a series of markings on an electronic display screen.

FIG. 14 shows a further possible embodiment of the progress monitor. In this case, the rotating main hand 4 of FIG. 13, which displays position on the course has been replaced by a bar 21 that moves across an electronic display screen 22 that has five distinct areas marked out. The areas represent: moving to the tee 19, teeing off (the tee time element 13), playing the fairway (the fairway time element 14), putting out (the green time element 15), and moving from the green 20. The operation of this progress monitor is essentially the same as before except that instead of the unit of measure being a degree or fraction of a degree of rotation of the main hand, it is horizontal movement of the bar of a fraction of an inch across the marked electronic display screen.

In the example, the screen measures five inches (5") across. A unit of measure could be one twentieth of an inch (0.05"). This would give 100 units of measure per hole, which we could allocate as follows: 5 to move to the tee, 20 for the tee, 50 for the fairway, 20 for the green and 5 to move from the green.

The information that would be entered into the tables in electronic memory of the progress monitor would be almost identical to that entered for the previous embodiment of the progress monitor with the rotating main hand. The following example shows how the table might be populated:

Example 6

Course information:

| Target Time (Hours:Minutes) |
|---|
| 4:00 |

Facet information:

| Facet Sequence Number | Facet Of Play |
|---|---|
| 0 | Move To Tee |
| 1 | Tee Off |
| 2 | Play Fairway |
| 3 | Call Up |
| 4 | Putt Out |
| 9 | Move From Green |
| . . . | |

Hole information:

| Hole | Facet Sequence Number | Fixed Time Allowance (Minutes:Secs) | Allowance As Percentage | Time For Facet (Minutes:Secs) | Number Of Units Of Measure (0.05") | Time Per Unit Of Measure (Seconds.Tenths) |
|---|---|---|---|---|---|---|
| 1 | 0 | 0:00 | | 0:00 | 5 | 0.0 |
| 1 | 1 | 2:00 | | 2:00 | 20 | 6.0 |
| 1 | 2 | | 6.5 | 7:46 | 50 | 9.3 |
| 1 | 4 | 3:00 | | 3:00 | 20 | 9.0 |
| 1 | 9 | 0:30 | | 0:30 | 5 | 6.0 |
| 2 | 0 | 0:30 | | 0:30 | 5 | 6.0 |

-continued

| Example 6 | | | | | | |
|---|---|---|---|---|---|---|
| 2 | 1 | 2:00 | | 2:00 | 20 | 6.0 |
| 2 | 2 | | 4.0 | 4:47 | 50 | 5.7 |
| 2 | 3 | 2:00 | | 2:00 | 0 | 120 |
| 2 | 4 | 3.00 | | 3:00 | 20 | 9.0 |
| 2 | 9 | 0:30 | | 0:30 | 5 | 6.0 |
| 3 | 0 | 0:30 | | 0:30 | 5 | 6.0 |
| 3 | 1 | 2:00 | | 2:00 | 20 | 6.0 |
| 3 | 2 | | 6.0 | 7:10 | 50 | 8.6 |
| 3 | 4 | 3:00 | | 3:00 | 20 | 9.0 |
| 2 | 9 | 0:30 | | 0:30 | 5 | 6.0 |
| . . . | | | | | | |
| 18 | 9 | 0:30 | | 0:30 | 5 | 6.0 |

The main difference in the table in this embodiment is that the time for moving between holes, has been explicitly divided into two portions, moving from the green and moving to the next tee. These times could be explicitly entered or the progress monitor could split a time for moving between holes automatically.

Operationally, the bar on the progress monitor would move forward 5 units of measure immediately when the start button 8 as pressed to be positioned at the start of the first tee. It would then move 20 units of measure at a rate of one unit every 6 seconds to mark out the time allowed for the first tee. Next it would move 50 units of measure at a rate of one unit every 9.3 seconds to mark out the time allowed for the play on the fairway. Next the time for putting out would be displayed as the bar moved 20 units of measure at a rate of one unit every 9 seconds. Lastly, the bar would move 5 units of measure, to the far right edge of the display 22, t a rate of one unit every 9.3 seconds, to mark out time moving from the green. The bar would momentarily disappear and then reappear coming in from the left hand edge of the display 22, marking the time moving to the second tee. It would move forward 5 units of measure at a rate of one unit every 6 seconds until it was positioned at the start of the second tee, and so on.

Figure 15:
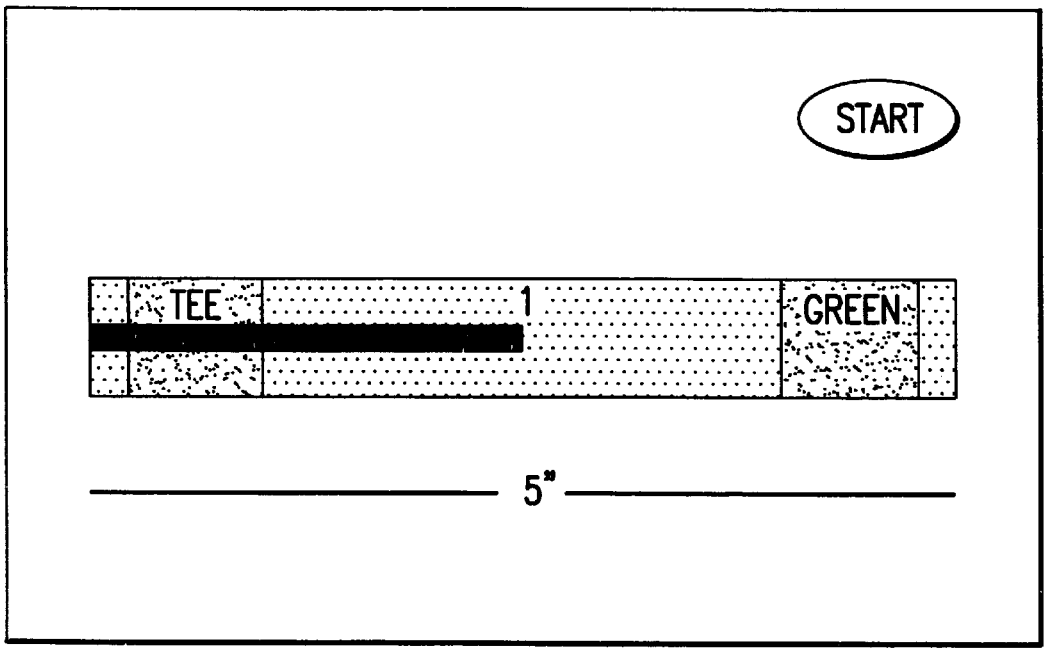

FIG. 14 shows how the progress monitor would appear 2 minutes after play had started on the hole (golfers would have completed teeing off), FIG. 15 shows how it would appear 5 minutes, 53 seconds after play had started on the hole (golfers would be halfway down the fairway).

Figure 16:
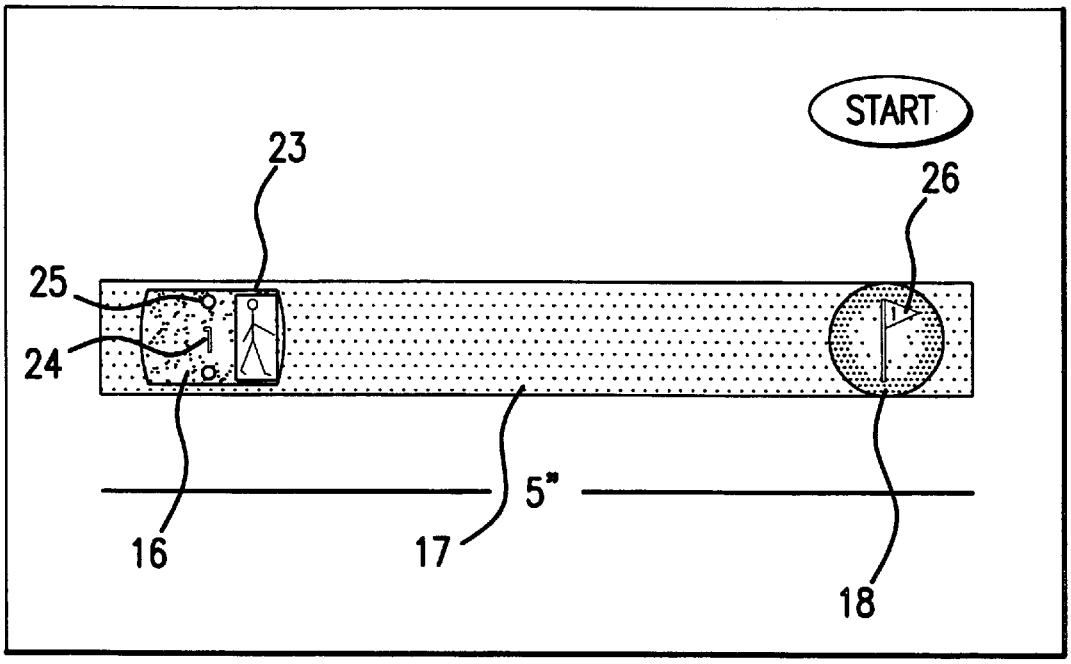
FIGS. 16 and 17 are front view of a seventh embodiment of the progress monitor showing how the position a golfer should have reached on the course at a given moment can be presented in the form of a graphic representation of a golfer moving across a series of graphic objects on an electronic display screen representing different facets of play on a golf course.

FIG. 16 illustrates a further embodiment of the progress monitor. The only difference between this embodiment and that described in FIG. 14 is that as in FIG. 11 graphics are used to represent the tee 16, the fairway 17 and the green 18. Rather than a bar, the display shows a stick FIG. 23 or similar graphic of a golfer moving down the hole, and the hole number 24 is displayed both on the tee, between the graphical representation of tee markers 25 and on the graphical representation of the flag stick 26 on the green. Operationally, this embodiment of the present progress monitor works exactly as in the previous embodiment.

Figure 17:
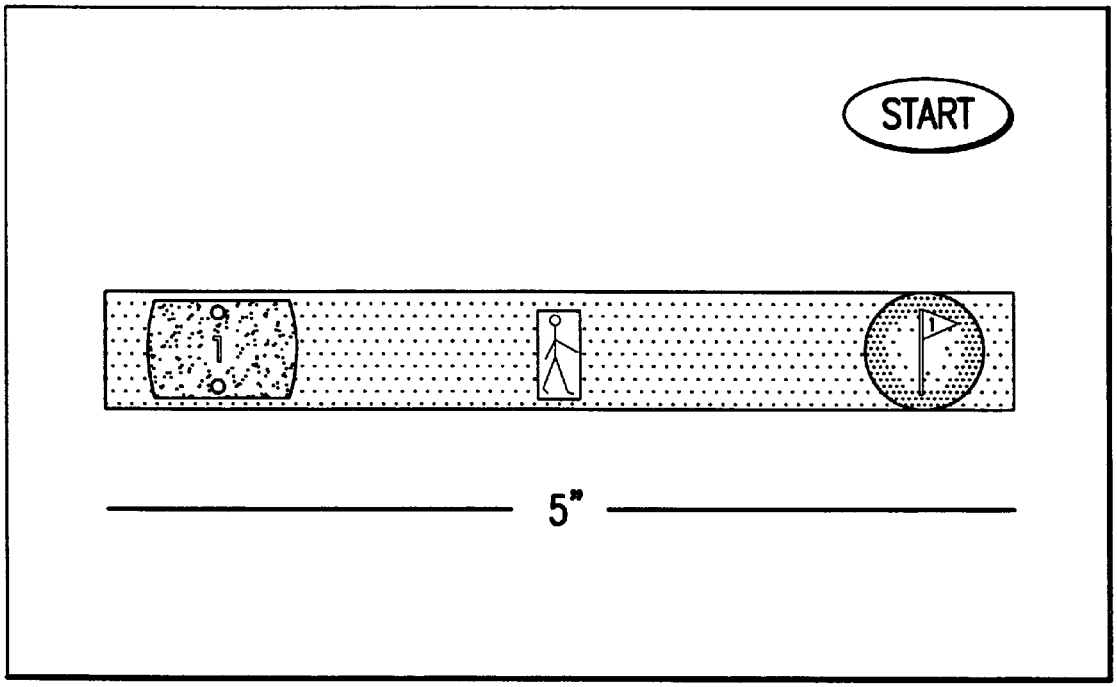

FIG. 16 shows how the progress monitor would appear 2 minutes after play had started on the hole (golfers would have completed teeing off), FIG. 17 shows how it would appear 5 minutes, 53 seconds after play had started on the hole (the golfers would be halfway down the fairway.

Figure 18:
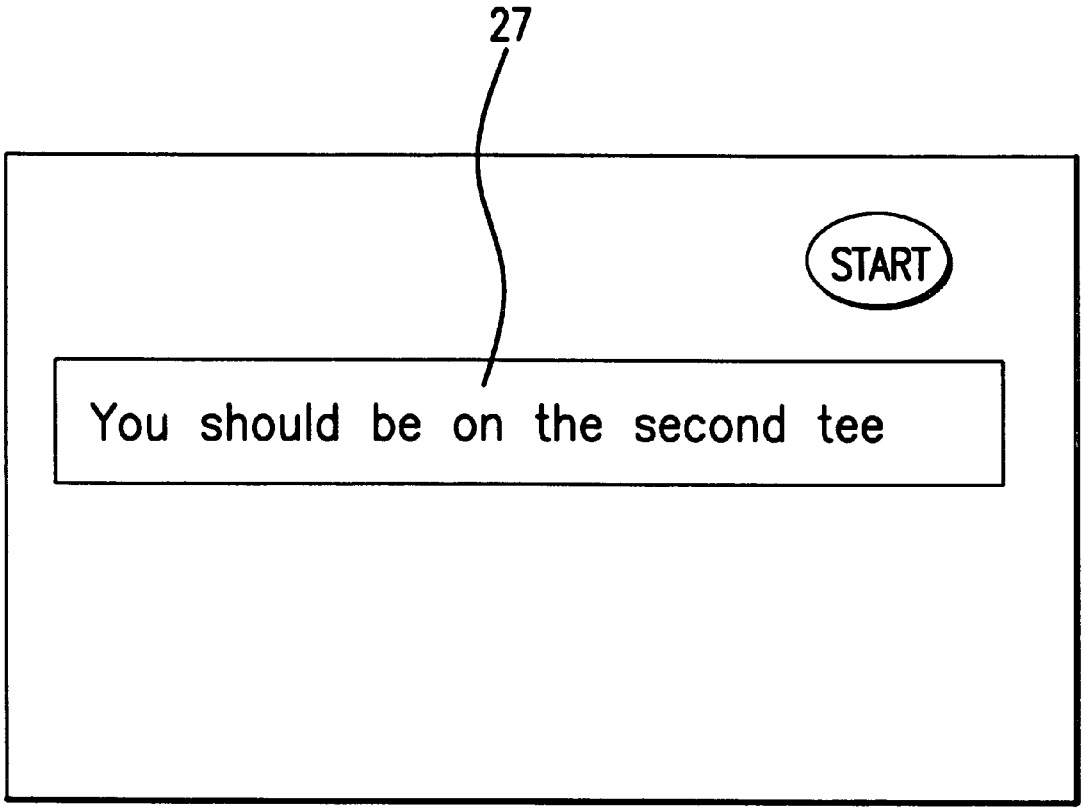
FIGS. 18, 19 and 20 are front views of an eighth embodiment of the progress monitor how the position a golfer should have reached on the course at a given moment can be presented in the form of messages on an electronic display that change as time passes.

FIG. 18 illustrates another embodiment of the progress monitor. The primary difference is that rather than a display with a moving bar, or graphical representation of a golfer, a message 27 is displayed telling the golfer in natural language where he or she should currently be.

To implement this embodiment of the progress monitor requires that we associate a message with each facet of play we intend to monitor and the progress monitor is programmed to display the appropriate message for the facet that the progress monitor knows should be current from reference to the table of information for each hole it has also stored in electronic memory. The following example shows how the tables might be structured and populated to enable this embodiment to be implemented.

Example 7

Course information:

| Target Time (Hours:Minutes) |
|---|
| 4:00 |

Facet information:

| Facet Sequence Number | Facet of Play | Message |
|---|---|---|
| 0 | Move To Tee | You should be moving to the tee |
| 1 | Tee off | You should be teeing off |
| 2 | Play Fairway | You should be moving down the fairway |
| 3 | Call Up | You should be calling up the group following you |
| 4 | Putt Out | You should be putting out |
| 9 | Move From Green | You should be clearing the green |

Hole information:

| Hole | Facet Sequence Number | Fixed Time Allowance (Minutes:Secs) | Allowance As Percentage | Time For Facet (Minutes:Secs) |
|---|---|---|---|---|
| 1 | 0 | 0:00 | | 0:00 |
| 1 | 1 | 2:00 | | 2:00 |
| 1 | 2 | | 6.5 | 7:46 |
| 1 | 4 | 3:00 | | 3:00 |
| 1 | 9 | 0:30 | | 0:30 |
| 2 | 0 | 0:30 | | 0:30 |
| 2 | 1 | 2:00 | | 2:00 |
| 2 | 2 | | 4.0 | 4:47 |
| 2 | 3 | 2:00 | | 2:00 |
| 2 | 4 | 3.00 | | 3:00 |
| 2 | 9 | 0:30 | | 0:30 |
| 3 | 0 | 0:30 | | 0:30 |
| 3 | 1 | 2:00 | | 2:00 |
| 3 | 2 | | 6.0 | 7:10 |
| 3 | 4 | 3:00 | | 3:00 |
| 2 | 9 | 0:30 | | 0:30 |
| . . . | | | | |
| 18 | 9 | 0:30 | | 0:30 |

Two changes in information stored in the tables in electronic memory are significant. The first is that for each facet of play we now have an associated message. The second is that we can drop off the last two columns from the hole information. We no longer need to record the number of units of measure to allocate to the facet or the rate of movement of the progress monitor that measures out that facet.

Operationally, this embodiment of the progress monitor simply displays the message associated with the specified facet, in turn, for the period specified for the facet.

Thus the first message to be displayed would be "You should be teeing off" as zero time has been allowed for the facet of moving to the tee on the first hole (technically, this first line of information need not be present). For two minutes it displays this message. For the next seven minutes and forty six seconds it displays the message "You should be moving down the fairway". For the next three minutes it displays the message "You should be putting out". After that, for thirty seconds it displays the message, "You should be clearing the green" followed by thirty seconds of the message, "You should be moving to the next tee", two minutes of the message, "You should be teeing off", and so on.

Figure 19:
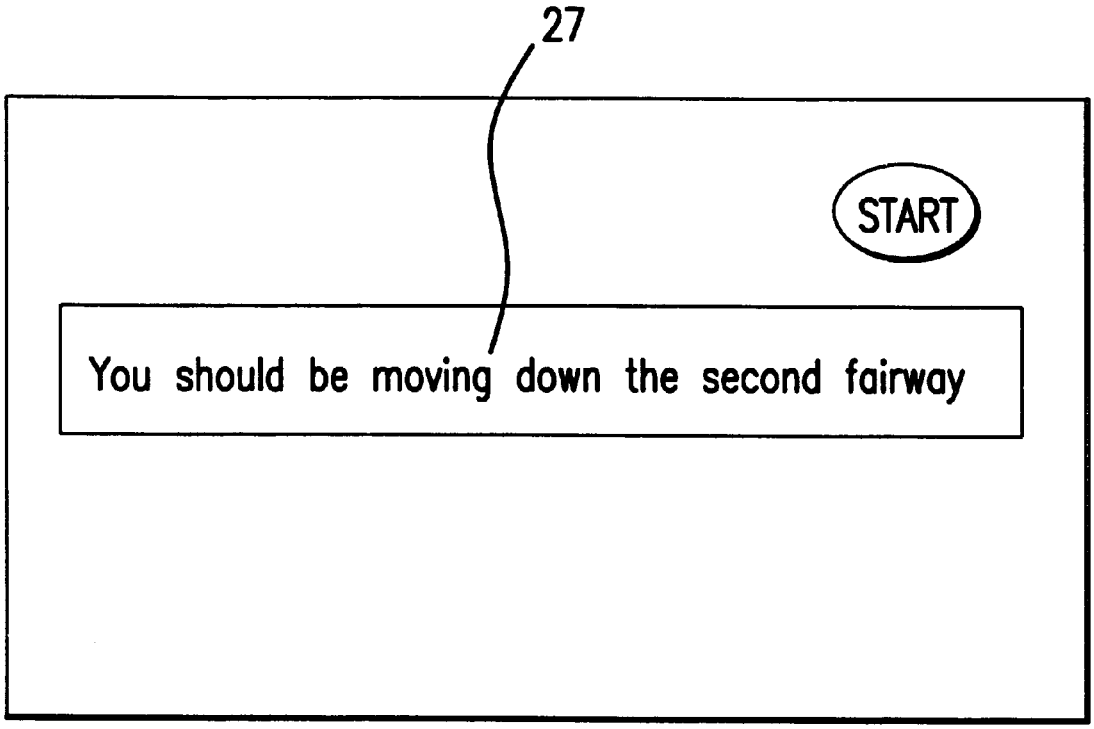
Figure 20:
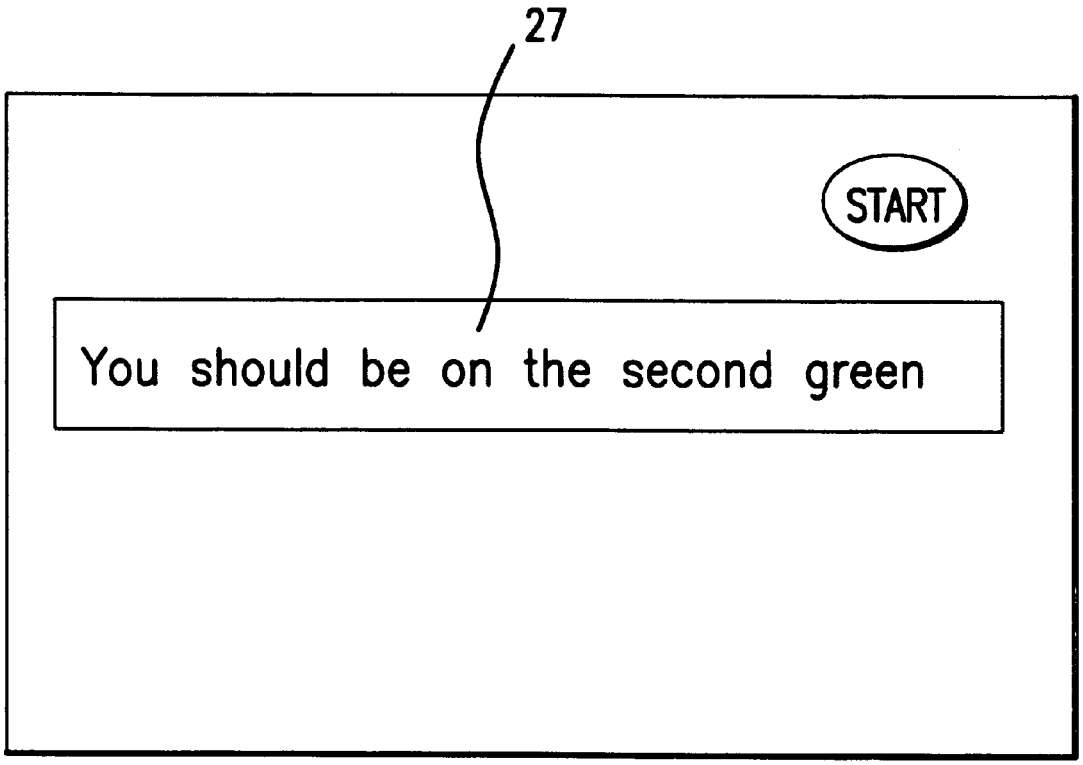

Based on the second example above, FIG. 18 illustrates the way the face of this embodiment of the progress monitor would look after 15 minutes and 36 seconds had elapsed (the message 27 is "You should be on the second tee"), FIG. 19 illustrates the way the face of this embodiment of the progress monitor would look after a further 4 minutes and 48 seconds had elapsed (the message 27 is "You should be moving down the second fairway"), FIG. 20 illustrates the way the face of this embodiment of the progress monitor would look after a further 3 minutes and 30 seconds had elapsed (the message 27 is "You should be putting out on the second green").

This embodiment of the invention could be enhanced by programming it so it displayed more hole specific messages, such as "You should be moving to the second tee" based on knowing which hole was relevant. Or it could display a message such as, "The first member of your group should be teeing off" or the "Last member of your group should be teeing off" based on the proportion of time that had elapsed for a particular facet.

Figure 21:
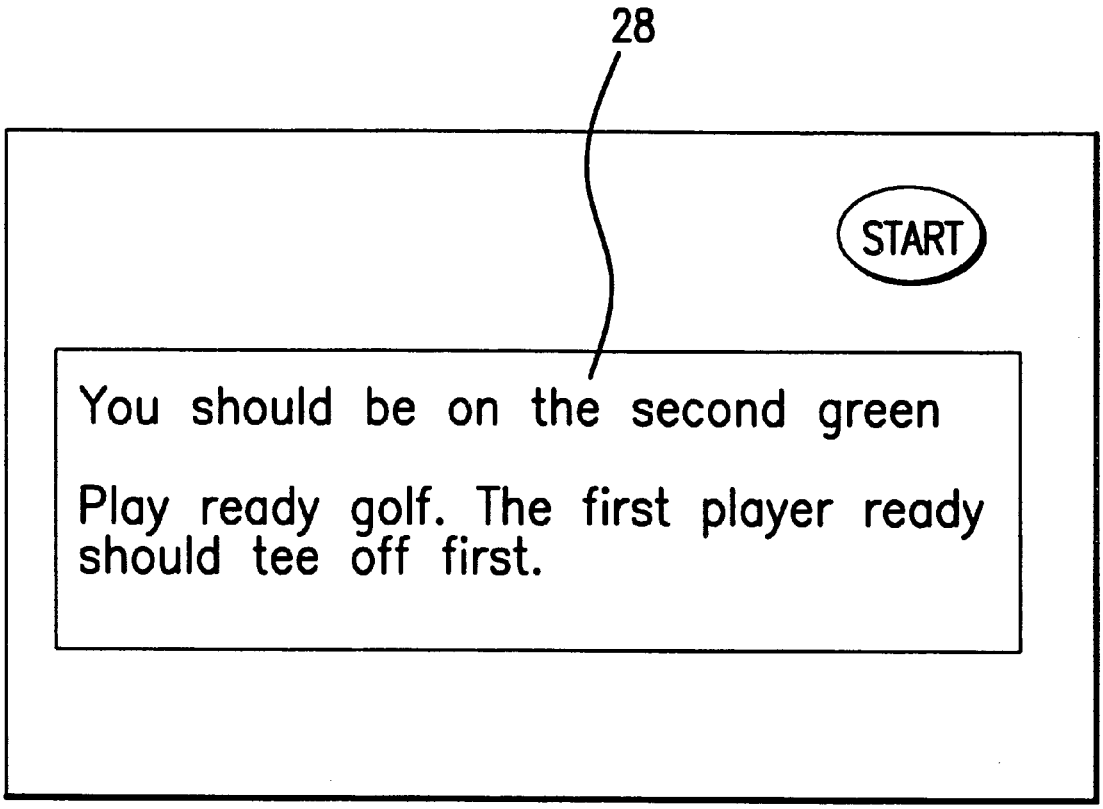
FIG. 21 is a front view of a ninth embodiment of the progress monitor that shows how a small electronic display could be used to display timely educational information or instructions to the golfer in conjunction with the information on where they should be on the course at any time.

FIG. 21 shows an embodiment of the invention that has a larger display panel 22 that could be used to show hints associated with a facet of play. From surveys of clubs it has become apparent that most golfers see education as a vital component in improving the pace at which golfers move. For example, when the progress monitor knows that the golfers should be teeing off, it could display a hint 28 such as "Play ready golf. The first golfer ready tees off first". If it knew the golfers were on the tee of a par 3 that had been designated as a call up hole, the panel could be used to remind golfers to call up the following golfers with a hint such as "Please call up the following group as soon as your flight is all on the green". The desirability to highlight to the group of golfers, their responsibility to call the following group, was noted in the discussion on calling up golfers as a facet of play. This embodiment provides a mechanism by which the functionality could be provided.

It should be noted that all but the first embodiment of the progress monitor could be implemented programmatically on any general purpose or computer with an acceptable electronic display and an available programming language with sufficient functionality.

Figure 22:
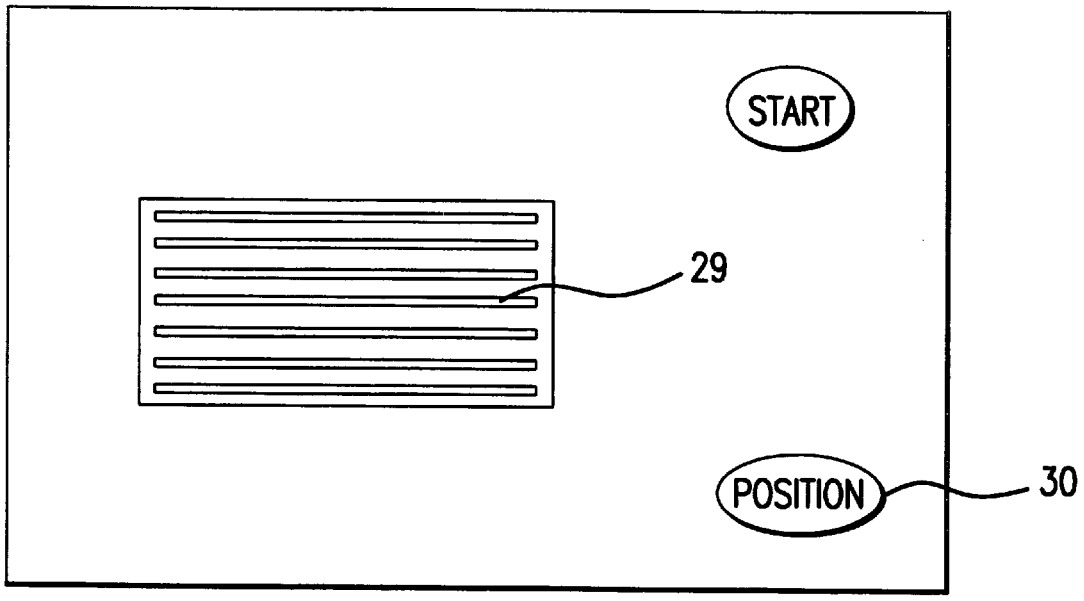
FIG. 22 is a front view of a tenth embodiment of the progress monitor that shows how a small speaker could be built into the progress monitor so an audible message could be generated to tell the golfer where they should be on the course at any point in time.

FIG. 22 illustrates a possible implementation of the progress monitor showing how the progress monitor could be fitted with a small speaker 29 by way of which a generated message could be audibly presented when the golfer pressed a position request button 30 on the face of the progress monitor.

The objective of the progress monitor is to establish a pace of play that will enable golfers to meet a target time for completion of a round without feeling unduly pressured overall, or in completing any facet of play. To do this, the fixed and variable amounts of time that are allocated for each hole, for each facet of play, must be based on a realistic assessment, or experiential evidence, of the capabilities of average golfers to meet the goals set. However, of necessity, the parameters must assume that the round proceeds normally and every group using the progress monitor plays at all times like the "average" golfer on whom the parameters are based. By making the times for each facet of play a little generous, and properly evaluating the requirements of each hole for a particular course, it should be possible for most groups to play at the suggested pace.

However, what if something happens to cause a group of golfers to fall behind the pace?

A useful enhancement would be some facility that enabled the golfer to indicate to the progress monitor the exact point they had actually reached on the course, as opposed to the point the progress monitor said they should have reached and for the progress monitor to provide a revised schedule, with a faster pace of play for the remaining holes, that would result in them completing the round in the target time.

Figure 23:
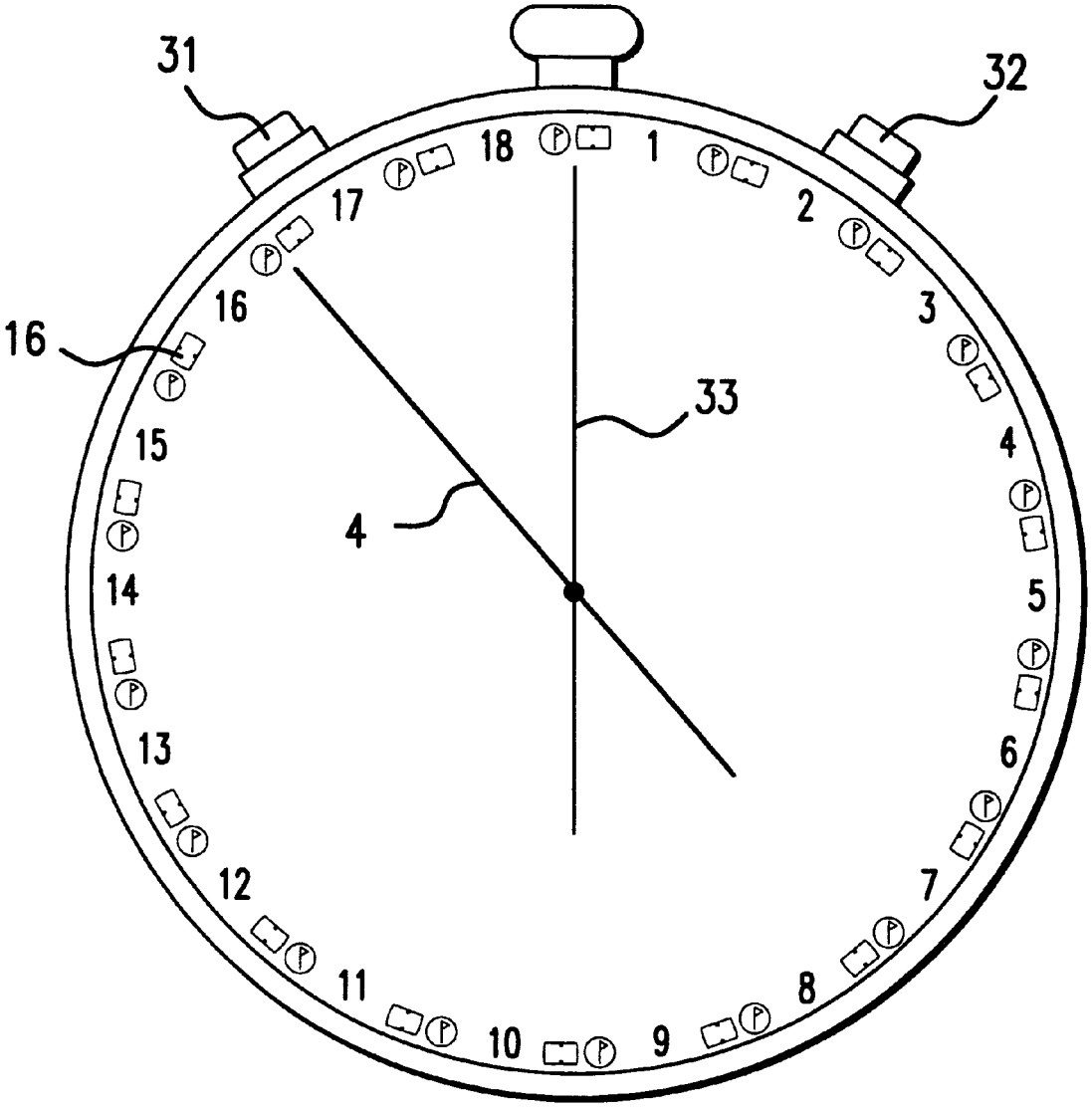
FIGS. 23, 24, 25 and 26 are front views of an eleventh embodiment of the progress monitor that shows how the functionality can be provided to allow a golfer to recalibrate the progress monitor, to take into account the golfers actual position and recalculate a new pace of play to still achieve the target time.

FIG. 23 shows a front view of an embodiment of the progress monitor that will allow the golfer to enter his or her actual position on the course and have a new rate of play calculated for completion of the round in the target time. It is very similar to the embodiment shown in FIG. 13. It differs from it in that it has two additional buttons. They are a recalibrate back button 31 and a recalibrate forward button 32. It also has an extra hand, the recalibration hand 33.

The main hand 4 would indicate where the golfer should be to finish the round in the prescribed target time. If the golfer falls behind more than one hole, the recalibrate back button 31 can be depressed causing the recalibration hand 33 to be set to the start of a tee graphic immediately preceding the position of the main hand 4. If the recalibration back button 31 is pressed again, within a prescribed period of time, it moves back one more tee graphic 16. Subsequently, the recalibration hand 33 will rotate through each facet of play at a rate that is faster than the main hand 4 at a new speed which is calculated to achieve a round of golf within the prescribed time for the remaining holes. The recalibration hand 33 can be set at a new speed that is determined to achieve that objective.

Similarly, the recalibration forward button 32 provides for a situation where the golfer is ahead of the target time. The recalibration hand 33 is moved forward one tee graphic 16 at a time and rotates through each facet of play at a rate that is slower than the main hand 4 to reach the target time for a round of golf. Consequently, the golfer can adopt a more leisurely pace for the remaining holes.

To implement such an enhancement would require that the progress monitor have a mechanism that would enable the golfer to indicate his or her actual position on the golf course, a mechanism for showing the changed rate of play and some way by which the revised rate of play information be calculated and stored in the internal memory of the progress monitor.

The following shows one way in which the tables of information in the electronic memory of the progress monitor might be modified to hold the information required to implement this enhancement.

Example 8

Course information:

| Target Time (Hours:Minutes) |
|---|
| 4:00 |

Facet information:

| Facet Sequence Number | Facet Of Play |
|---|---|
| 0 | Move To Starting Tee |
| 1 | Tee Off |
| 2 | Play Fairway |
| 3 | Call Up |
| 4 | Putt Out |
| 5 | Move to Next Hole |
| 9 | Clear Last Green |

Hole information:

| A | B | C | D | E | F | G | H | I |
|---|---|---|---|---|---|---|---|---|
| 16 | 1 | 2:00 | | 2:00 | 40 | 3.0 | 1:17 | 1.9 |
| 16 | 2 | | 6.5 | 7:46 | 110 | 7.8 | 5:00 | 2.7 |
| 16 | 4 | 3:00 | | 3:00 | 40 | 4.5 | 1:56 | 2.9 |
| 16 | 5 | 1:00 | | 1:00 | 10 | 6.0 | 0:39 | 3.9 |
| 17 | 1 | 2:00 | | 2:00 | 40 | 3.0 | 1:17 | 1.9 |
| 17 | 2 | | 4.0 | 4:47 | 110 | 2.6 | 3:05 | 1.7 |
| 17 | 3 | 2:00 | | 2:00 | 0 | 12.0 | 1:17 | 1.9 |
| 17 | 4 | 3.00 | | 3:00 | 40 | 4.5 | 1:56 | 2.9 |
| 17 | 5 | 1:00 | | 1:00 | 10 | 6.0 | 0:39 | 3.9 |
| 18 | 1 | 2:00 | | 2:00 | 40 | 3.0 | 1:17 | 1.9 |
| 18 | 2 | | 6.0 | 7:10 | 110 | 3.3 | 4:37 | 2.5 |
| 18 | 4 | 3:00 | | 3:00 | 40 | 4.5 | 1:56 | 2.9 |
| 18 | 9 | 0:30 | | 0:30 | 5 | 6.0 | 0:19 | 3.9 |

Key to Table Columns
A = Hole
B = Facet Sequence Number
C = Fixed Time Allowance (Minutes:Secs)
D = Allowance As Percentage
E = Time For Facet (Minutes:Secs)
F = Number Of Units Of Measure (0.1°)
G = Time Per Unit Of Measure (Seconds.Tenths)
H = Recalibrated Time For Facet (Minutes:Secs)
I = Recalibrated Time Per Unit Of Measure (Seconds.Tenths)

In the preferred implementation it is considered desirable to continue to display the position the golfers should have reached according to the initial parameters. If golfers were able to rest the main hand 4 back there would be no record for the course ranger that they were in fact behind the original schedule. Hence the need for a second, recalibration hand 33. This means that a separate set of values (time per unit of measure) must be maintained for the recalibration hand to function from.

Figure 24:
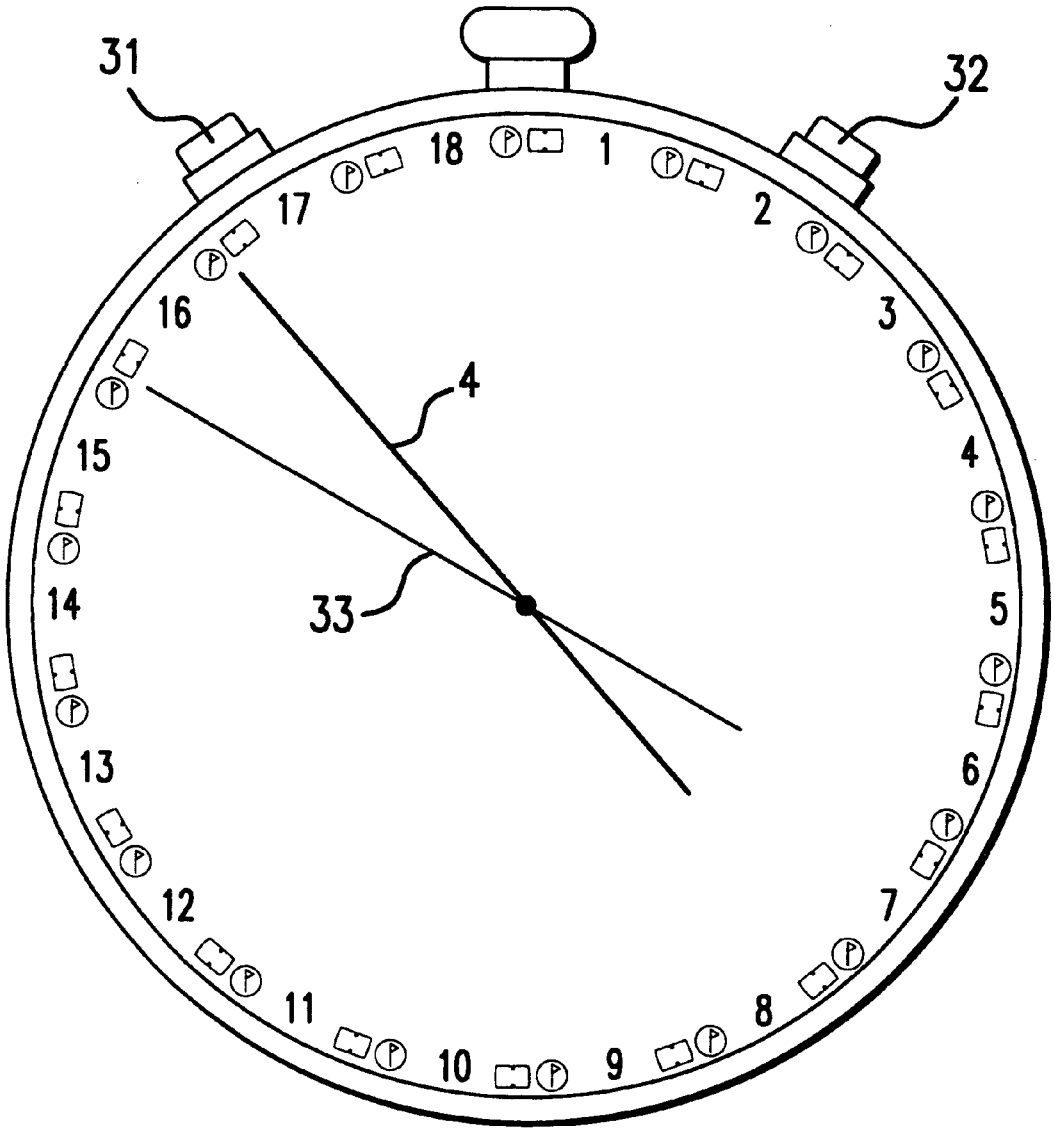

Let us assume that at some point in time the progress monitor indicates the golfer should be teeing off on the seventeenth ($17^{th}$) tee, the golfer is actually just ready to tee off on the sixteenth ($16^{th}$) tee. The golfer presses the recalibration back button 31 to move it to the start of the sixteenth ($16^{th}$) tee. The initial position of the recalibration hand 33 and main hand 4 are shown in FIG. 23. The position of the recalibration hand after the recalibrate back button 31 has been pressed three times is shown in FIG. 24.

According to the progress monitor, the golfer has 24 minutes and 57 seconds (24:57) to complete the round in the target time. This value can be derived from the sum of the times of the facets yet to be played. The time that it would normally take the golfer to complete the three holes that they actually have remaining can be derived from the sum of facets for those three holes. It is thirty eight minutes and 43 seconds (38:43). Using a simple plan, whereby the time for each facet is reduced by a similar proportion, to complete these holes in the target time, the golfers must complete each facet in 64.44% of the time originally allocated. The recalibrated time per facet column of the table shows the recalculated times. Using these times, the time per unit of measure is recalculated. Immediately the calculations are completed, the recalibration hand 33 of the progress monitor will start to rotate according to the values in this column (note that the values for number of units of measure for each facet are not changed by the recalibration process, nor are the original times per unit of measure for the main hand 4, the recalibrated time per unit of measure values are used only by the recalibration hand 33.

Figure 25:
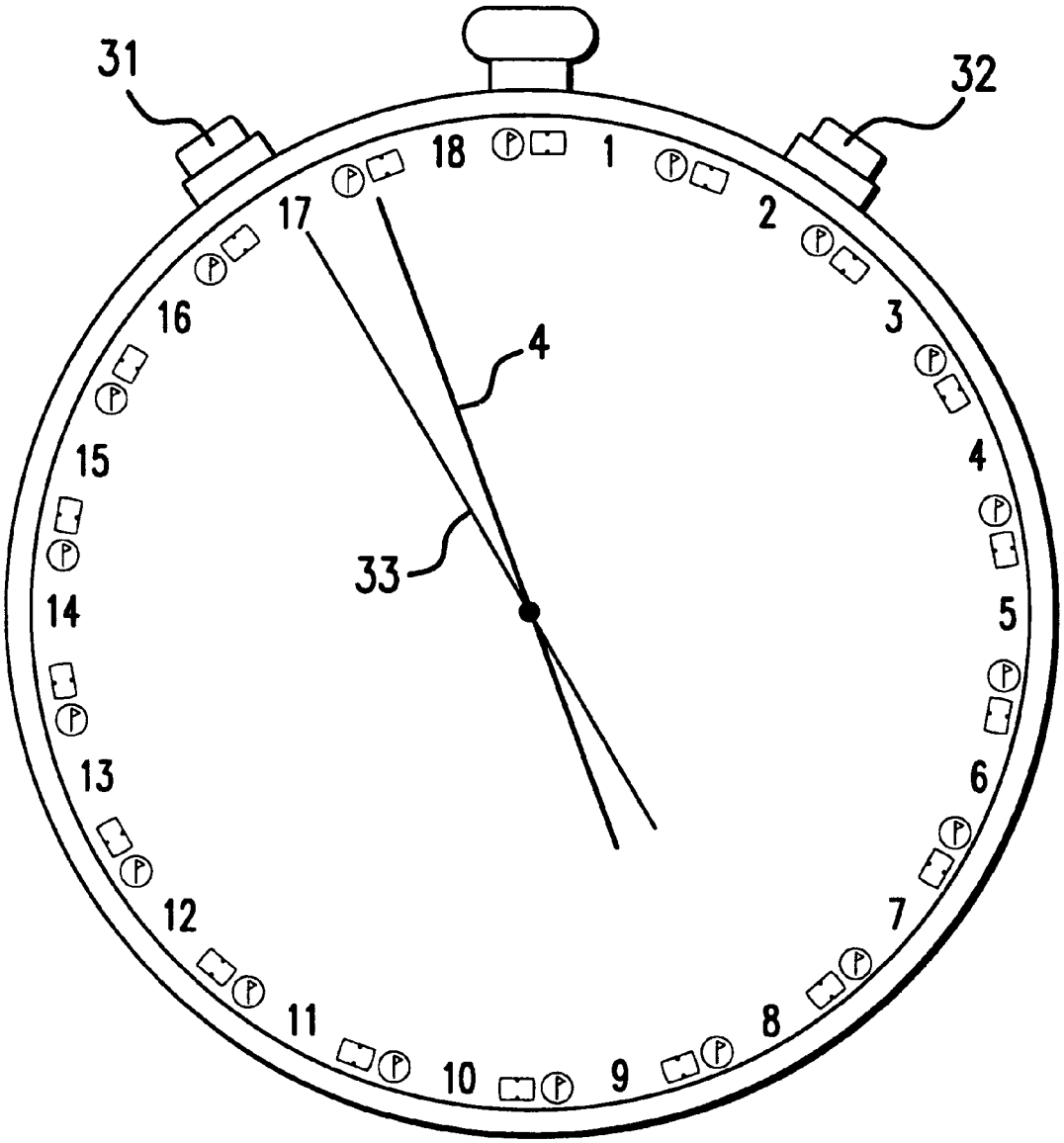
Figure 26:
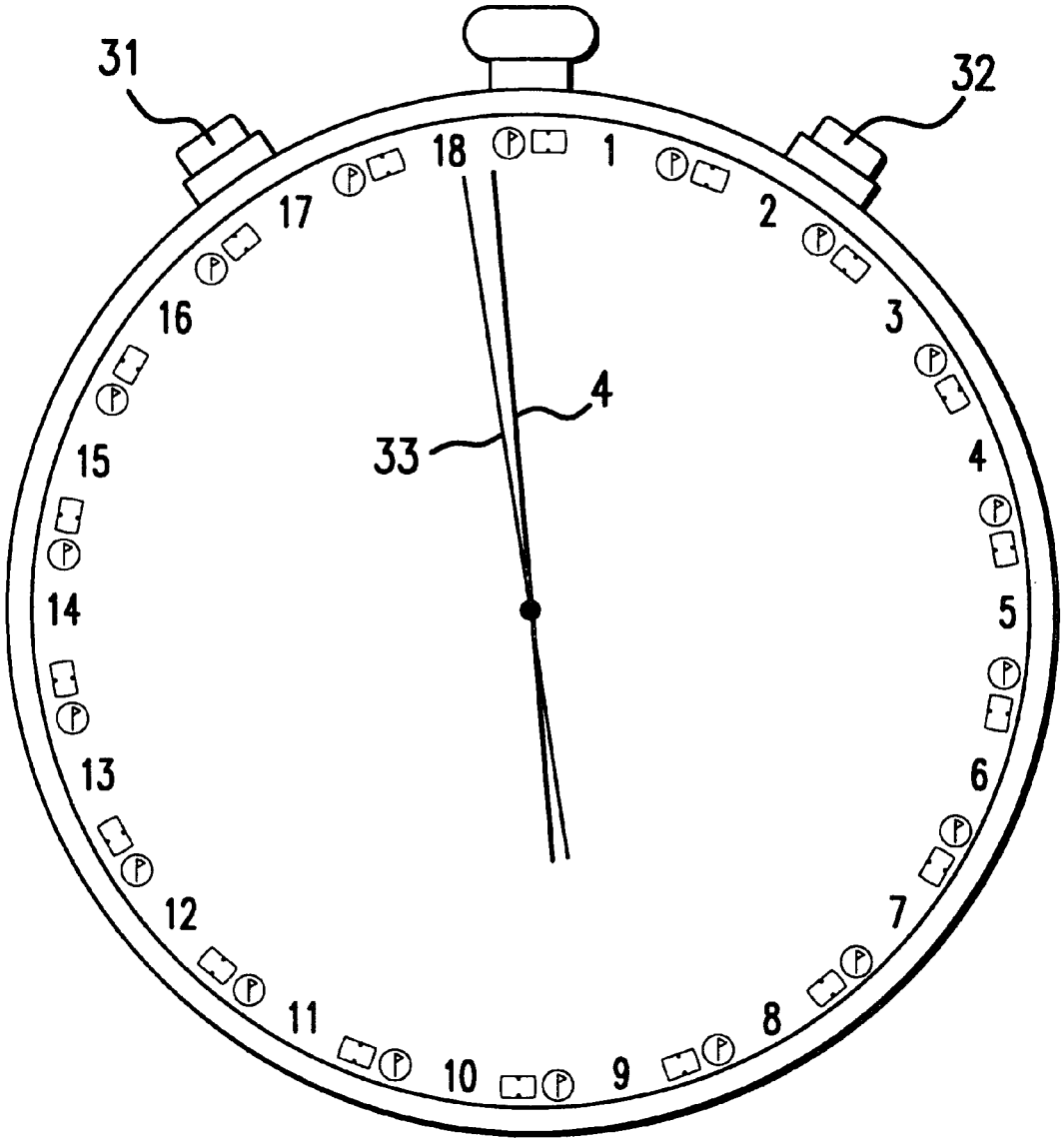

FIGS. 25 and 26 show (approximately) how the recalibration hand will move in relation to the main hand. They should reach the 12 o'clock position indicating the end of the round simultaneously.

Recalibration could be provided as a function in the other embodiments of the progress monitor. All that is required is some mechanism to indicate the actual position, a variation of the display to show an additional item of information equivalent to the main hand which is the recalibrated hand equivalent (such as an additional moving bar in the embodiment shown in FIG. 14), and the addition of the additional recalibration column(s) to in electronic memory.

The typical game of golf begins on the first tee. However it is quite common for groups to play the "back nine" first, that is to start at the tenth ($10^{th}$) tee first. There is also a common practice for starting large groups in tournament play called a "shotgun start". In such tournaments, groups are sent to each tee and at a predetermined time all tee off simultaneously.

Figure 27:
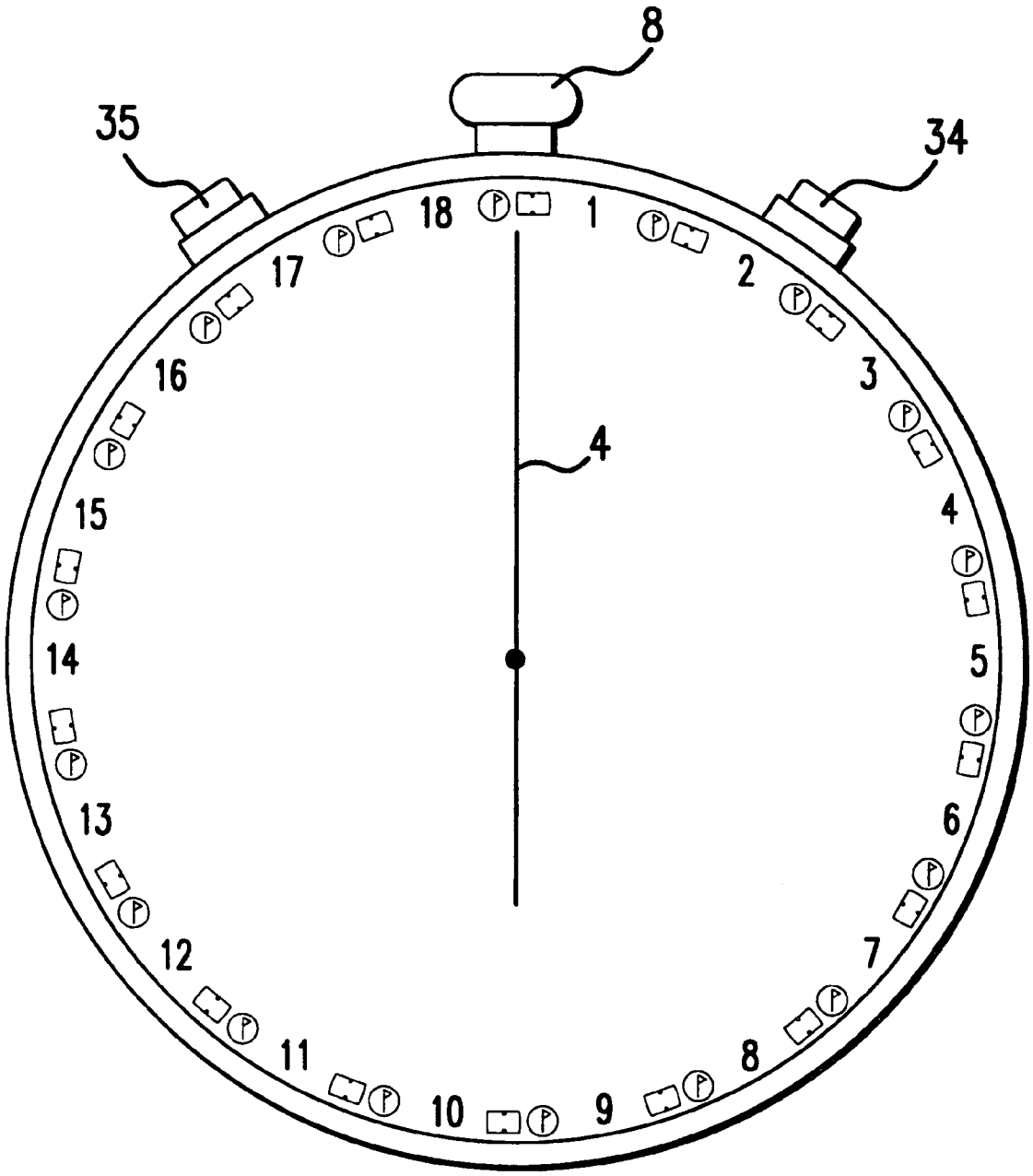
FIGS. 27 and 28 are front views of an embodiment of the progress monitor that shows how the golfer can indicate to the progress monitor that a specific hole is the starting hole.
Figure 28:
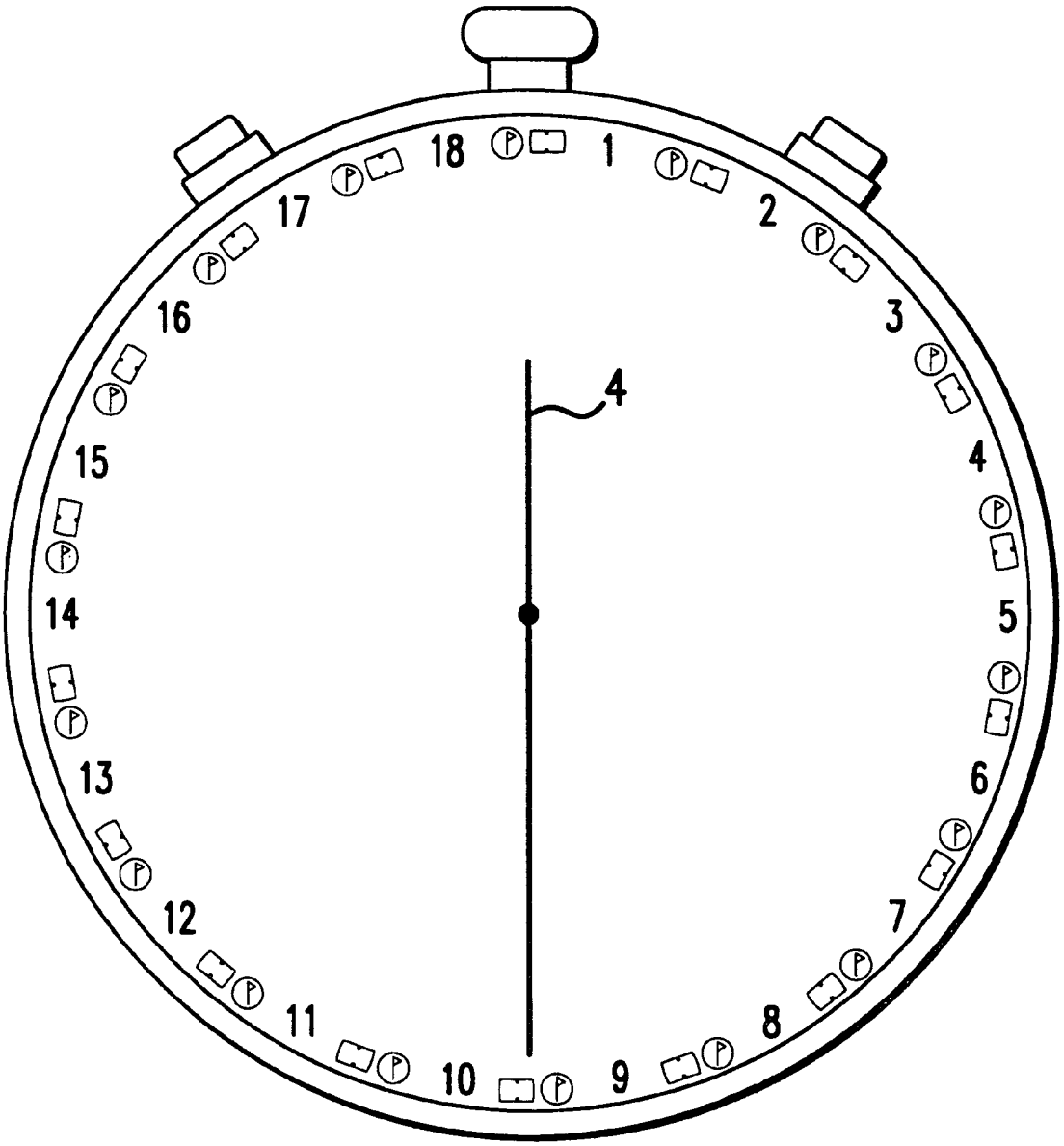

FIG. 27 shows an embodiment of the progress monitor that would provide the capability to start the game at any hole and monitor progress from that point for the next eighteen holes. It contains two additional buttons, a forward button 34 that moves the main hand 4 forward (clockwise) one tee position each time it is depressed and a back button 35 that moves the main hand 4 backward (anti-clockwise) one tee position each time it is depressed. Provided the forward button 34 or backward button 35 is pressed prior to the progress monitor being activated by depression of the start/stop button 8 the main hand 4 can be moved forward or backward, as is most convenient, until it is positioned at the desired starting position. FIG. 28 shows the progress monitor with the main hand positioned to start at the tenth ($10^{th}$) hole.

For convenience it would be desirable to store the starting hole and finishing numbers as additional items of information in the electronic memory of the progress monitor. One benefit of doing this is the functionality to be able to dictate any hole as the start hole might be combined with the recalibration option, using the same buttons (the starting position can only be altered prior to the progress monitor being started, the recalibration hand 33 can only be invoked after it has been started, so there is no conflict). If this was done, the progress monitor would need to know the finishing hole in order to evaluate how many holes there are remaining over which to apportion the available time.

| Course information: | | |
|---|---|---|
| Target Time (Hours:Minutes) | Starting Hole | Finish Hole |
| 4:00 | 10 | 9 |

The preceding narrative has demonstrated how a progress monitor would work based on information on how time was to be apportioned to various facets of play. It is proposed that information would be stored in electronic memory. What follows is a discussion on the various methods by which it is proposed the information could be loaded into the electronic memory of the progress monitor.

Figure 29:
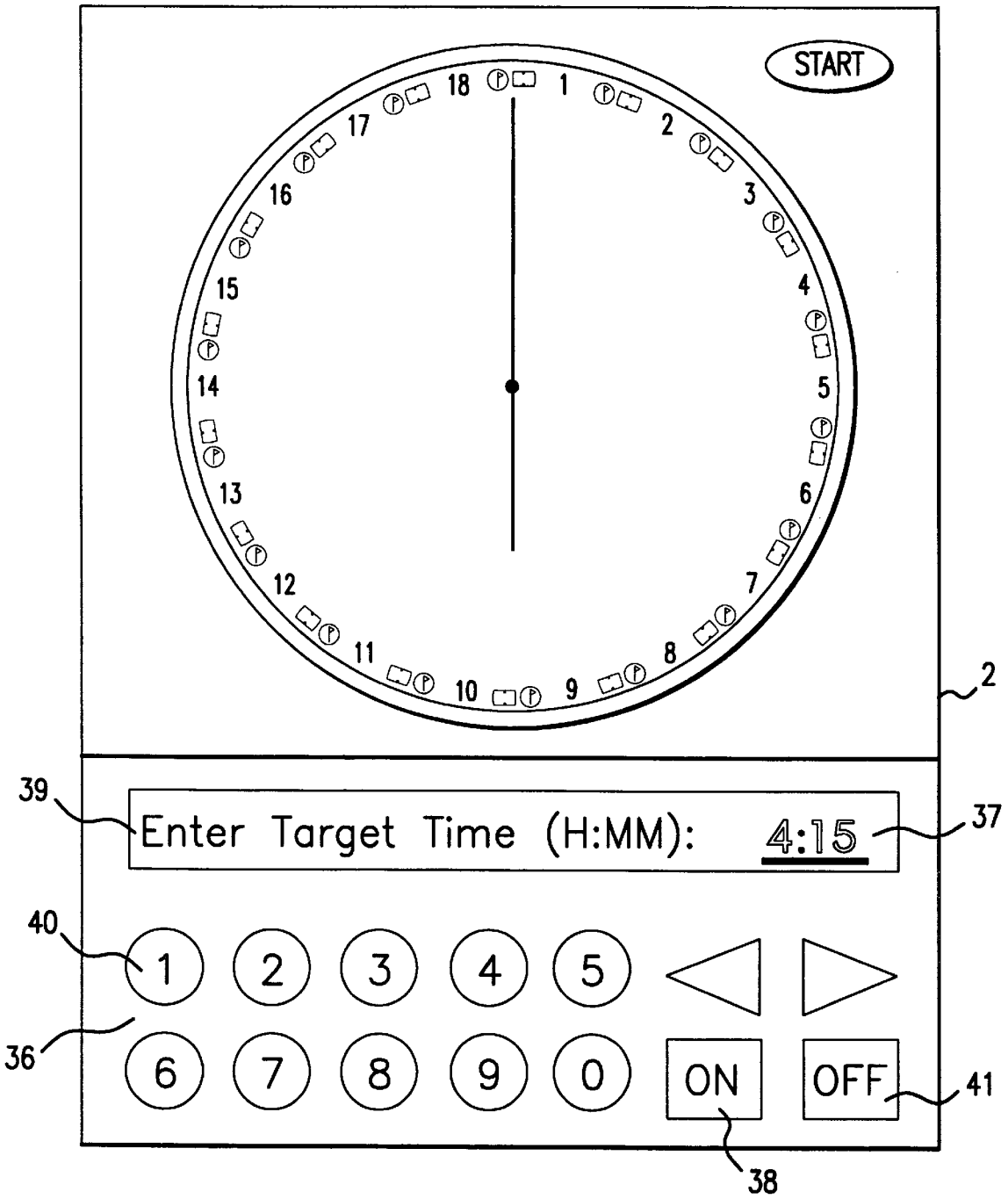
FIGS. 29, 30, 31, 32, 33, 34 and 35 are front views of an embodiment of the progress monitor that shows how parameters governing the rate of play for different facets of play on the golf course could be input manually.

FIG. 29 illustrates a possible implementation of the progress monitor showing how a golfer could enter information for each hole, through a small keypad 36 incorporated into the case 2 of the progress monitor. A small electronic display screen 37 is also incorporated into the design to provide for the golfer to be prompted as to which data to enter and to show the entry of that data. FIG. 29 demonstrates a possible implementation where the process of data entry has been simplified because the design has preset fixed times for certain facets of play, such as teeing off, putting out and moving between holes. In this possible implementation all that is required to set the device is the entry of the target time and the percentage of the available time to allocate to each hole. In this implementation it is envisaged the golfer will be entering values from some printed list.

Figure 30:
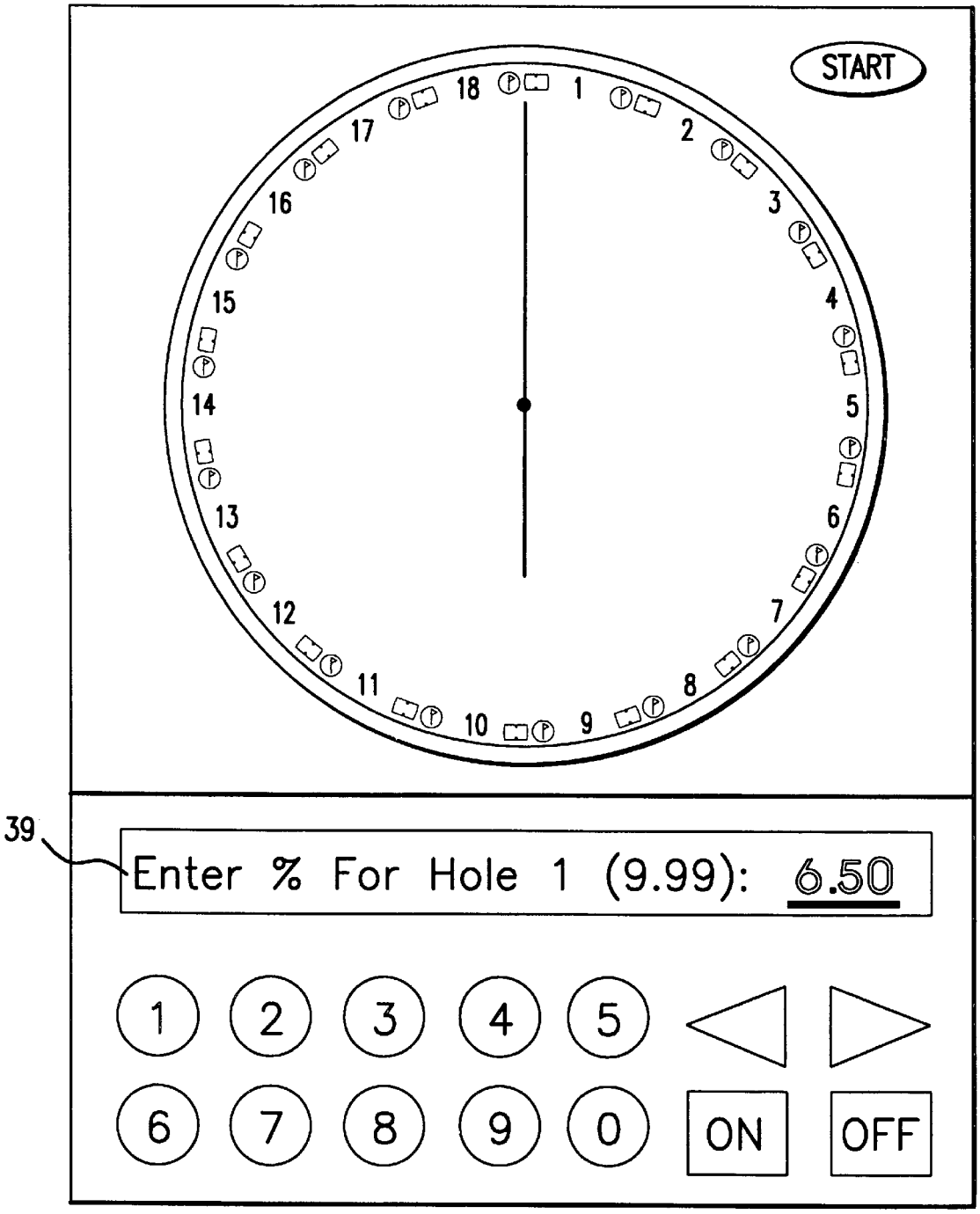

To begin the entry of times for the round, the golfer first presses the ON button 38. This brings up the display shown in FIG. 29 in which the first prompt 39 ("Enter Target Time (H:MM):") is for the target time. To enter a value for the target time, the golfer presses numeric keys 40. In a simple implementation, the device could insist that all three digits of the target time be entered and when it detected the third digit had been entered, immediately bring up the display shown in FIG. 30. In this display the prompt 39 ("Enter Percentage For Hole 1 (9,99):") is for entry of the percentage of target time to allow for the first hole. In a simple implementation, the device could insist that all three digits of the percentage be entered. That is, it would insist on 6.50 as shown in FIG. 30, not allowing 6.5).

Figure 31:
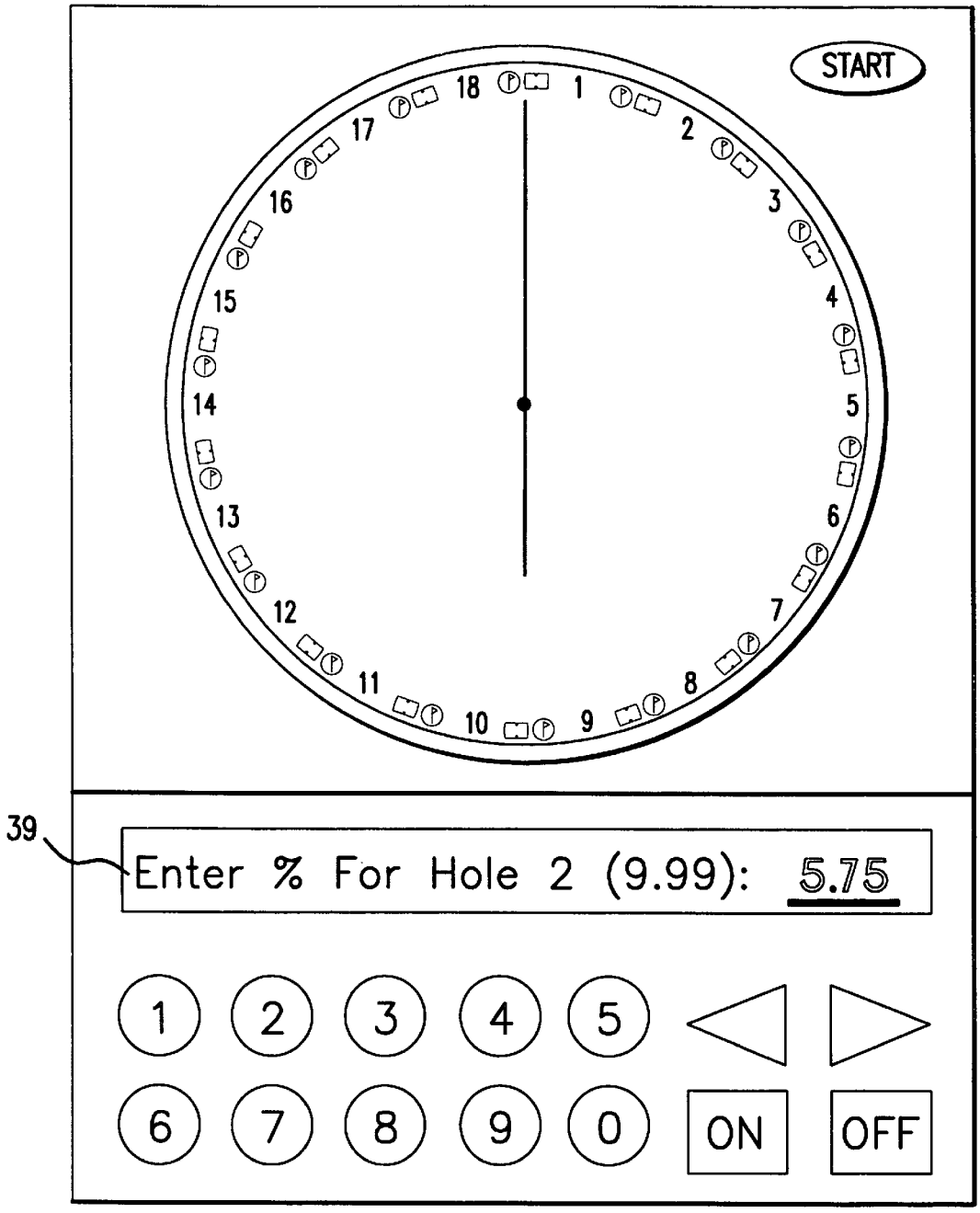
Figure 32:
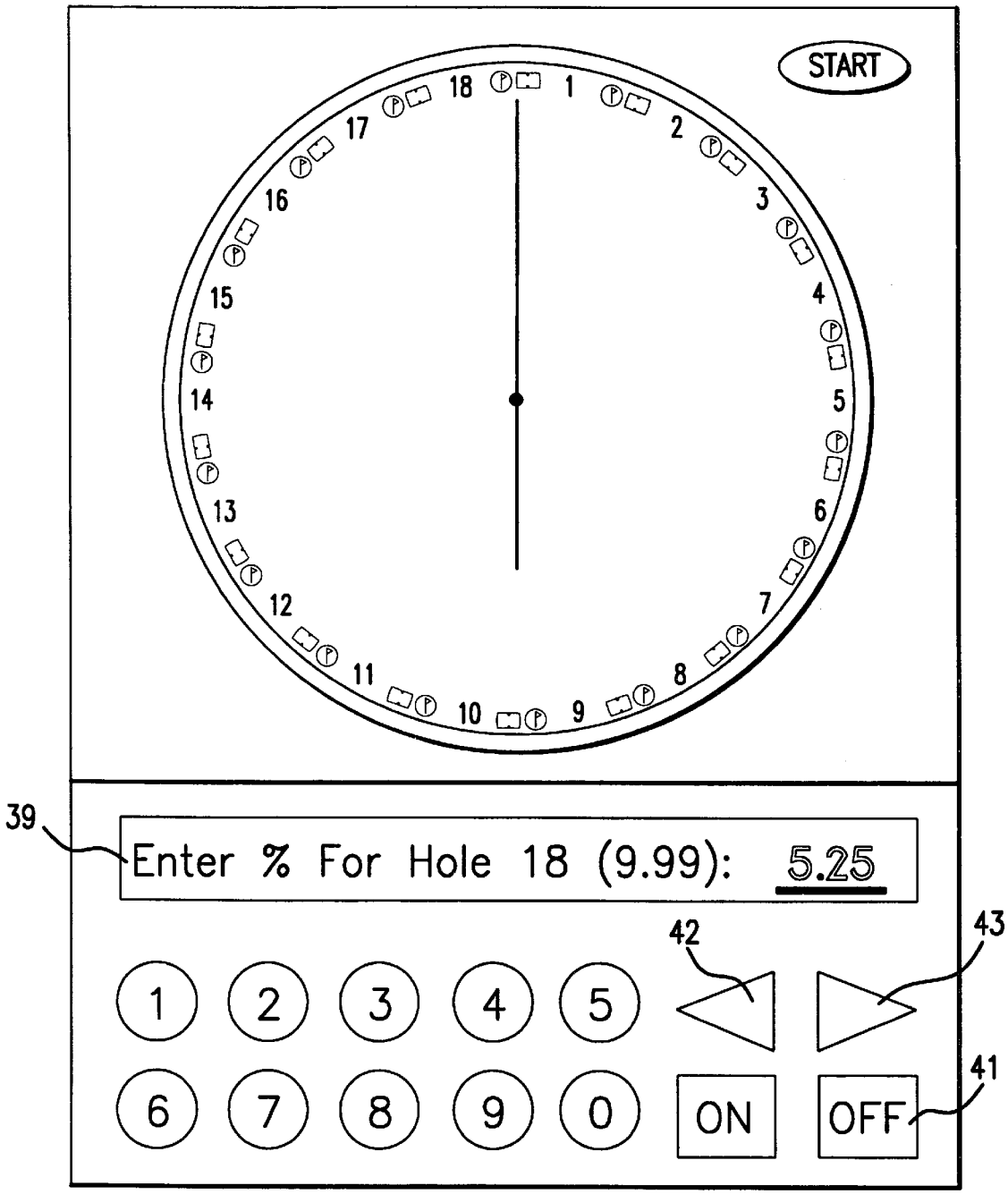

When the third digit had been entered it would immediately bring up the display shown in FIG. 31. In this display the prompt 39 ("Enter Percentage For Hole 2 (9.99):") is for entry of the percentage of target time to allow for the second hole. When the percentage for this hole had been entered it would move to the next hole, and so on until it had entries for all eighteen holes, as shown in FIG. 32. At this point the golfer simply turns the display off by pressing the Off button 41.

In this example, the progress monitor allows three digits to be entered representing a possible range of target time hours and minutes from 0:00 to 9:99, and percentages 0.00% to 9.99%. In practice it would be expected that certain edit checks be added so that the target time could not, for example, be less than 3:00 or higher than 6:00. Similarly checks could be added so the percentage of time to allocate to any hole could not, for example, be less than 4.00% or higher than 8.00%. A check would also ensure that the total of percentages entered could not exceed 100%. A Back Key 42 and a Forward Key 43, would allow for correction of any entry for a single hole or to go back to re-enter the target time.

It is obvious that such a design is technically feasible, but with a large number of factors, typing them in individually, for each hole could be somewhat tedious. However, most golfers play the same course on a regular basis. It is proposed that the progress monitor would have the ability to retain settings in electronic memory. This is a very significant advantage over other devices in the art. What would be required in this case would be a one time entry of the hole percentage allocations. If the target times changed, just a single entry would be required which would be possible just by turning the device on, as it is the first display. This would make such an implementation quite practical for a golfer who played the same course on a regular basis. The size of the screen and the keyboard limit the sophistication with which data entry can be done. However, by limiting the number of options the capability could be increased within this design.

Figure 33:
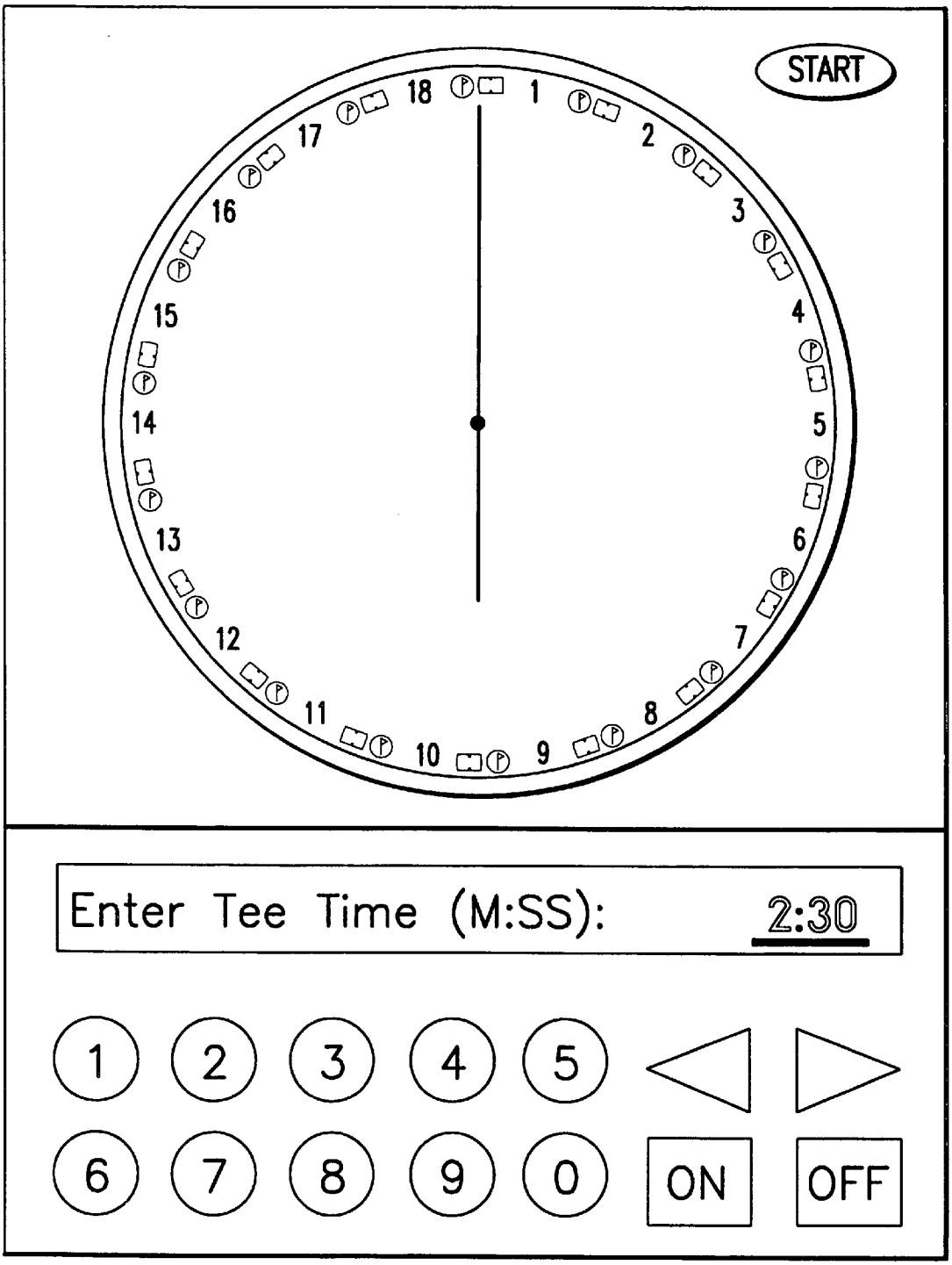
Figure 34:
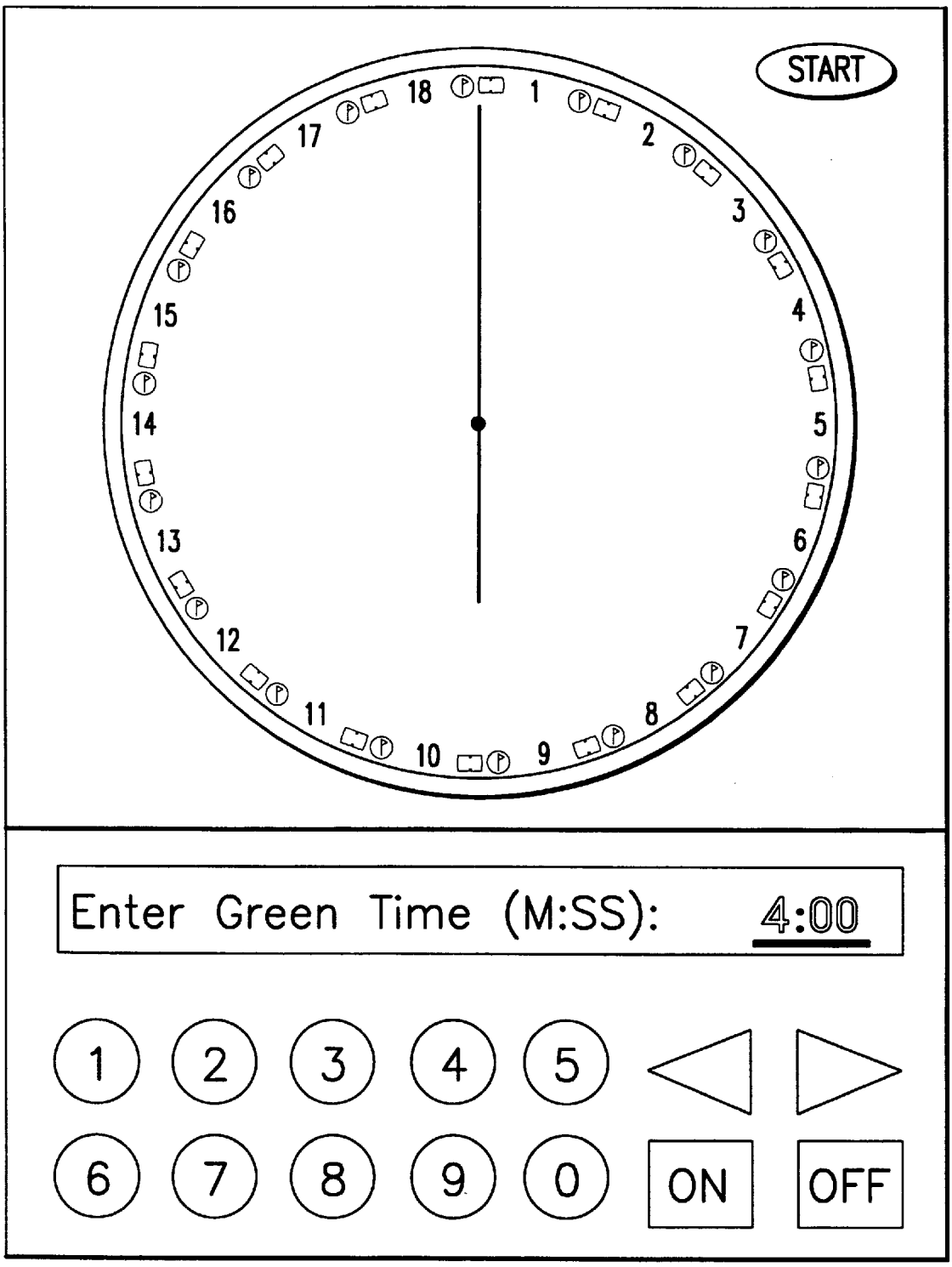
Figure 35:
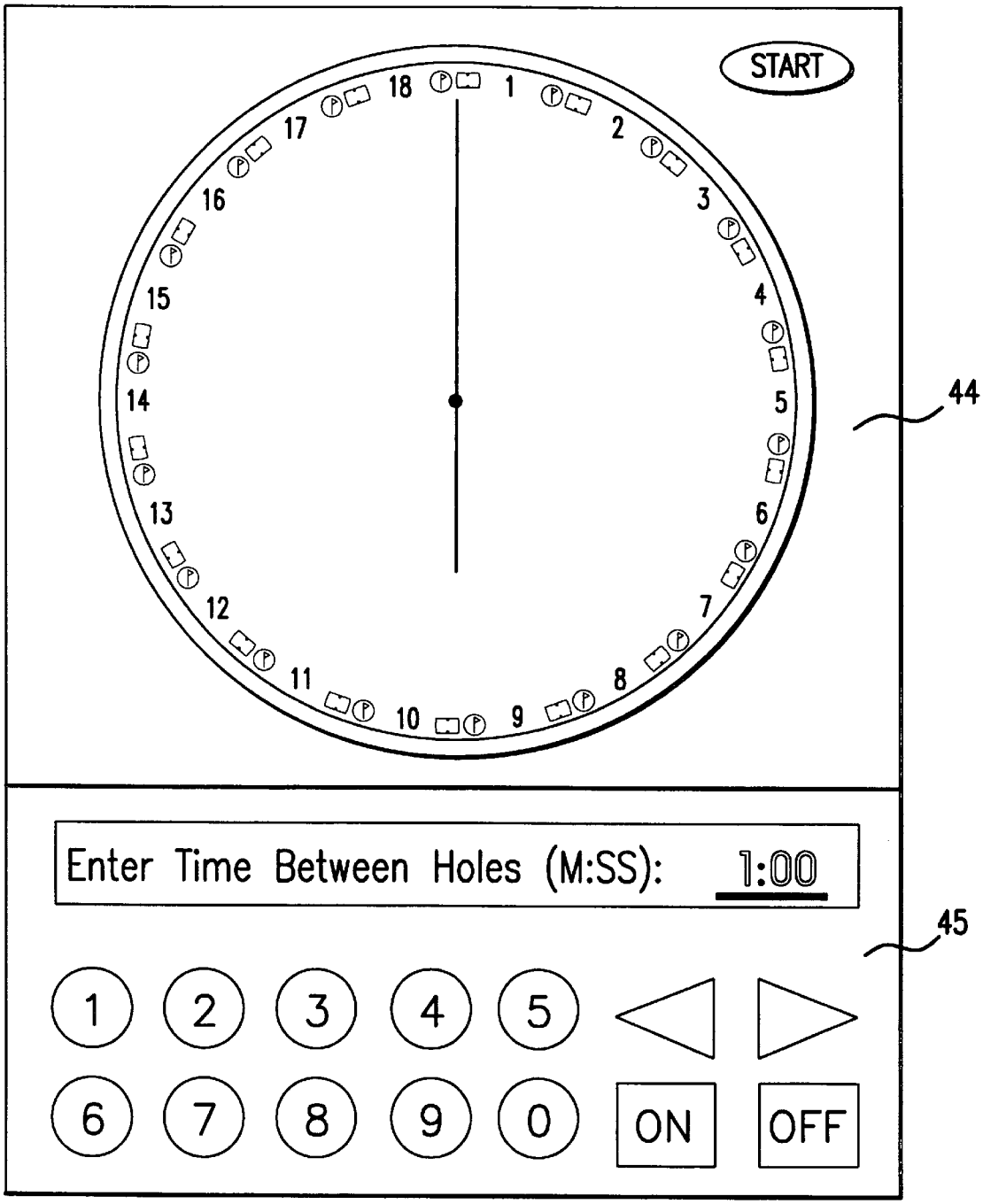

For example, data entry should still be relatively easy if the golfer had the option of entering fixed times for teeing off, putting out, and moving between holes, but these times were applicable to all holes. In a possible implementation based on this design, the user would simply be asked to enter three additional pieces of information as shown in FIGS. 33, 34 and 35. Logically these screens would follow after the target time had been requested and entered, as shown in FIG. 29 and prior to the request for the percentage allocations per hole as shown in FIGS. 30, 31, and 32 (Which in this implementation are now by implication for play down the fairway). Further sophistication could be added by requesting the entry of the hole numbers for call up holes and adding a fixed amount of time to the putting out time for those holes, for example, equal to the tee off time entered. Having a simple data entry function such as this keeps manufacturing costs down and enhances portability.

In FIGS. 29–35 the progress monitor is shown as a single unit. However, functionally it is divided into two sections. The upper part, the progress display component 44 provides the functionality to demonstrate to a golfer where on the course he or she should be at a given point in time, based on parameters stored in electronic memory. The lower part, the data entry component 45, provides the functionality to enter those parameters.

The input of parameters would be greatly enhanced by the addition of a larger screen for displaying prompts to the user and displaying the results of the data entry. A larger keyboard would also be advantageous. However, the unit then becomes increasingly bulky. Portability is an important consideration.

Figure 36:
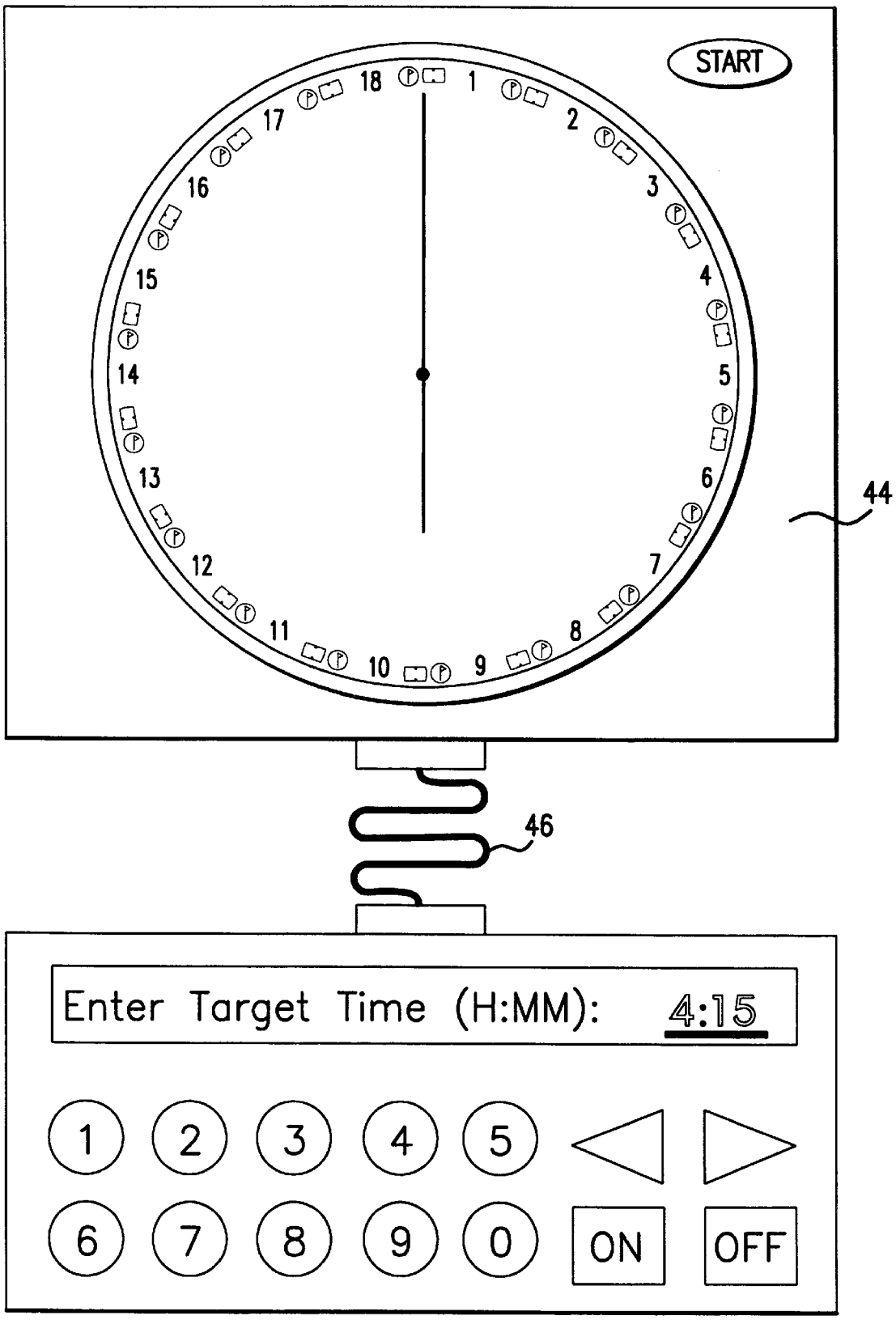
FIG. 36 is a front view of an embodiment of the progress monitor that shows how the display and data entry components of the progress monitor could be separated and joined by an interface cable.

Quite obviously, the two parts could be physically separate units, connected by a detachable cable 46, as is shown in FIG. 36. This solves the problem of bulk, and also solves a problem associated with the environment in which the progress monitor would be used. That is, bouncing around on a golf cart exposed to all sorts of weather. By separating functions, only the progress display component 44 needs to be made more rugged to protect it from shocks and weather.

Figure 37:
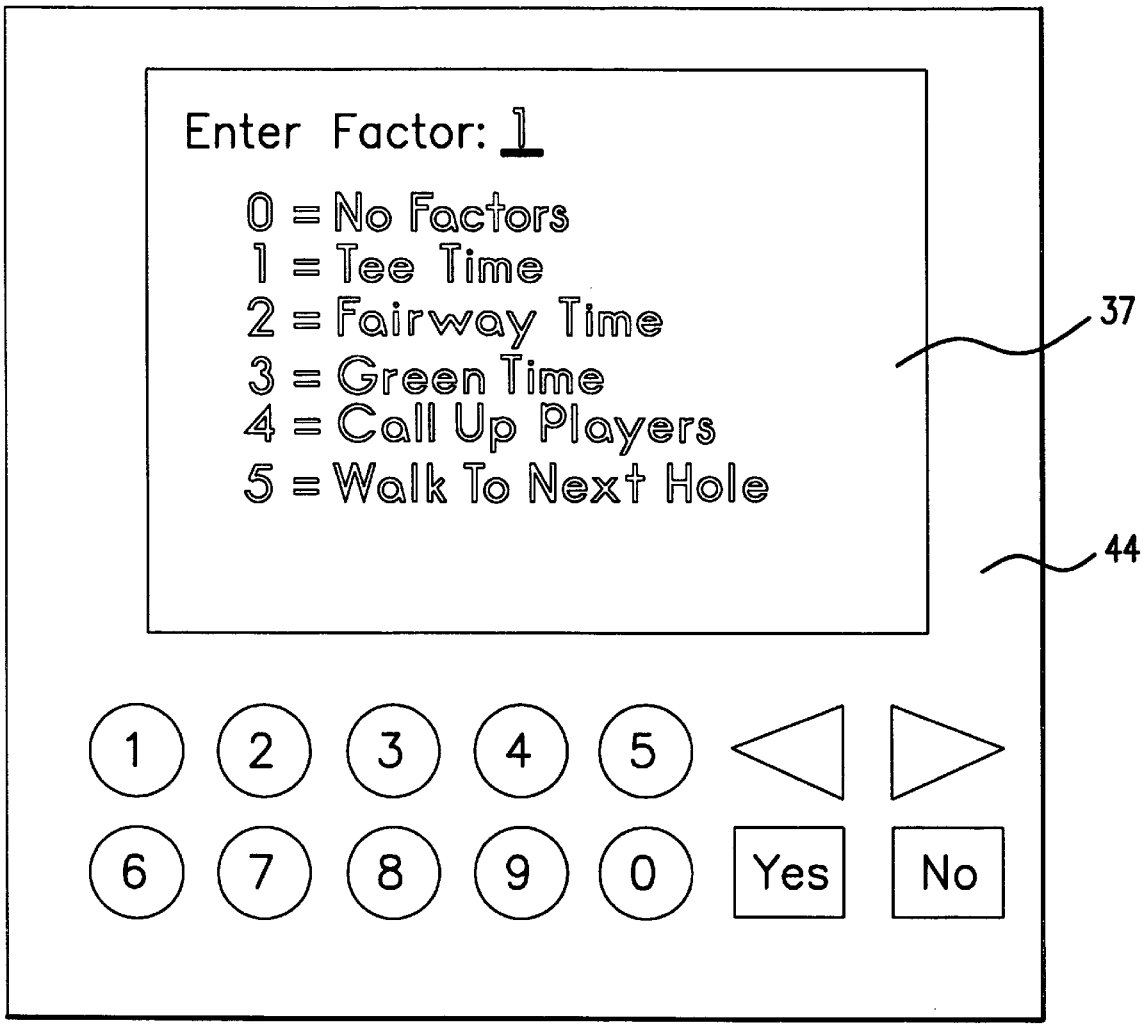
FIGS. 37 and 38 are front views of an embodiment of the progress monitor that shows how a large screen for the data entry component allows the entry of parameters to be facilitated by more user friendly dialog.
Figure 38:
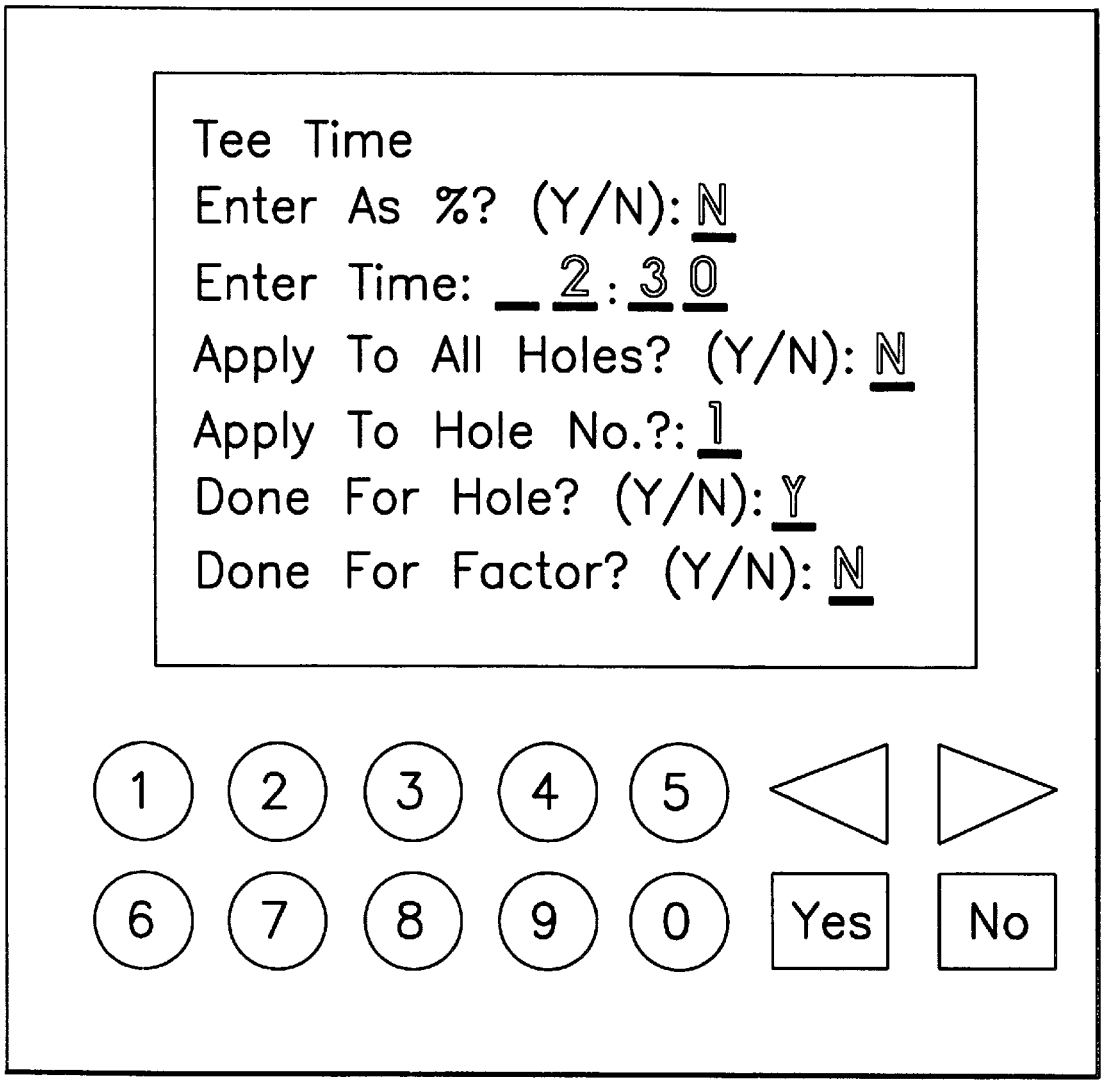

FIG. 37 shows an embodiment of the data entry component 44 of the progress monitor in which the size of the screen 37 in the data entry component 44 has been increased, from the single line display shown in FIG. 36 to one capable of showing several lines of text. The dialog on this screen and on the screen shown in FIG. 38 demonstrates how the larger screen makes it possible to do more sophisticated prompting of the user.

In these examples, the extra screen space is used to allow more sophisticated interaction to occur. The user interface could provide a menu of choices and multiple questions on a single screen as shown.

Using such an expanded data entry component, a series of questions could be asked that allowed all the parameters for a round of golf to be established. The design of the screens would be dictated by the need to make the process of entry of parameters as easy as possible. Though there are numerous ways in which the dialog between the progress monitor and the user can be arranged, there is probably an order that is most logical.

In a possible implementation, the target time for the round would probably be the first value entered. It is probable that the next series of questions would ask for all the facets for which fixed times were to be allocated to be entered. To minimize the effort in entering these values, the implementation could provide the capability for the user to choose to apply that value to all holes, then to change the value for the holes that were an exception to the rule. For example, the user could decide that tee time would always be a fixed amount. The user could enter, for example, two minutes, then apply it to all holes. However, for some reason, on the fifth tee a longer amount of time is needed. The user should be able to select that one hole for revision and to change the time to, for example, three minutes. The screen could display the amount of unallocated that was left after the fixed time factors had been entered. The user might then enter the percentages of time to apply to each hole. In such an implementation, it is probably that the values to be entered will have been calculated independently of the progress monitor and just entered. Some validation could be provided to ensure that exactly one hundred percent (100%) of the remaining time was allocated to variable factors.

Though technically feasible, providing a special purpose data entry screen has several disadvantages, compared with an alternative implementation discussed as follows. Firstly, though an improvement on the screen shown in FIG. 36, the screen shown in FIG. 37 is still relatively small and the keyboard minimally functional. Though a better dialog can be presented to the user, the useability is still constrained by the screen size. For example, it would be much better if all the parameters entered were shown on the screen so the user has a sense of where he or she was in the process. It is a special purpose device, so developing it would be expensive. Nevertheless, it should be borne in mind that once entered, the parameters for a round are retained permanently in the electronic memory of the progress monitor. Normally, for a given course, the target time would be the only parameter to alter from round to round. The ability to set the device with just the entry of the target time is a major advantage of the progress monitor of the present invention.

The primary reason why the foregoing embodiment is not preferred is that it does not seem necessary. Rather then use a special purpose device it is suggested that the parameters for the progress monitor be set up on a general purpose computer and downloaded into the monitor.

FIG. 37 shows schematically the simplest implementation of such an embodiment. In the configuration, the computer 47 provides the functionality of the data entry component 45 in FIG. 36. An interface is made with the cable 46 or other mechanism to the display component of the progress monitor 44 especially designed with a connection for the downloading function. In this implementation the ability to do more sophisticated parameter entry is immediately provided. In fact, the type of information that is required for operation of the progress monitor is ideal for collection by a computer program. It could be done by spreadsheet, though a purpose written, user friendly program would probably be better, given the broad user community it is intended to serve.

The screen on the computer could show how the total time for the round was being allocated over the various facets and if a user changed any parameter it could dynamically adjust the allocation in a manner similar to that of a spreadsheet. In this embodiment the parameters are all held on the computer and downloading is controlled from there. Once the user is satisfied that the correct values have been entered, he or she would simply click on an icon to load the parameters into a progress monitor. The downloading would be controlled from the computer all that would be required of the progress monitor would that it be plugged into the interface and placed into a load ready state.

The arrangement shown in FIG. 37 greatly enhances the ability to establish an load the parameters that will be used by the progress monitor. If the user needs to describe any course, he or she could do so and then save the results for future use, on the hard drive of the computer. If the user played on a number of different courses, the files could be identified in some way so that the appropriate one could be called up, and only those factors that varied since the last time it was used need to be entered.

This brings to the forefront the fact that the intrinsic nature of a golf course does not change much from year to year, let alone round to round. Once built, the sequence of holes and their par values tend to remain that way. Occasionally a course may have a hole change in length, par or in playing order, but such changes are unusual. This opens up the opportunity for a database of courses to be created and made available to the purchasers of the progress monitor. The supplier of this database of information would have to establish the best allocation of time over the facets of play applicable to each course.

Figure 39:
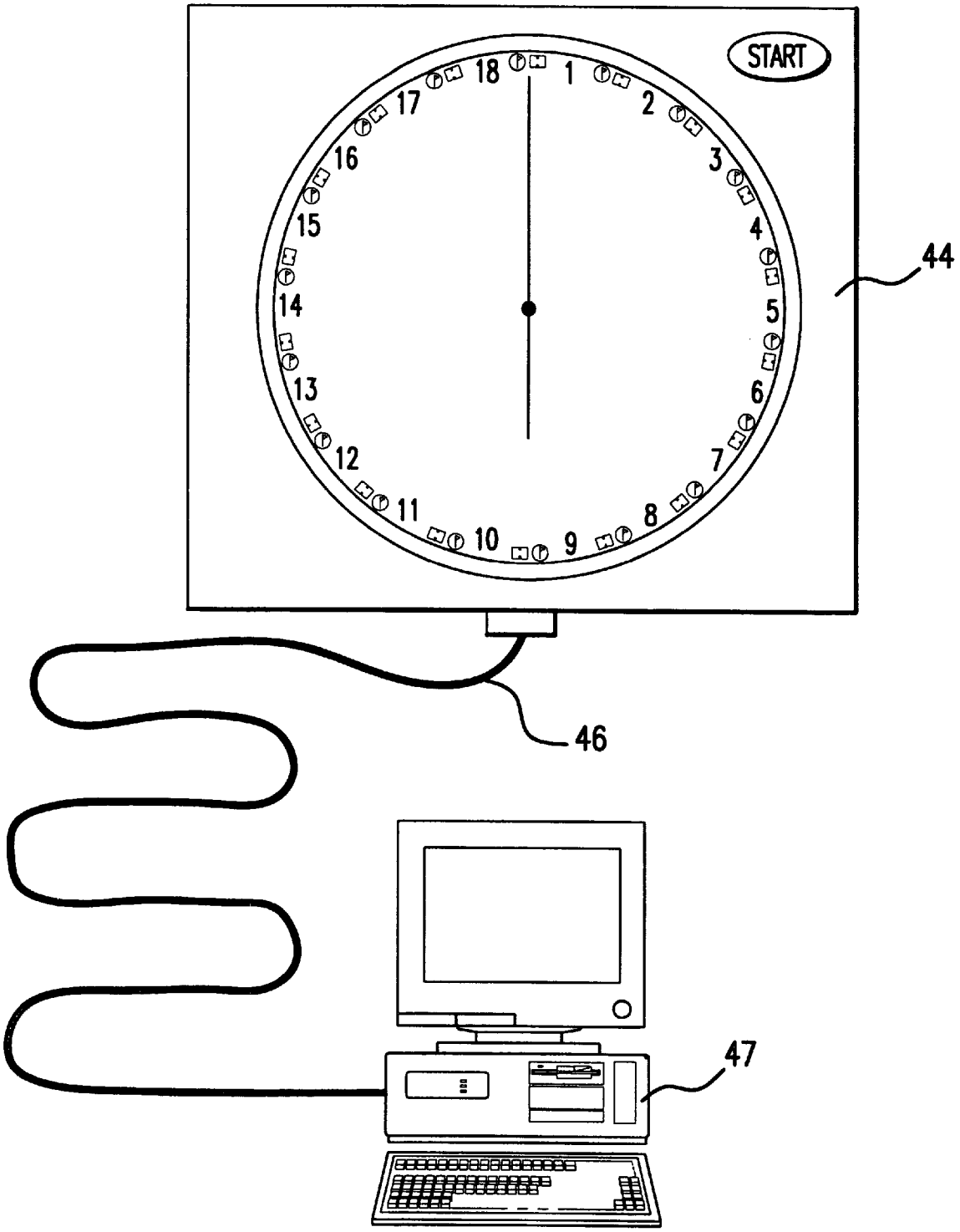
FIG. 39 is a front view of an embodiment of the progress monitor that shows how parameters are downloaded into the progress monitor from a computer.
Figure 40:
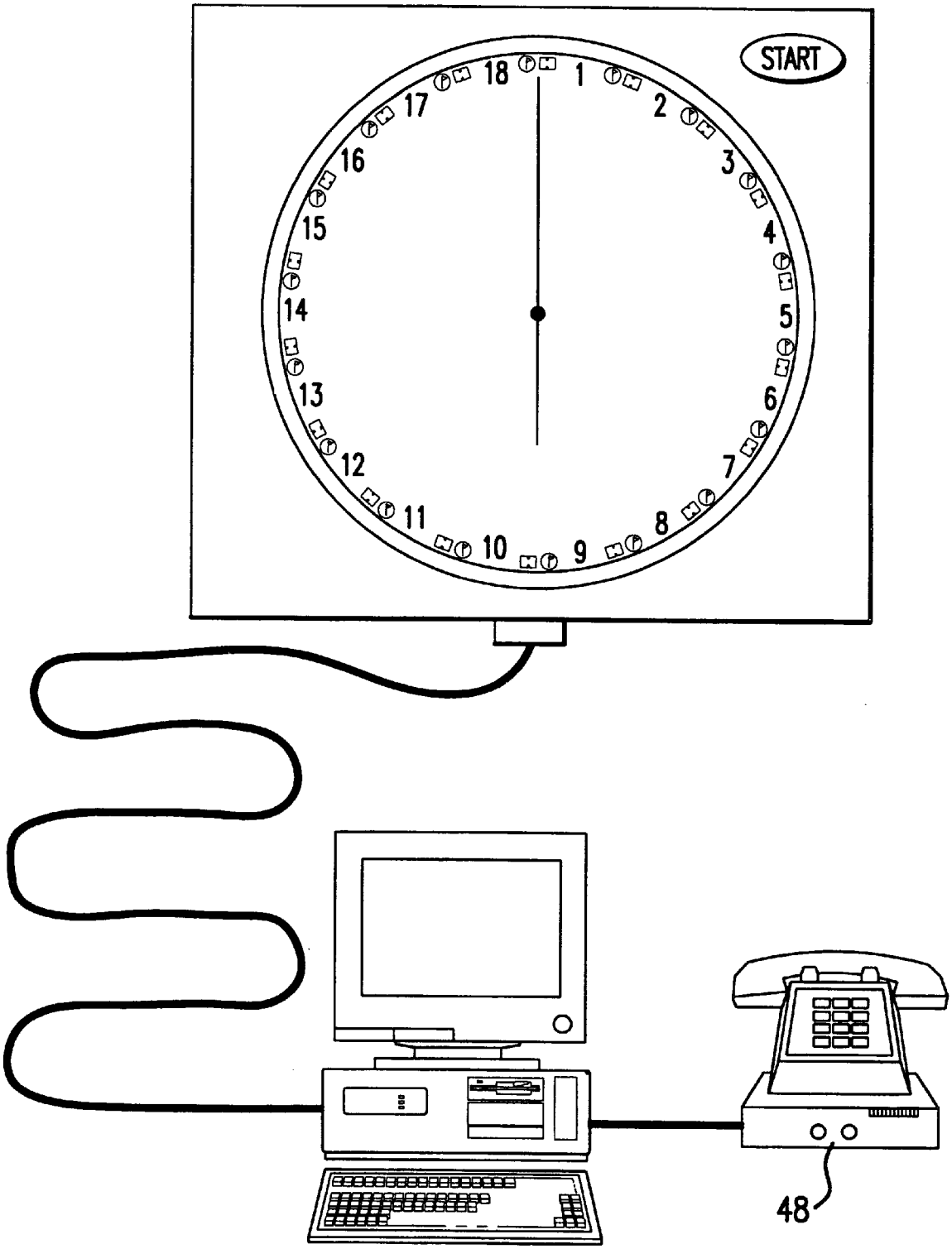
FIG. 40 is a front view of an embodiment of the progress monitor that shows how parameters are downloaded into the progress monitor through a modem.

FIGS. 39 and 40 show two arrangements by which the owner of the progress monitor would access that information. Instead of entering the parameters for the course, the user would either connect the progress monitor to a computer or dial into the Internet through a modem 58 and access an Internet site on which the database of courses and their parameters was held. The user selects the course of interest from the computer an downloads previously calculated percentages for that course. The user could then download those parameter directly into the progress monitor, or more likely, download them onto the hard drive of their computer from where they would then download them independently to the progress monitor. (This arrangement takes into account that the owner of the progress monitor(s) will in most cases be the course management or golf professional responsible for play on the course who will be loading a number of them to provide to the golfers who will be using them, and returning them at the end of their round.

Figure 41:
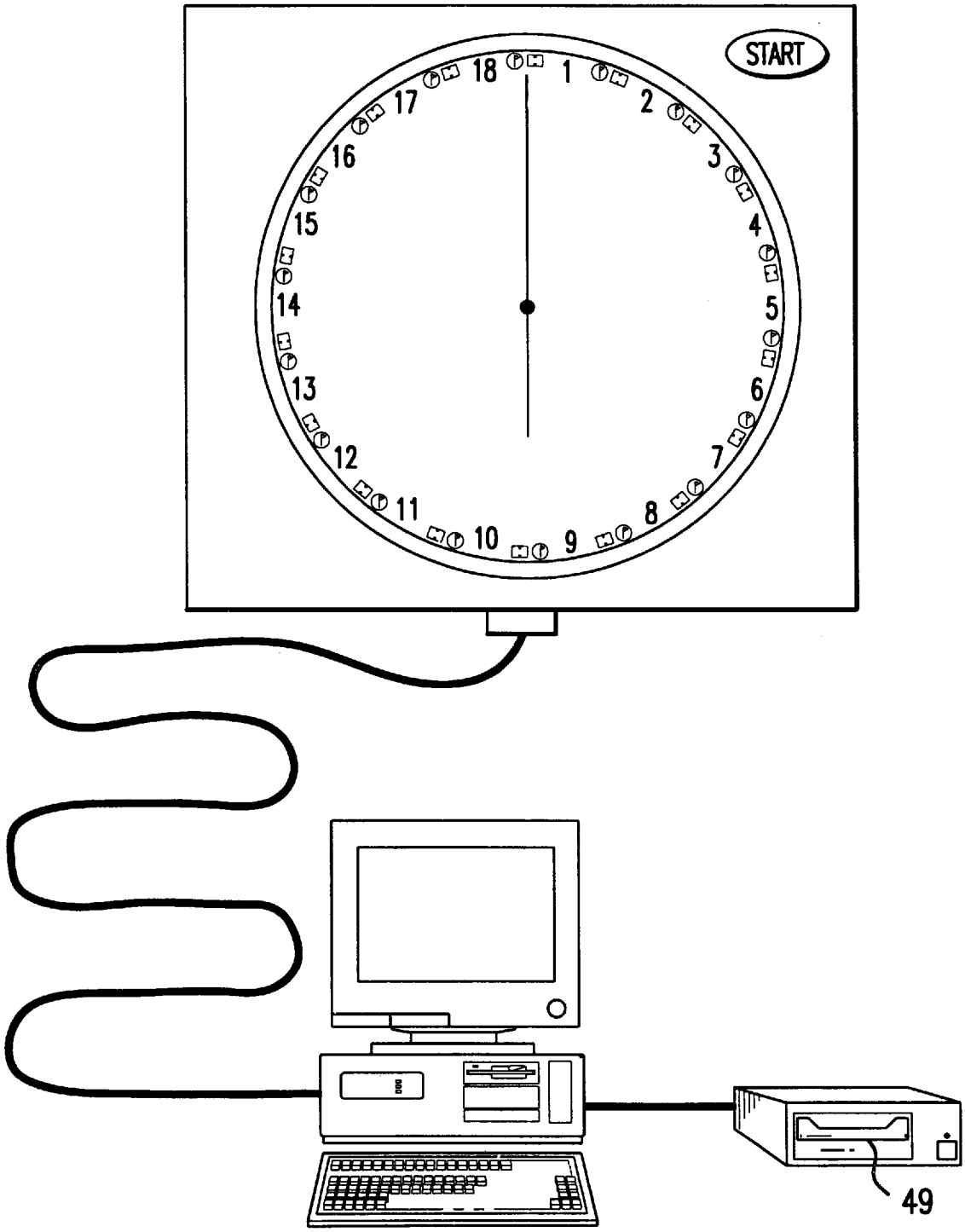
FIG. 41 is a front view of an embodiment of the progress monitor that shows how parameters are downloaded into the progress monitor through a CD ROM.

FIG. 41 shows an alternative in which, rather than accessing a database through the Internet the user is provided with a CD ROM containing the database of courses and downloads the information by placing the CD ROM into a CD ROM player 49, and reading it from there.

The foregoing discussion focused on the functionality provided by the progress monitor regarding performance of its main task, namely, showing golfers where they should be at any point in time if they are to complete a round of golf within a given time.

However, once the device has the provision to accept information in electronic form downloaded from a computer, CD ROM, an internet site, or some other repository, additional functions become possible.

The discussion has already covered how the progress monitor course information relevant to the functions of the progress monitor. It would take minimal additional effort to expand the possibilities of the device so that it could include other related information. For example:

Yardage & Par Information

| Tee Color | Course Rating | Slope | Length Out | Par Out | Length In | Par In | Length | Par |
|---|---|---|---|---|---|---|---|---|
| Black | 72.7 | 123 | 3271 | 36 | 3271 | 36 | 6803 | 72 |
| Blue | 71.10 | 120 | 3174 | 36 | 3174 | 36 | 6508 | 72 |
| White | 69.3 | 116 | 2889 | 36 | 2889 | 36 | 5879 | 72 |
| Red | 71.6 | 120 | 2668 | 37 | 2668 | 38 | 5469 | 75 |

Hole Information For Black Tees

| Hole | Length | Par | Handicap |
|---|---|---|---|
| 1 | 345 | 4 | 11 |
| 2 | 330 | 4 | 15 |
| 3 | 193 | 3 | 17 |
| 4 | 333 | 4 | 13 |
| 5 | 533 | 5 | 3 |
| 6 | 205 | 3 | 9 |
| . . . | | | |

Some of this additional information could be used to assist in the setting of target times for the different facets of play on different holes. For example, rather than have a golfer enter allocations, it might be possible to apply an algorithm based on such information. It is certainly reasonable that the time it should take to play a hole is going to be determined by par, length, handicap (degree of difficulty) and so on.

The information that could be downloaded need not be restricted to alphanumeric data. It could be a particularly useful addition to the functionality if the device provided for the downloading of graphics showing the layout of each hole. In research into the issue of slow play one comment that appeared numerous times was how having distances well marked made club selection for players simpler and faster. A graphic that showed distances such as 200, 150 and 100 yards to the front of the green, in relationship to recognizable objects on the hole, could be very useful. If the information was being downloaded every day it might be practical to show flag positions and so on. Detailed information such as this is regularly compiled and used by professional and better players. Any changes to the course that would effect the speed of play could be updated and downloaded with the same frequency as the changes themselves.

By making a device that was appropriate size, and included a keyboard as shown in preceding embodiments, the functionality could be expanded to allow input of information by golfers as they played their round. For example, it might be programmed to provide for input scores, keep track of matches and so on.

Furthermore, the attachment to a computer need not be a one way connection. It could be practical to provide for the information about a round to be uploaded from the device into a computer. Now the capability would exist for scores to be directly passed to the electronic systems that many clubs use for handicapping.

The creation of a graphical layout of a course compilation of it relevant details would be a one time exercise. Once converted into digital form, the regular use of the device becomes an attractive proposition. A device that was rugged enough to attach to a golf cart or trundler, becomes economically more viable the greater the number of functions it can perform. By providing download, input, upload and appropriate display capability, the number of functions can be easily expanded so that what might have a primary function as a progress monitor becomes a game management device.

Having described several embodiments of the progress monitor, it is believed that other modifications, variations and changes will be suggested to those skilled in the art in view of the description set forth above. For example, the number of holes and time duration's shown in the illustrated embodiments are meant to be common values, and are not meant to be limited to those values. It is therefor to be understood that all such variations, modifications and changes are believed to fall within the scope of the invention as defined in the appended claims.

What is claimed is:

1. A device for monitoring progress of golf play comprising:

a dial having eighteen uniform segments corresponding to holes of a round of golf;

means for setting a desired duration period for said round of golf;

means for entering a desired duration for at least one facet of play;

a first rotating hand indicating a position on one of said segments corresponding to a position at one of said holes a golfer should be at, at a given time, in order to complete said round of golf in said desired duration period;

means for rotating said first rotating hand at varying speeds determined by said desired duration period for said round of golf and said desired duration period for said at least one independent facet of play on each of said holes, said first rotating hand rotating one complete revolution in said desired duration period for a round of golf;

said segments comprising markings corresponding to said at least one independent facet of play, wherein said first rotating hand crosses said markings in said desired duration for said at least one independent facet of play; and means for starting and stopping said rotating means.

2. A device as recited in claim 1, wherein said at least one facet of play is one of teeing off, moving down a fairway, putting out, culling up trailing golfers, and moving between holes.

3. A device as recited in claim 1, wherein said entering means enters said desired duration for said at least one independent facet of play as one of fixed amounts for individual holes, a fixed amount for a series of said holes of said golf course, and all of said holes of said golf course.

4. A device as recited in claim 1, wherein said desired duration for said at least one independent facet of play is entered as one of a fixed amount of time and a proportion of said desired duration period for said round of golf.

5. A device as recited in claim 1, wherein said first hand rotates a fixed angular amount for each unit of movement, and completes said each unit of movement at a variable rate determined by said desired duration of said at least one independent facet of play and a number of said units of movement required for said at least one facet of play and said desired duration period for said round of golf.

6. A device as recited in claim 1, further comprising means to start said round of golf at any of said eighteen holes.

7. A device as recited in claim 6, further comprising means for moving said first rotating hand forward and backward one hole at a time.

8. A device as recited in claim 1, further comprising means for entering a golfer's current location on said golf course and means for recalculating a rate of play to complete said round of golf in said desired duration period.

9. A device as recited in claim 8, further comprising a second rotating hand which rotates at a rate determined by said recalculating means, said second hand indicating where said golfer should be at any given time in order to complete said round of golf in said desired duration period based upon said recalculated rate.

10. A device as recited in claim 1, wherein said desired duration period and said desired duration for said at least one independent facet of play are downloaded from a computer.

11. A device as recited in claim 1, wherein said desired duration period and said desired duration for said at least one independent facet of play are downloaded from a compact disk read only memory (CD ROM).

12. A device as recited in claim 1, wherein said desired duration period and said desired duration for said at least one independent facet of play are downloaded via the Internet.

13. A device for monitoring progress of a game of golf relative to a target time as recited in claim 1, that provides a means by which the parameters for the round are downloaded from a compact disk read only memory (CD ROM).

14. A device for monitoring progress of golf play comprising:

a dial having eighteen uniform segments corresponding to holes of a round of golf;

means for entering desired durations for individual facets of play for said holes;

means for determining a desired duration for said round of golf as a sum of said desired durations for said individual facets of play for all of said holes of said round of golf;

a first rotating hand indicating a position on one of said segments corresponding to a position at one of said holes a golfer should be at, at a given time, in order to complete said round of golf in said desired duration period;

means for rotating said first rotating hand at varying speeds determined by said desired duration period for said round of golf and said desired duration period for said at least one independent facet of play on each of said holes, said first rotating hand rotating one complete revolution in said desired duration period for a round of golf;

said segments comprising markings corresponding to said at least one independent facet of play, wherein said first rotating hand crosses said markings in said desired duration for said at least one independent facet of play; and means for starting and stopping said rotating means.

15. A device for monitoring progress of golf play comprising:

means for setting a desired duration period for said round of golf;

a display having:

a linear element which moves across said display to indicate a golfer's progress on a golf course;

a tee element, a fairway element and a green element for a hole, said linear moving relative to said tee, fairway and green elements; and a hole number indicator representing what hole a golfer should be at to complete a round of golf in said desired duration period;

means for entering a desired duration for said tee, said fairway and said green;

means for advancing said linear element at varying speeds determined by said desired duration period for said round of golf and said desired duration period for said tee, fairway and green on each of said holes of said golf course; and means for starting and stopping movement of said linear element.

16. A device for monitoring progress of golf play comprising:

a dial having eighteen uniform segments corresponding to holes of a round of golf;

means for setting a desired duration period for said round of golf;

means for entering a desired duration for at least one facet of play;

means for illuminating an arcuate portion of said dial to indicate a position on one of said segments corresponding to a position at one of said holes a golfer should be at, at a given time, in order to complete said round of golf in said desired duration period;

means for increasing a size of said arcuate portion in a clockwise manner at varying speeds determined by said desired duration period for said round of golf and said desired duration period for said at least one independent facet of play on each of said holes, said illuminating means illuminating all of said dial in said desired duration period for a round of golf;

said segments comprising markings corresponding to said at least one independent facet of play, wherein an advancing edge of said illuminating means crosses said markings in said desired duration for said at least one independent facet of play; and means for starting and stopping said illuminating means.

17. A device for monitoring progress of golf play comprising:

means for setting a desired duration period for said round of golf;

a display having:

a message portion to inform a golfer where to be on a golf course at any given time relative to tees, fairways and greens for eighteen holes of said golf course;

means for entering a desired duration period for said round of golf;

means for setting a desired duration for said tee, said fairway and said green for each of said eighteen holes;

means changing a length of said message portion at varying speeds determined by said desired duration period for said round of golf and said desired duration period for said tee, fairway and green on each of said holes of said golf course; and means for starting and stopping said device.

18. A device for monitoring progress of golf play comprising:

means for setting a desired duration period for said round of golf;

a means for providing an audio message signal, said audio message signal including information telling a golfer where to be on a golf course at any given time relative to tees, fairways and greens for eighteen holes of said golf course;

means for entering a desired duration period for said round of golf;

means for setting a desired duration for said tee, said fairway and said green for each of said eighteen holes;

means changing said audio message signal at varying speeds determined by said desired duration period for said round of golf and said desired duration period for said tee, fairway and green on each of said holes of said golf course; and means for starting and stopping said device.

19. A device for monitoring progress for golf play comprising;

a display for indicating a golfer's progress on a golf course;

means for inputting a desired duration period for a round of golf and a desired duration for at least one facet of play;

said display advancing based upon said desired duration period for said round of golf and said desired duration for said at least one facet of play;

means for starting and stopping said progress monitored device.

20. A device for monitoring progress of golf play as recited in claim 19, wherein said inputting means is a keyboard.

21. A device for monitoring progress of golf play as recited in claim 20, wherein said keyboard is a separate detachable unit.

22. A device for monitoring progress of golf play as recited in claim 19, wherein said display shows multiple lines of text.

23. A device for monitoring progress of golf play as recited in claim 19, wherein said inputting device is a computer connected by direct cable connection to said progress monitor device.

24. A device for monitoring progress of golf play as recited in claim 19, wherein said inputting device is a computer connected by modem to said progress monitor device.

25. A device for monitoring progress of golf play as recited in claim 19, wherein said inputting device is a compact disk read only memory (CD ROM).

* * * * *